US011493860B2

(12) United States Patent
Mizukoshi et al.

(10) Patent No.: US 11,493,860 B2
(45) Date of Patent: Nov. 8, 2022

(54) TONER CARTRIDGE, DEVELOPING UNIT, PROCESS CARTRIDGE, AND IMAGE FORMING APPARATUS

(71) Applicant: CANON KABUSHIKI KAISHA, Tokyo (JP)

(72) Inventors: Shunsuke Mizukoshi, Tokyo (JP); Seiichi Shinohara, Shizuoka (JP); Masanori Tanaka, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/370,172

(22) Filed: Jul. 8, 2021

(65) Prior Publication Data

US 2022/0011692 A1 Jan. 13, 2022

(30) Foreign Application Priority Data

Jul. 10, 2020 (JP) ..... JP2020-119123

(51) Int. Cl.
*G03G 15/08* (2006.01)

(52) U.S. Cl.
CPC ..... *G03G 15/0886* (2013.01); *G03G 15/0872* (2013.01); *G03G 15/0891* (2013.01)

(58) Field of Classification Search
CPC ..... G03G 15/0891; G03G 15/0872
See application file for complete search history.

(56) References Cited

U.S. PATENT DOCUMENTS 10,126,681 B2 11/2018 Nishiyama
2013/0259532 A1* 10/2013 Kubota ..... G03G 15/0886 399/254

FOREIGN PATENT DOCUMENTS

JP 2017182009 A 10/2017

* cited by examiner

*Primary Examiner* — Victor Verbitsky
(74) *Attorney, Agent, or Firm* — Rossi, Kimms & McDowell LLP

(57) ABSTRACT

In a toner cartridge configured such that, by rotating a toner housing portion relative to a shutter in a state in which a first portion-to-be-engaged is engaged to a first engaging portion of a developing unit, relative positions of a cover and the shutter are displaced from first relative position, in which a closing portion opposes a second opening, to second relative position, in which the interior of the toner housing portion communicates with the developing unit through a first opening and the second opening, and a second portion-to-be-engaged is engaged to a second engaging portion of the developing unit, thereby being attached to the developing unit, a biasing member is provided in order to exert a biasing force for generating relative rotation between the cover and the shutter in a direction for displacing the relative positions thereof from the second relative position to the first relative position.

28 Claims, 40 Drawing Sheets

9

9

TONER CARTRIDGE, DEVELOPING UNIT, PROCESS CARTRIDGE, AND IMAGE FORMING APPARATUS

BACKGROUND OF THE INVENTION

Field of the Invention

The present invention relates to a toner cartridge, a developing unit, and a cartridge such as a process cartridge provided in an image forming apparatus using an electrophotographic system.

Description of the Related Art

Conventionally, an electrostatic recording system, an electrophotographic recording system, and so on are widely used in image forming apparatuses such as copiers and printers. In one of these systems, an image is formed on a recording material by forming a toner image on a photosensitive drum and transferring the toner image onto a sheet serving as the recording material. In order to facilitate maintenance at this time, a system in which some of the components of the image forming apparatus are provided in a cartridge that can be attached to and detached from an apparatus main body, and maintenance and exchange are performed by detaching the cartridge from the apparatus main body, is widely used. Japanese Patent Application Publication No. 2017-182009, for example, discloses a configuration in which a shutter provided on a toner cartridge is opened and closed in accordance with operations performed by a user to attach and detach the toner cartridge to and from a developing unit.

SUMMARY OF THE INVENTION

However, when the toner cartridge attached to the developing unit is detached from the developing unit and then reattached to the developing unit, a part of the toner cartridge may interfere with the developing unit, making it impossible to attach the toner cartridge smoothly.

An object of the present invention is to provide a technique with which a toner cartridge can be reattached smoothly.

To achieve the object described above, a toner cartridge according to the present invention, which can be attached to and detached from a developing unit of an image forming apparatus for forming an image on a recording material, includes:

a toner housing portion that houses toner and that has a first end portion and a second end portion on an opposite side to the first end portion in a longitudinal direction of the toner cartridge;

a conveyance member that is disposed in the interior of the toner housing portion, includes a rotary axis, and that conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the toner cartridge is configured such that by rotating the toner housing portion relative to the shutter in a state in which the first portion-to-be-engaged is engaged to a first engaging portion of the developing unit, relative positions of the cover and the shutter are displaced from first relative position, in which the closing portion opposes the second opening, to second relative position, in which the interior of the toner housing portion communicates with a reception port of the developing unit through the first opening and the second opening, and the second portion-to-be-engaged is engaged to a second engaging portion of the developing unit, thereby completing attachment of the toner cartridge to the developing unit, and wherein the toner cartridge includes a biasing member that exerts a biasing force for generating relative rotation between the cover and the shutter in a direction for displacing the relative positions thereof from the second relative position to the first relative position.

To achieve the object described above, a toner cartridge according to the present invention, which can be attached to and detached from a developing unit of an image forming apparatus for forming an image on a recording material, includes:

a toner housing portion that houses toner and that has a first end portion and a second end portion on an opposite side to the first end portion in a longitudinal direction of the toner cartridge;

a conveyance member that is disposed in the interior of the toner housing portion, includes a rotary axis, and conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the toner cartridge is configured such that by rotating the toner housing portion relative to the shutter in a state in which the first portion-to-be-engaged is engaged to a first engaging portion of the developing unit, relative positions of the cover and the shutter are displaced from first relative position, in which the closing portion opposes the second opening, to second relative position, in which the interior of the toner housing portion communicates with a reception port of the developing unit through the first opening and the second opening, and the second portion-to-be-engaged is engaged to a second engaging portion of the developing unit, thereby completing attachment of the toner cartridge to the developing unit, wherein the first portion-to-be-engaged and the second portion-to-be-engaged are configured such that before the toner housing portion is rotated relative to the shutter during attachment of the toner cartridge to the developing unit, the first portion-to-be-engaged and the second portion-to-be-engaged, in a case of being seen in the axial direction, are set in a first arrangement arranged side by side in an attachment direction in which the toner cartridge is attached to the developing unit, and after the toner housing portion is rotated relative to the shutter, the first portion-to-be-engaged and the portion-to-be-engaged are set in a second arrangement arranged side by side in a direction that intersects the attachment direction, and wherein the first portion-to-be-engaged has a tapered shape in a case of being seen in the axial direction, the tapered shape being formed so that even though an angle of the first portion-to-be-engaged relative to the second portion-to-be-engaged in the first arrangement is displaced within a predetermined range, a width of the first portion-to-be-engaged and the second portion-to-be-engaged in an orthogonal direction to the attachment direction, in a case where the first portion-to-be-engaged and the second portion-to-be-engaged are projected in the attachment direction, does not vary.

To achieve the object described above, a developing unit according to the present invention, which is provided in an image forming apparatus for forming an image on a recording material, includes:

a carrier that carries toner;

a casing in which the carrier is incorporated, the casing having a first toner housing chamber for housing the toner; and a toner cartridge that can be attached to and detached from the casing, wherein the casing comprises:

a reception port that receives toner supplied from the toner cartridge; and an attachment portion including a first engaging portion and a second engaging portion for engaging the toner cartridge to the casing, wherein the toner cartridge comprises:

a toner housing portion that houses the toner and that has a first end portion and a second end portion on an opposite side to the first end portion in a longitudinal direction of the toner cartridge;

a conveyance member that is disposed in the interior of the toner housing portion, includes a rotary axis, and conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the first portion-to-be-engaged and the second portion-to-be-engaged, in a case of being seen in the axial direction, are configured to be capable of taking a first arrangement arranged side by side in an attachment direction in which the toner cartridge is attached to the developing unit, and a second arrangement arranged side by side in a direction that intersects the attachment direction, wherein the toner cartridge is configured such that in a case where the toner cartridge is to be attached to the developing unit, by rotating the toner housing portion relative to the shutter in a state in which the first portion-to-be-engaged and the second portion-to-be-engaged are inserted into the attachment portion in the first arrangement and the first portion-to-be-engaged is engaged to the first engaging portion, relative positions of the cover and the shutter are displaced from first relative position, in which the closing portion opposes the second opening, to second relative position, in which the interior of the toner housing portion communicates with the reception port through the first opening and the second opening, and the second portion-to-be-engaged is engaged to the second engaging portion after entering the second arrangement, thereby completing attachment of the toner cartridge to the developing unit, wherein the attachment portion, in a case of being seen in the axial direction, includes a pair of guide walls opposing each other in an orthogonal direction to the attachment direction, and wherein the pair of guide walls are configured such that opposing wall surfaces on the downstream side in the attachment direction form the first engaging portion, one wall surface on the upstream side in the attachment direction extends along the attachment direction and is connected to the first engaging portion, and the other wall surface on the upstream side in the attachment direction includes a tapered wall surface that inclines so as to increase the width of the attachment portion on the upstream side in the attachment direction.

To achieve the object described above, a process cartridge according to the present invention, which can be attached to and detached from an apparatus main body of an image forming apparatus for forming an image on a recording material, includes:

a photosensitive member unit including a photosensitive member on which a latent image is formed;

a developing unit for forming a toner image on the photosensitive member by developing the latent image; and the toner cartridge of the present invention.

To achieve the object described above, a process cartridge according to the present invention, which can be attached to and detached from an apparatus main body of an image forming apparatus for forming an image on a recording material, includes:

a photosensitive member unit including a photosensitive member on which a latent image is formed; and the developing unit of the present invention, for forming a toner image on the photosensitive member by developing the latent image.

To achieve the object described above, an image forming apparatus according to the present invention, which forms an image on a recording material, includes:

an apparatus main body including a photosensitive member unit that includes a photosensitive member on which a latent image is formed, a developing unit for forming a toner image on the photosensitive member by developing the latent image, and a transfer unit for transferring the toner image onto the recording material; and the toner cartridge of the present invention, which can be attached to and detached from the developing unit.

To achieve the object described above, an image forming apparatus according to the present invention, which forms an image on a recording material, includes:

a photosensitive member unit including a photosensitive member on which a latent image is formed;

the developing unit of the present invention, for forming a toner image on the photosensitive member by developing the latent image; and a transfer unit for transferring the toner image onto the recording material.

According to the present invention, a toner cartridge can be reattached smoothly.

Further features of the present invention will become apparent from the following description of exemplary embodiments with reference to the attached drawings.

DESCRIPTION OF THE EMBODIMENTS

Figure 1:
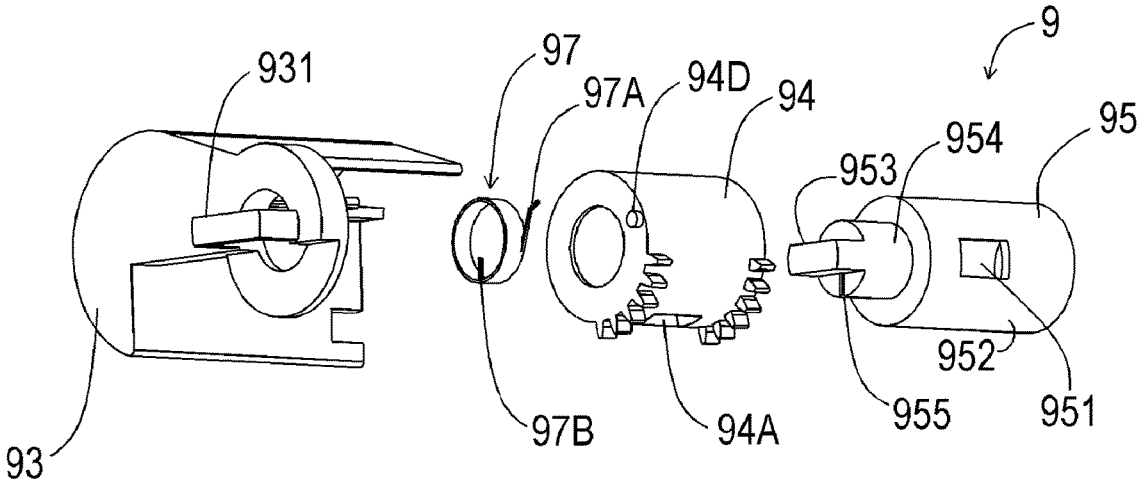
FIG. 1 is a partially exploded perspective view of a toner cartridge according to a first embodiment.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Configuration of Image Forming Apparatus According to First Embodiment

First, using FIG. 2, configurations of an image forming apparatus 1 and a cartridge unit 10 according to a first embodiment will be described.

Here, in the following description, directions are defined using a user of the image forming apparatus 1 as a reference. Specifically, a front surface side of the image forming apparatus 1 is set as "front", a back surface side is set as "rear", an upper surface (top surface) side is set as "up", and a lower surface (bottom surface) side is set as "down". Further, the left side of the image forming apparatus 1 when the image forming apparatus 1 is seen from the front surface side is set as "left", and the right side is set as "right". Likewise with regard to the cartridge unit 10, directions are defined similarly to the image forming apparatus 1 using an identical attitude to the state thereof when attached to the image forming apparatus 1 as a reference. Directions in the figures are defined by arrows drawn on the figures. A front-rear direction, an up-down direction, and a left-right direction indicated by these arrows are orthogonal to each other. These directions are the same in all of the figures. The up-down direction is parallel to a vertical direction, while the left-right direction and the front-rear direction are parallel to a horizontal direction. Furthermore, the left-right direction is parallel to respective rotary axis directions of a photosensitive drum 61 and a developing roller 71 to be described below. Here, the terms "axial direction" and "longitudinal direction", when used in the following description, denote the rotary axis directions of the photosensitive drum 61 and the developing roller 71, i.e., the left-direction direction. Moreover, a direction in which a toner cartridge 9 is inserted into a developing unit 7 will be defined as appropriate using arrows drawn on the figures.

Further, an integrated component acquired by attaching the developing unit 7 to a photosensitive member unit 6 will be referred to as a process cartridge 5. When the process cartridge 5 is attached to an apparatus main body 2, an insertion direction (attachment direction) S1 and a detachment direction S2 are substantially parallel to the front-rear direction and orthogonal to the left-right direction and the up-down direction.

Figure 2:
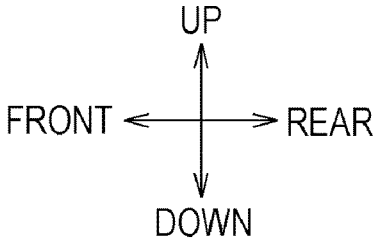
FIG. 2 is a sectional view of an image forming apparatus according to the first embodiment.
Figure 2:
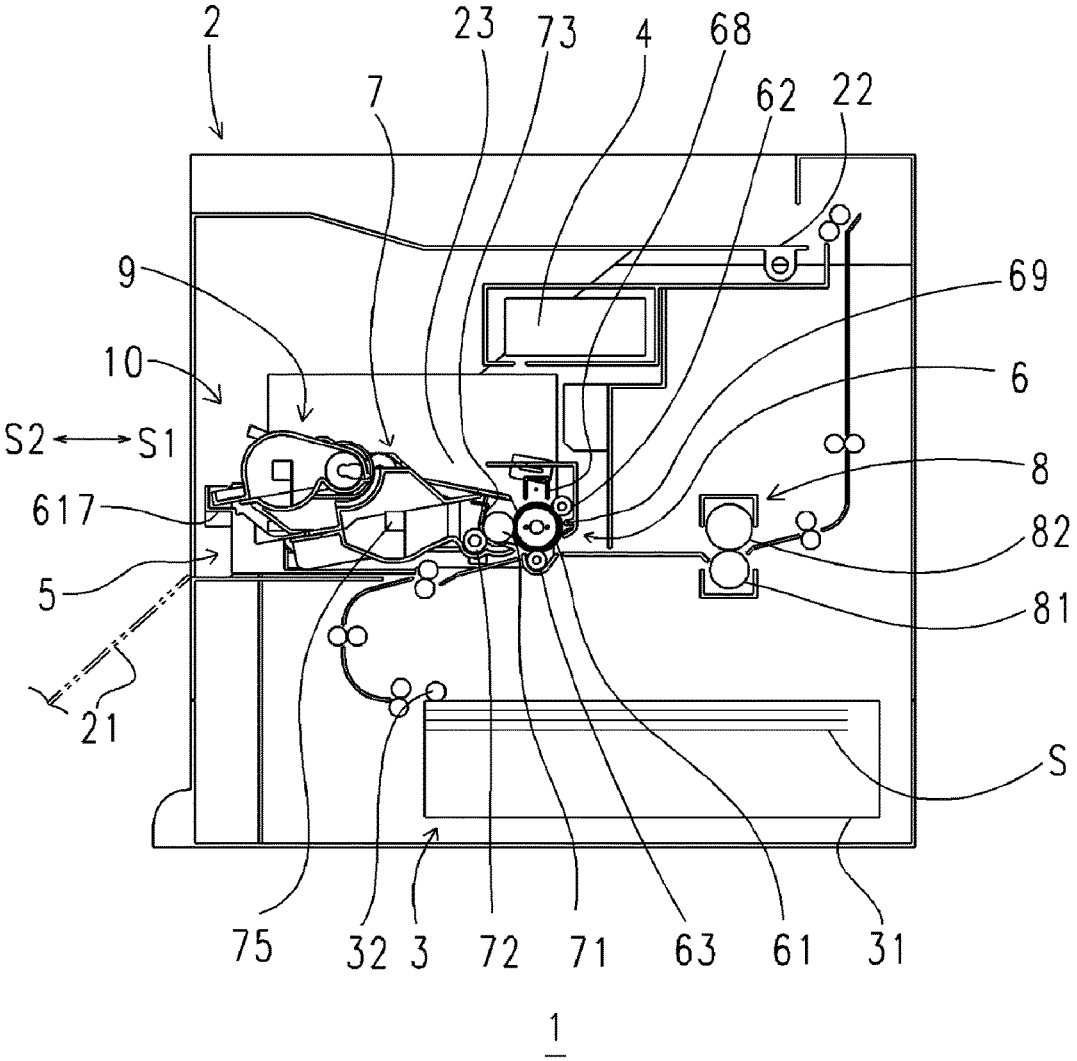

FIG. 2 is a sectional view of the image forming apparatus 1, the cross-section thereof being parallel to the up-down direction and the front-rear direction. As shown in FIG. 2, the image forming apparatus 1 mainly includes a sheet feeding portion 3 for supplying a sheet S of paper to the interior of the apparatus main body 2, an exposure apparatus 4, a cartridge unit 10 serving as a transfer unit for transferring a toner image onto the sheet S, and a fixing apparatus 8 for heat-fixing the toner image transferred onto the sheet S.

The sheet feeding portion 3 is provided in a lower portion of the apparatus main body 2 and mainly includes a sheet feeding tray 31 and a sheet feeding mechanism 32. The sheet S, which is housed in the sheet feeding tray 31 as a recording material, is supplied toward the cartridge unit 10 (between the photosensitive drum 61 and a transfer roller 63) by the sheet feeding mechanism 32.

The exposure apparatus 4 is arranged in an upper portion of the apparatus main body 2 and includes a laser light emission portion, not shown in the figure, and a polygon mirror, a lens, a reflector, and so on, which are shown without reference numerals. In the exposure apparatus 4, the surface of the photosensitive drum 61 is exposed by scanning the surface of the photosensitive drum 61 by means of high-speed scanning using a laser beam based on image data, which is emitted from the laser light emission portion.

Further, in the image forming apparatus 1, the cartridge unit 10 is provided so as to be attachable. The cartridge unit 10 is arranged below the exposure apparatus 4. The cartridge unit 10 is configured to be attached to the apparatus main body 2 by being inserted in the insertion direction S1 into a housing portion 23 of the apparatus main body 2 through an opening formed when a door 21 provided on the apparatus main body 2 is opened (illustrated by a dot-dot-dash line in FIG. 2). When the cartridge unit 10 is to be detached from the apparatus main body 2, the cartridge unit 10 is moved and detached in the detachment direction S2.

Figure 3:
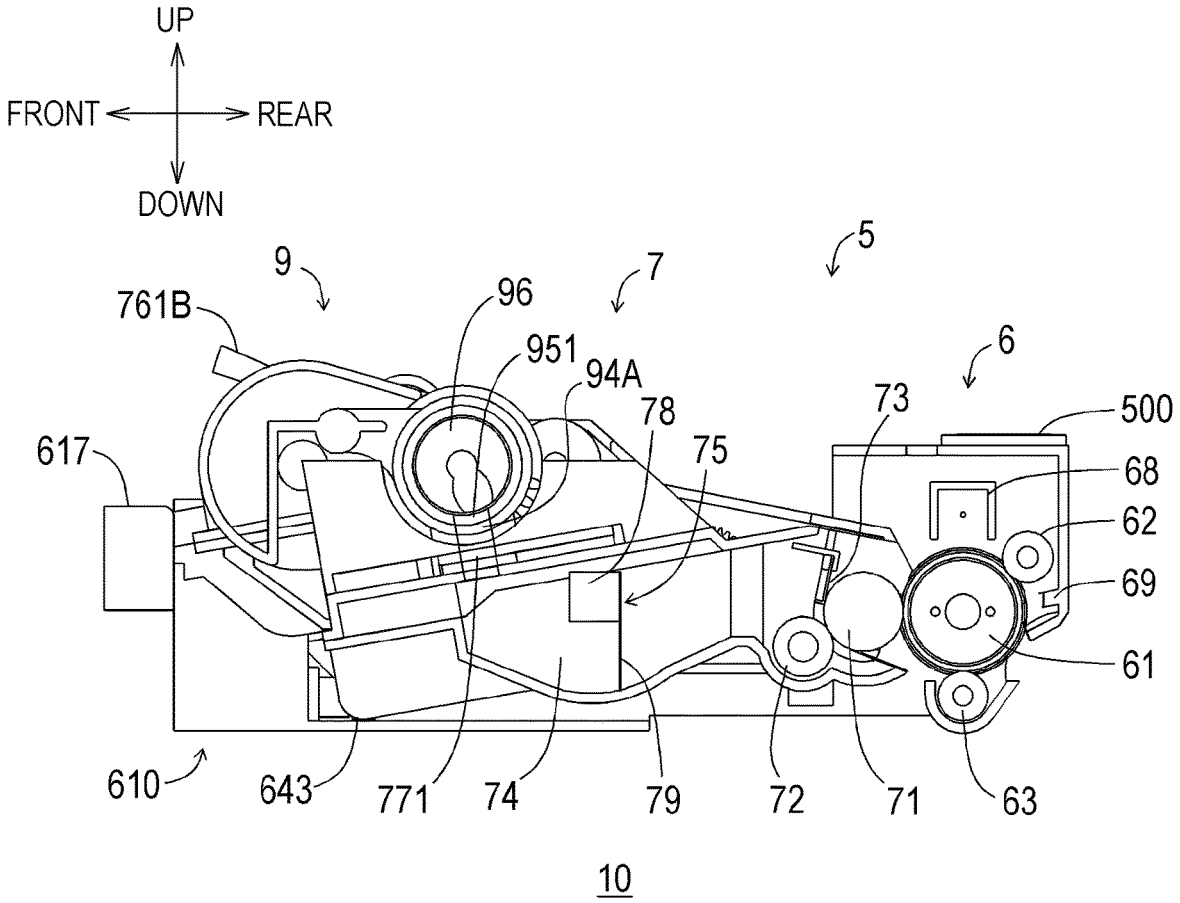
FIG. 3 is a sectional view of a cartridge unit according to the first embodiment.

Next, using FIG. 3, the configuration of the cartridge unit 10 according to the first embodiment will be described. FIG. 3 is a sectional view of the cartridge unit 10. The cartridge unit 10 is constituted by the process cartridge 5 and the toner cartridge 9. The process cartridge 5 mainly includes the photosensitive member unit 6 and the developing unit 7, and the developing unit 7 and photosensitive member unit 6 are formed integrally. The photosensitive member unit 6 mainly includes the photosensitive drum 61, a corona charger 68, a pre-exposure portion 69, a recovery roller 62, and a transfer roller 63. The developing unit 7 mainly includes the developing roller (a developer carrying member) 71, a supply roller 72, a layer thickness regulating blade 73, a toner housing portion (a developer housing portion) 74 for housing toner (developer), and a first agitator 75 provided in the toner housing portion 74.

Image Forming Process of First Embodiment

Next, an image forming process using the cartridge unit 10 will be described using FIGS. 2 and 3.

The photosensitive drum 61 is driven to rotate during execution of the image forming process. First, the surface of the photosensitive drum 61 is uniformly charged by the corona charger 68. Next, the surface of the photosensitive drum 61 is exposed by emitting a laser beam corresponding to image data from the exposure apparatus 4, whereby an electrostatic latent image corresponding to the image data is formed.

Toner carried in the toner cartridge 9 is conveyed to the toner housing portion 74 of the developing unit 7 through a discharge port 94A, a toner passage hole 951, and a toner receiving portion 770 (FIG. 6), and normally, a predetermined amount of toner is housed in the toner housing portion 74. The toner in the toner housing portion 74, which serves as a toner housing chamber, is agitated by the first agitator 75 and then supplied to the developing roller 71 via the supply roller 72. The toner supplied to the developing roller 71 is then regulated to a thin layer having a constant thickness by the layer thickness regulating blade 73 and carried thus on the developing roller 71.

The toner carried on the developing roller 71 is supplied to the electrostatic latent image formed on the photosensitive drum 61. Accordingly, the toner is adhered to the electrostatic latent image, thereby making the electrostatic latent image visible, and as a result, a toner image is formed on the photosensitive drum 61. Next, the toner image on the photosensitive drum 61 is transferred onto the sheet S, which has been conveyed between the photosensitive drum 61 and the transfer roller 63.

The sheet S onto which the toner image has been transferred is then conveyed to the fixing apparatus 8. The fixing apparatus 8 mainly includes a pressing roller 81 and a heating roller 82 and is arranged to the rear of the process cartridge 5. When the sheet S passes through the fixing apparatus 8, the sheet S is pressed and heated between the pressing roller 81 and the heating roller 82, whereby the toner image is fixed on the sheet S. Having passed through the fixing apparatus 8, the sheet S is discharged onto a sheet discharge tray 22.

Note that after the toner image is transferred from the photosensitive drum 61 onto the sheet S, the charge on the surface of the photosensitive drum 61 is removed by the pre-exposure portion 69. The pre-exposure portion 69 includes a light-emitting diode serving as a light source and a light guide (not shown) serving as a light-guiding member, and guides light emitted from the light-emitting diode using the light guide so as to irradiate the surface of the photosensitive drum 61 with the light. A current is supplied to the light-emitting diode from the apparatus main body 2. Foreign matter, such as paper particles and refuse, and toner adhered to the surface of the photosensitive drum 61 are then recovered by the recovery roller 62, to which a predetermined voltage is applied from the apparatus main body 2.

Configuration of Cartridge Unit

Next, the respective units of the cartridge unit 10 will be described in further detail. As noted above, the cartridge unit 10 is constituted by the process cartridge 5, in which the developing unit 7 and the photosensitive member unit 6 are integrated, and the toner cartridge 9 provided detachably in the developing unit 7.

Configuration of Developing Unit

Figure 4:
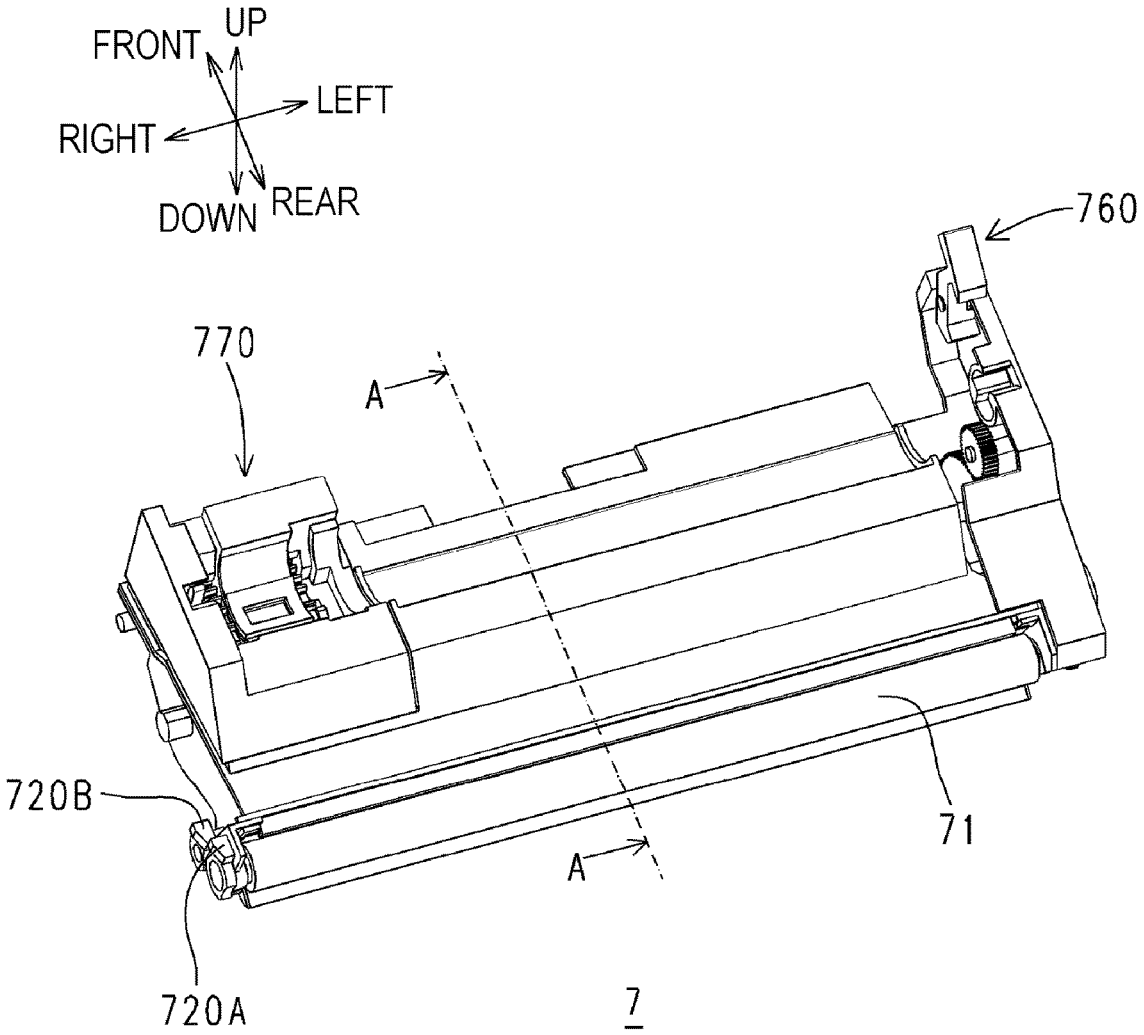
FIG. 4 is a perspective view of a developing unit according to the first embodiment.
Figure 5A:
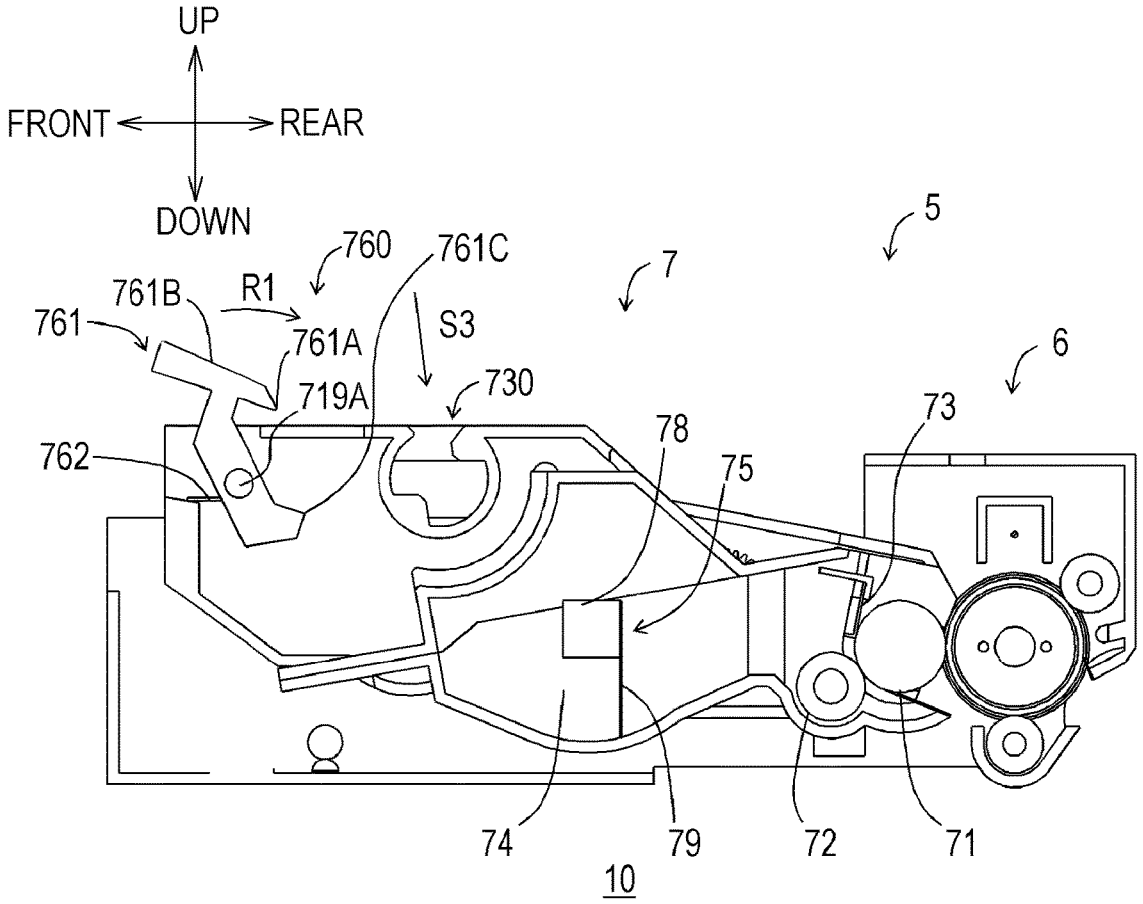
FIGS. 5A and 5B are sectional views of a process cartridge according to the first embodiment.
Figure 5B:
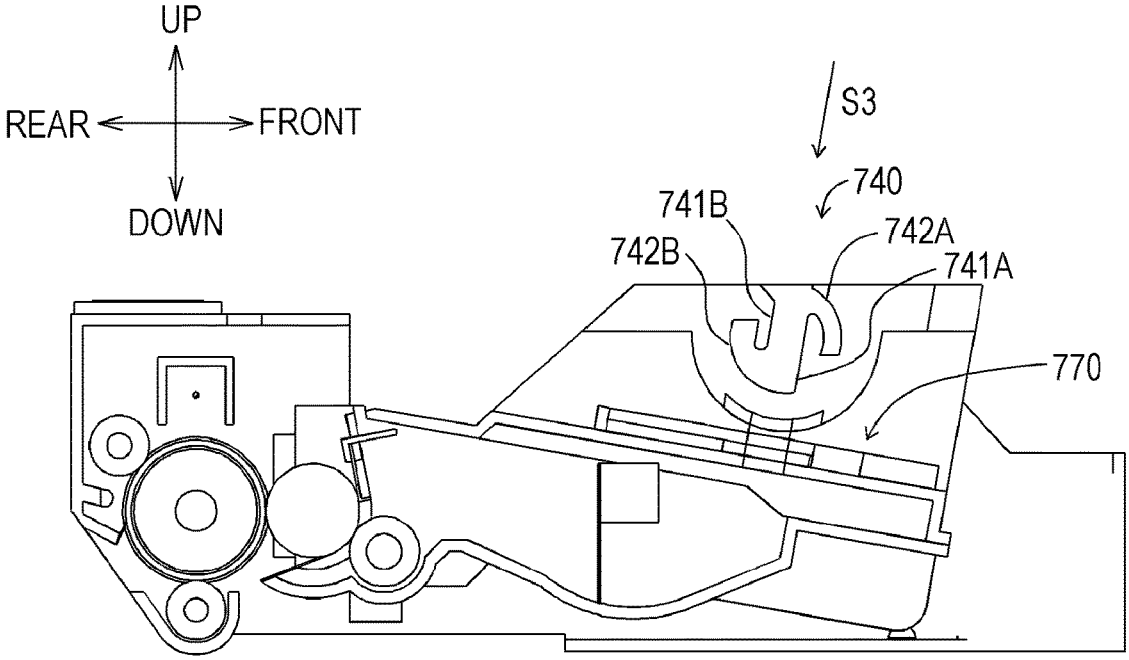
Figure 6:
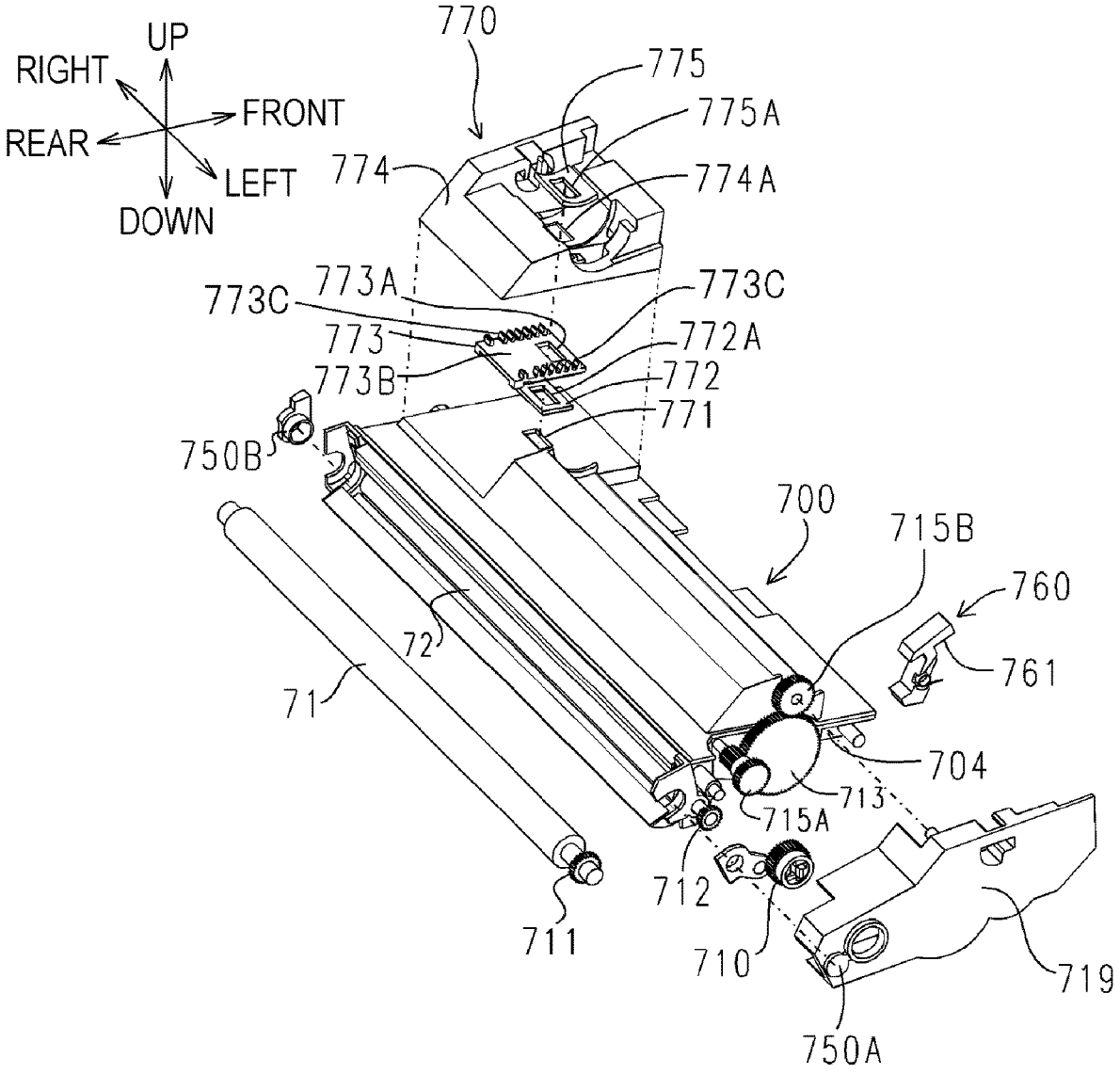
FIG. 6 is an exploded perspective view of the developing unit according to the first embodiment.
Figure 7:
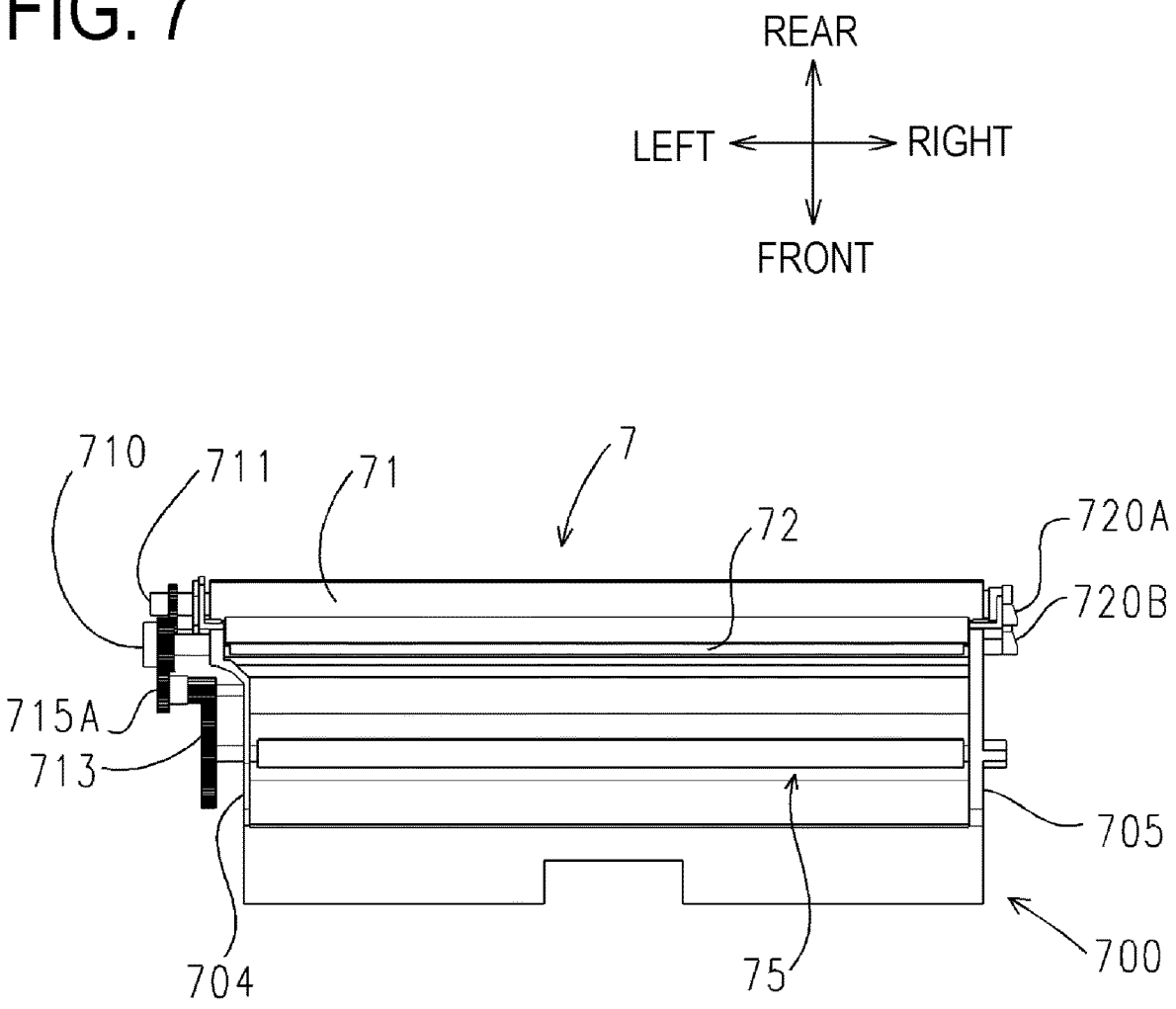
FIG. 7 is a view showing the developing unit according to the first embodiment from above.

First, the configuration of the developing unit 7 will be described using FIGS. 4 to 7. FIG. 4 is a perspective view of the developing unit 7. FIGS. 5A and 5B are sectional views of the process cartridge 5 and a sectional view of an A-A section in FIG. 4. Here, the A-A section is parallel to the up-down direction and the front-rear direction. In FIGS. 5A and 5B, FIG. 5A is a view showing the A-A section from a rightward direction with a frontward direction on the left, while FIG. 5B is a view showing the A-A section from a leftward direction with the frontward direction on the right. FIG. 6 is an exploded perspective view of the developing unit 7. FIG. 7 is a view showing the developing unit 7 from above, and for descriptive purposes shows a state in which the top surface of a casing 700 has been removed.

As shown in FIGS. 5A and 5B, in the developing unit 7, the developing roller 71 and the supply roller 72 are provided rotatably. In this case, as shown in FIG. 7, the respective ends of each of the developing roller 71 and the supply roller 72 are supported rotatably by a left side wall 704 and a right side wall 705 of the casing 700. As shown in FIG. 4, the developing unit 7 is provided with a first electrical contact 720A that is electrically connected to the developing roller 71 and supplied with a voltage to be applied to the developing roller 71. The developing unit 7 is also provided with a second electrical contact 720B that is electrically connected to the supply roller 72 and supplied with a voltage to be applied to the supply roller 72. Power is supplied to the developing roller 71 and the supply roller 72 by bringing these electrical contacts into contact with a power supply contact, not shown, provided in the apparatus main body 2.

Furthermore, the first agitator 75 for agitating the toner in the toner housing portion 74 and suppling the toner to the supply roller 72 is provided rotatably in the developing unit 7. The first agitator 75 includes an agitating rod 78 and an agitating sheet 79. Moreover, the first agitator 75 is configured to be capable of rotating when a first agitator gear 713 thereof receives driving force from a development coupling 710 via an idler gear 715A (see FIG. 7). Toner located near the first agitator 75 in the toner housing portion 74 is agitated by the first agitator 75, then supplied to the supply roller 72 side, and then supplied to the developing roller 71 by the supply roller 72.

In addition, the toner cartridge 9 for supplying the toner is attachable to the developing unit 7, and therefore, as shown in FIG. 6, the developing unit 7 is provided with the toner receiving portion 770 for receiving the toner supplied by the toner cartridge 9. The developing unit 7 also includes a lift mechanism 760 (a lock mechanism) for holding and lifting up the toner cartridge 9. As shown in FIGS. 5A and 5B, a support portion 730 and a support portion 740 (a support portion) for holding the toner cartridge 9 on the developing unit 7 are provided on respective longitudinal direction sides. The receiving portion 770, the lift mechanism 760, the support portion 730, and the support portion 740 will be described in more detail in order below.

Next, a drive configuration of the developing unit 7 will be described using FIG. 6. As shown in FIG. 6, the development coupling 710, a developing roller gear 711, a supply roller gear 712, the first agitator gear 713, and idler gears 715A, 715B are provided on the left side of the left side wall 704 of the casing 700. The developing roller gear 711 is fixed to an end portion of the developing roller 71, and the supply roller gear 712 is fixed to an end portion of the supply roller 72. Further, the first agitator gear 713 is fixed to an end portion of the agitating rod 78 of the first agitator 75. In conjunction with an operation for closing the door 21 (illustrated in FIG. 2) provided on the apparatus main body 2, a development drive transmission member, not shown, provided in the apparatus main body 2 moves to a position for engaging with the development coupling 710. Conversely, in conjunction with an operation for opening the door 21, the development drive transmission member (not shown) moves to a position for releasing the engagement with the development coupling 710. When the apparatus main body 2 operates after the door 21 is closed, driving force is transmitted to (input into) the development coupling 710, which serves as a driving force reception member, from the development drive transmission member (not shown). Next, the developing roller 71 and the supply roller 72 become capable of rotating, via the developing roller gear 711 and the supply roller gear 712, respectively, due to a gear provided on a peripheral surface of the development coupling 710. The development drive transmission member (not shown) is configured to be capable of transmitting driving force to the development coupling 710 by allowing the position of the development coupling 710 to shift within a predetermined range. Axial direction movement of the development coupling 710, the developing roller gear 711, and the supply roller gear 712 is restricted by a side holder 719 attached to the casing 700.

Configuration of Photosensitive Member Unit and Support of Developing Unit

Figure 8:
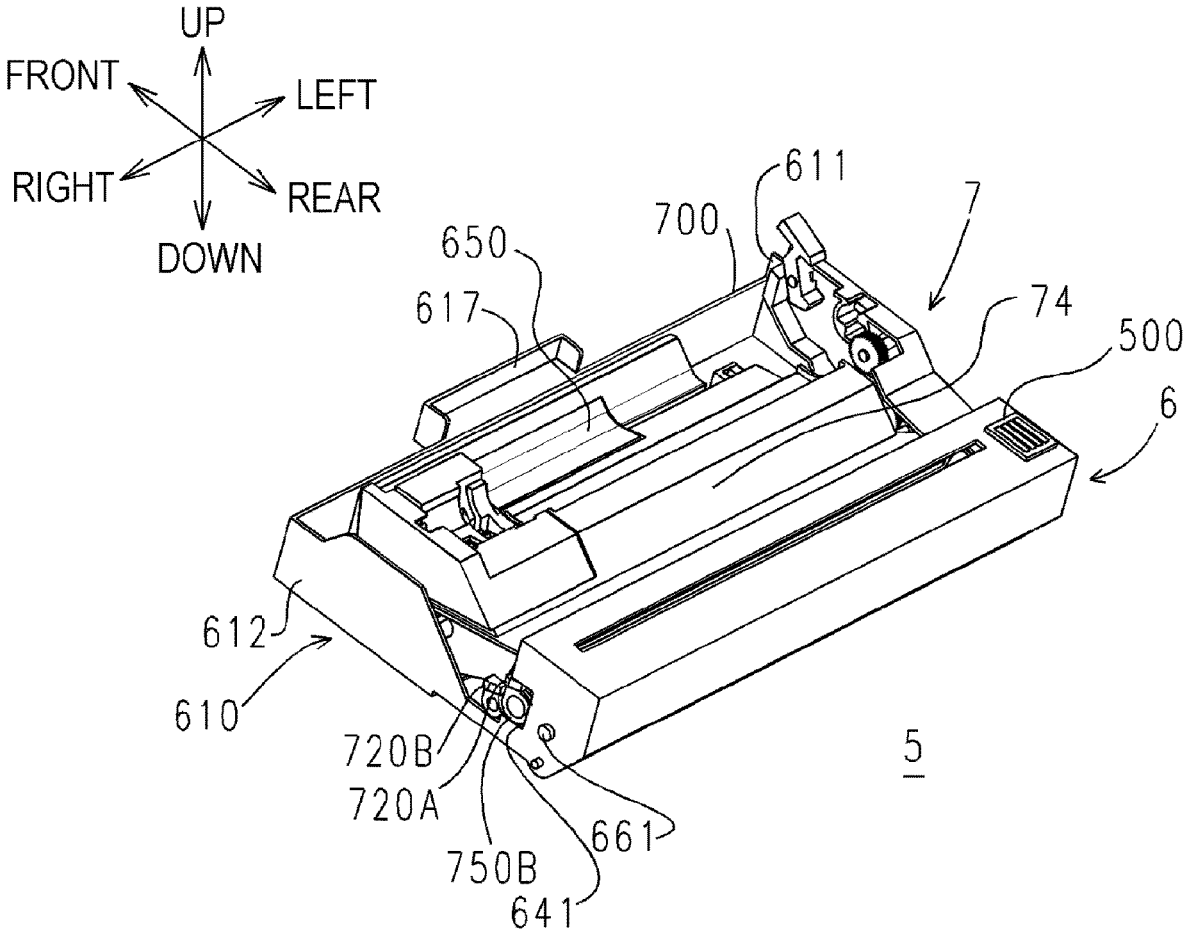
FIG. 8 is a perspective view of the process cartridge according to the first embodiment.
Figure 9:
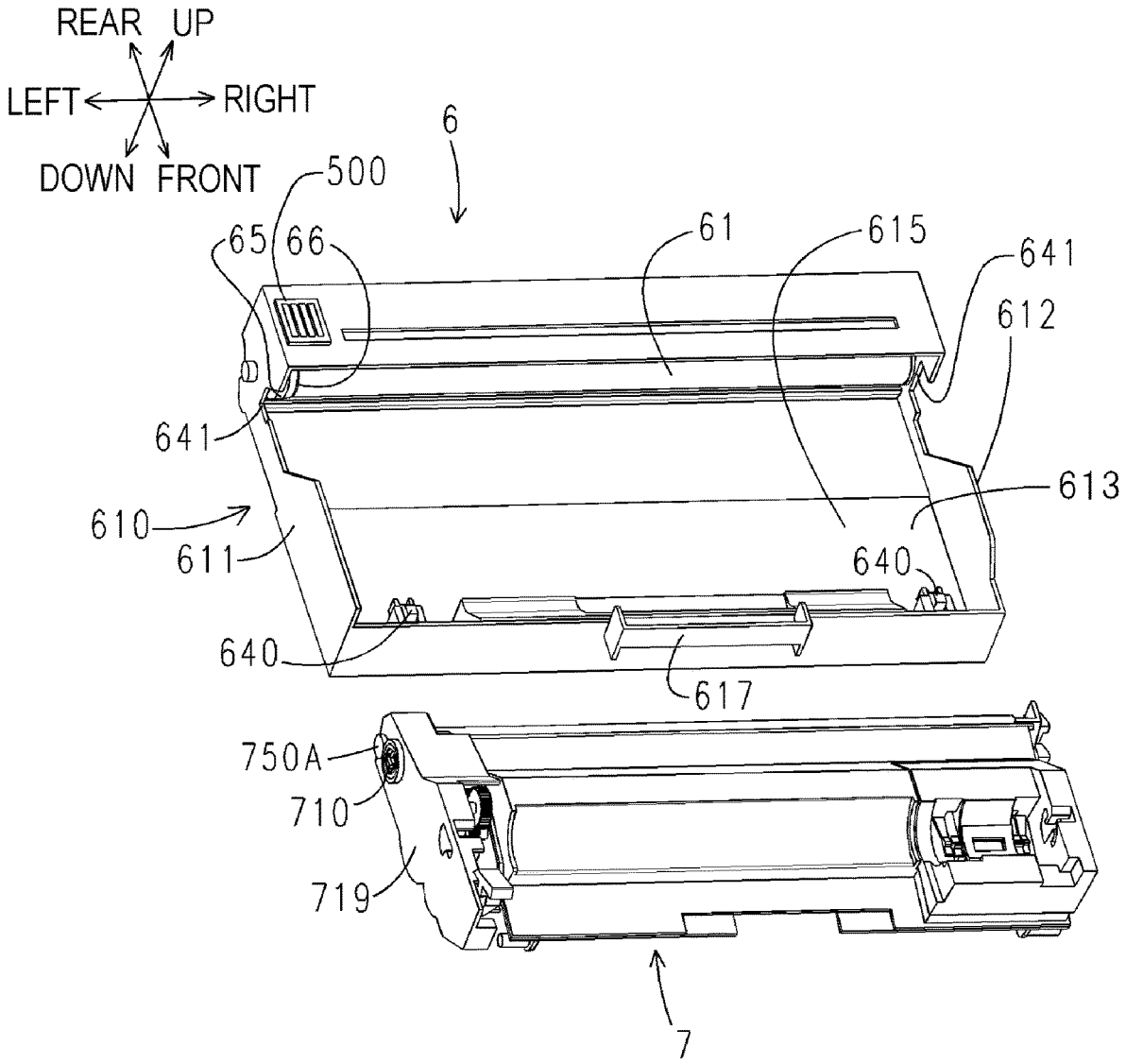
FIG. 9 is a perspective view of the developing unit and a photosensitive member unit according to the first embodiment.
Figure 10:
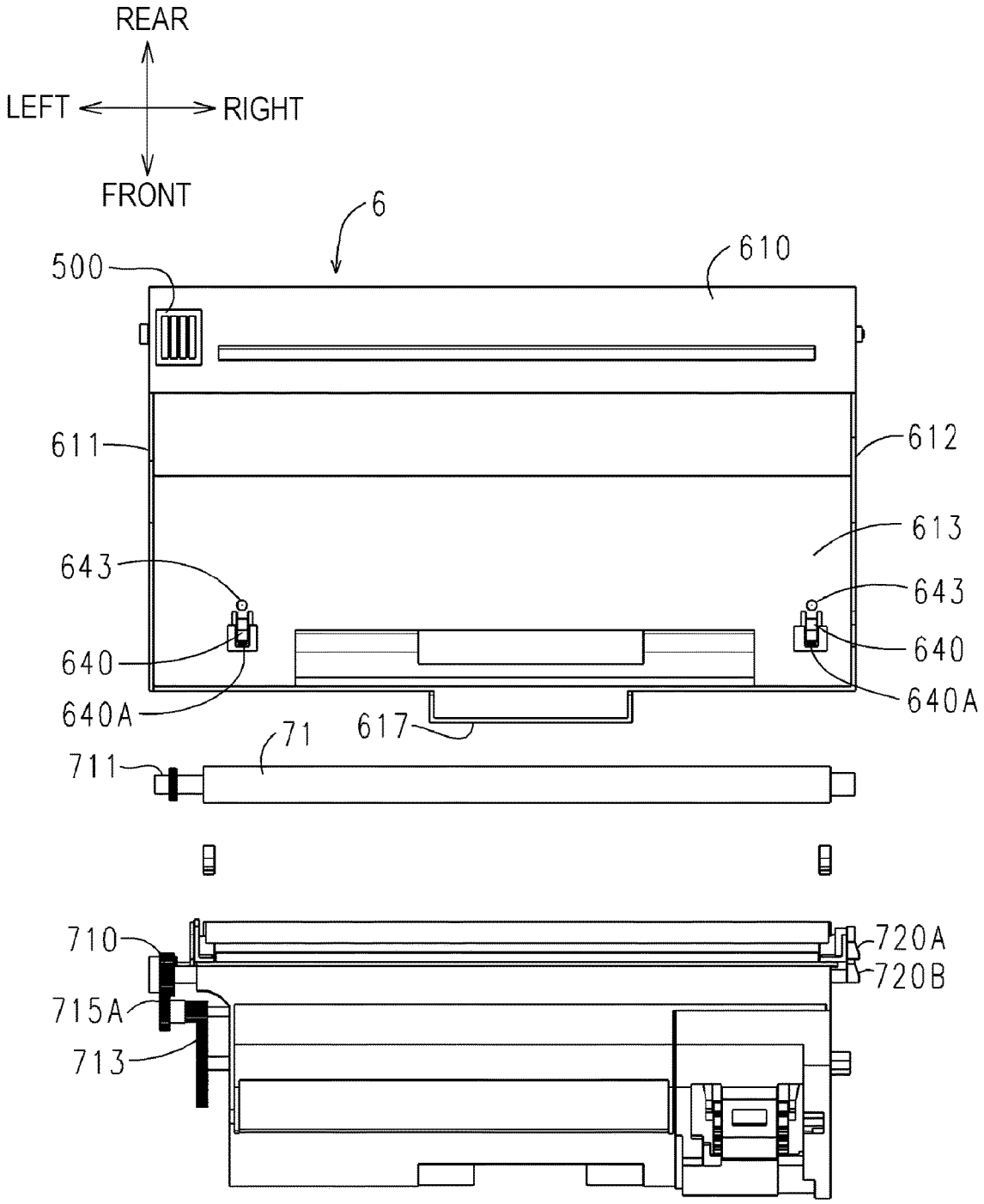
FIG. 10 is a view showing the photosensitive member unit and the developing unit according to the first embodiment from above.
Figure 11:
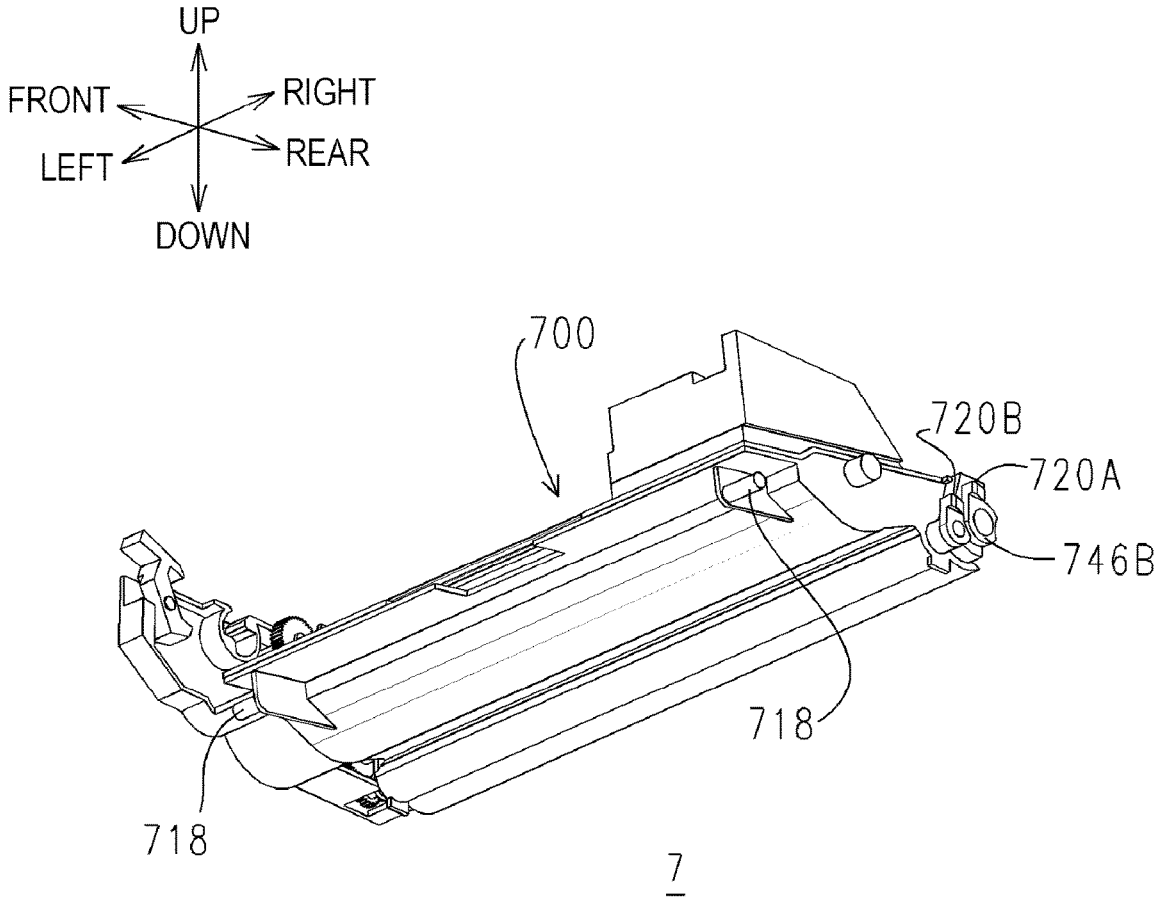
FIG. 11 is a perspective view of the developing unit according to the first embodiment.
Figure 12:
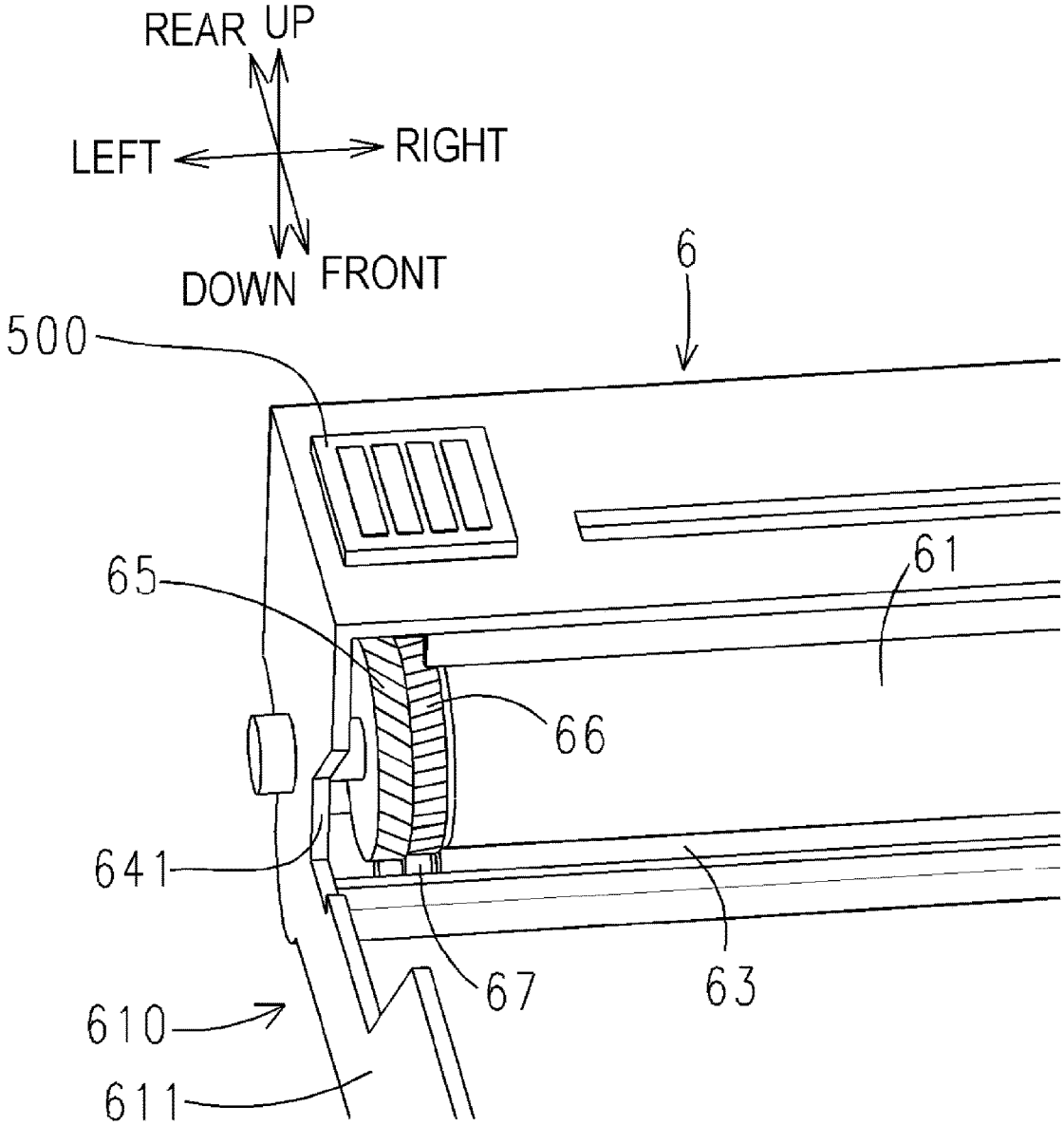
FIG. 12 is a partial perspective view of the photosensitive member unit according to the first embodiment.

Next, the detailed configuration of the photosensitive member unit 6 and a configuration for supporting the developing unit 7 within the process cartridge 5 will be described using FIGS. 8 to 12. FIG. 8 is a perspective view of the process cartridge 5. FIG. 9 is a perspective view of the developing unit 7 and the photosensitive member unit 6. FIG. 10 is a view showing left-right direction positional relationships between the photosensitive member unit 6, the developing unit 7, and the developing roller 71 from above. FIG. 11 is a perspective view showing the developing unit 7 from below. FIG. 12 is a partial perspective view of the photosensitive member unit 6.

As shown in FIG. 9, the photosensitive member unit 6 mainly includes a frame 610 having a left side wall 611 and a right side wall 612 forming a pair, and the photosensitive drum 61, which is supported rotatably at the rear of the frame 610. An attachment portion 615 to which the developing unit 7 can be attached and a gripping portion 617 by which the user grips the photosensitive member unit 6 are provided at the front of the frame 610.

As shown in FIG. 8, the toner housing portion 74 of the developing unit 7 is attached to the attachment portion 615, which is positioned between the left side wall 611 and the right side wall 612 in the left-right direction. As shown in FIG. 9, receiving portions 641 for receiving rotary shaft receiving portions 750A and 750B (FIG. 8) of the developing roller 71 are formed in the left side wall 611 and the right side wall 612 of the frame 610 in front of the photosensitive drum 61. The receiving portions 641 are substantially U-shaped recesses that open frontward, and a rotary shaft (not shown) of the developing roller 71 is inserted therein. The developing unit 7 is supported in the photosensitive member unit 6 by the receiving portion 641. Further, as shown in FIG. 10, projecting portions 643 are provided so as to project in an upward direction from respective left-right direction end portions of a bottom surface 613 of the frame 610. The projecting portions 643 support the developing unit 7 by contacting a boss 718, shown in FIG. 11, provided on a bottom portion of the casing 700 of the developing unit 7. Moreover, in the configuration of this embodiment, as shown in FIG. 8, a retaining member 650 is provided to ensure that when the developing unit 7 is attached to the photosensitive member unit 6, the developing unit 7 cannot be detached.

Furthermore, as shown in FIGS. 9 and 10, the photosensitive member unit 6 includes pressing members 640. The pressing members 640 are provided on respective left-right direction end portions at the front of the frame 610 and biased in a rearward direction from the front by compression springs 640A serving as biasing members. Hence, using the biasing force of the compression springs 640A, the pressing members 640 respectively press the boss 718 (FIG. 11) provided on the casing 700 of the developing unit 7. By pressing the developing unit 7 using the pressing members 640, the developing roller 71 is biased toward the photosensitive drum 61. Further, as shown in FIG. 12, a photosensitive member gear (a first gear) 65 and a transfer gear (a second gear) 66 are fixed to a left end portion of the photosensitive drum 61 and configured to rotate integrally with the photosensitive drum 61. When the process cartridge 5 is attached to the apparatus main body 2, a drive gear (not shown) of the apparatus main body 2 is meshed to the photosensitive member gear 65 such that driving force is transmitted to the photosensitive drum 61 and the transfer gear 66, and as a result, the photosensitive drum 61 and the transfer gear 66 become able to rotate. Furthermore, the transfer gear 66 is meshed to a transfer roller gear (a third gear) 67 fixed to a left end portion of the transfer roller 63 so that the transfer roller 63 is also able to rotate.

The photosensitive member unit 6 also includes a memory tag 500. The memory tag 500 is capable of storing and transmitting various information, and by bringing a tag contact (not shown) of the apparatus main body 2 into electrical contact with an information transmission contact 500A, information is transmitted. In this embodiment, the memory tag 500 is provided on an end portion of the process cartridge 5 on the other end side, i.e., the opposite side to one end side thereof in the axial direction of the developing roller 71.

Configuration of Toner Cartridge

Figure 13:
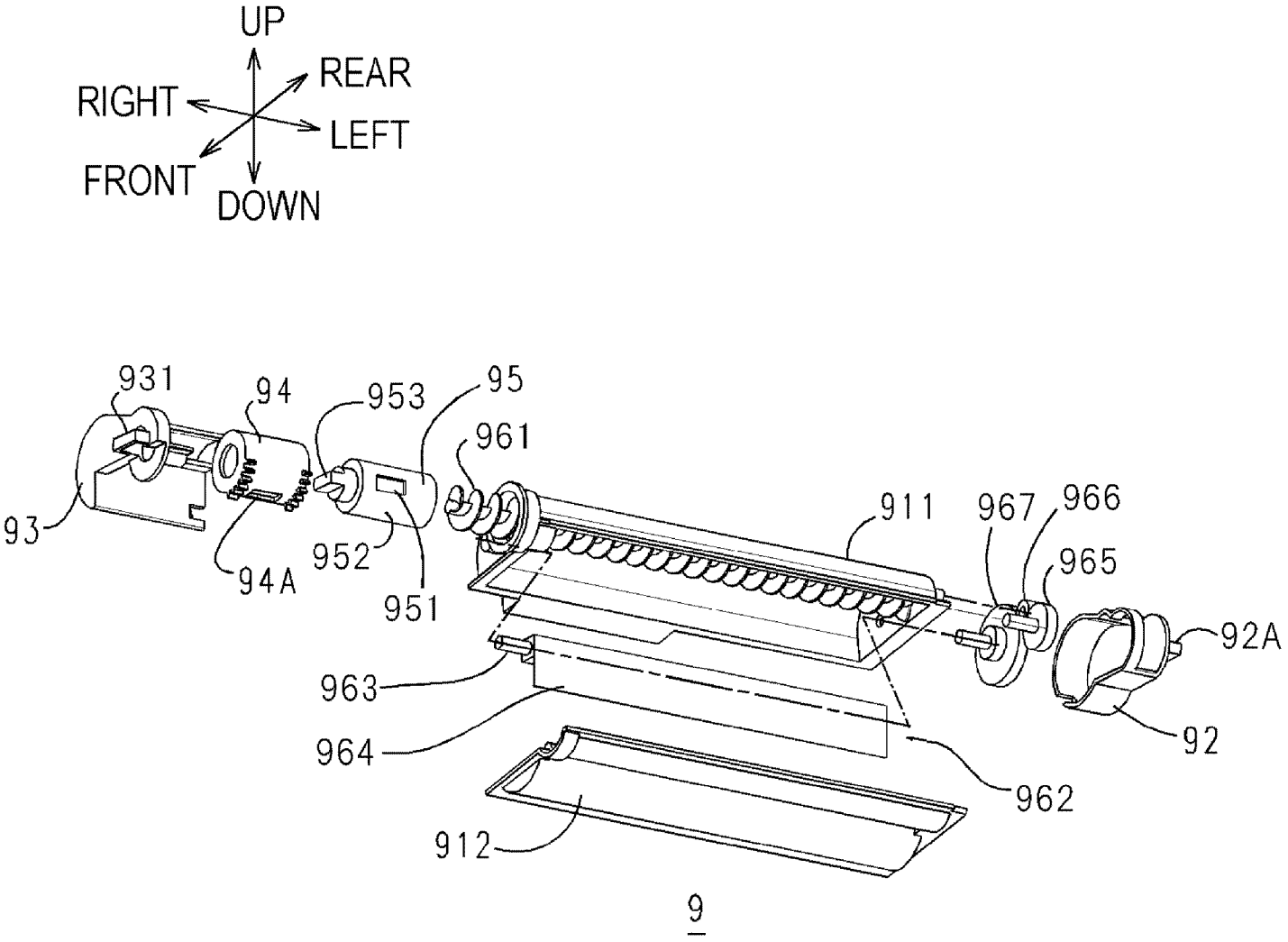
FIG. 13 is an exploded perspective view of the toner cartridge according to the first embodiment.
Figure 14:
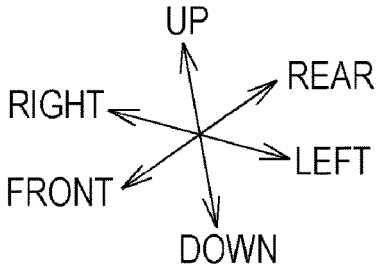
FIG. 14 is a perspective view of the toner cartridge according to the first embodiment.
Figure 14:
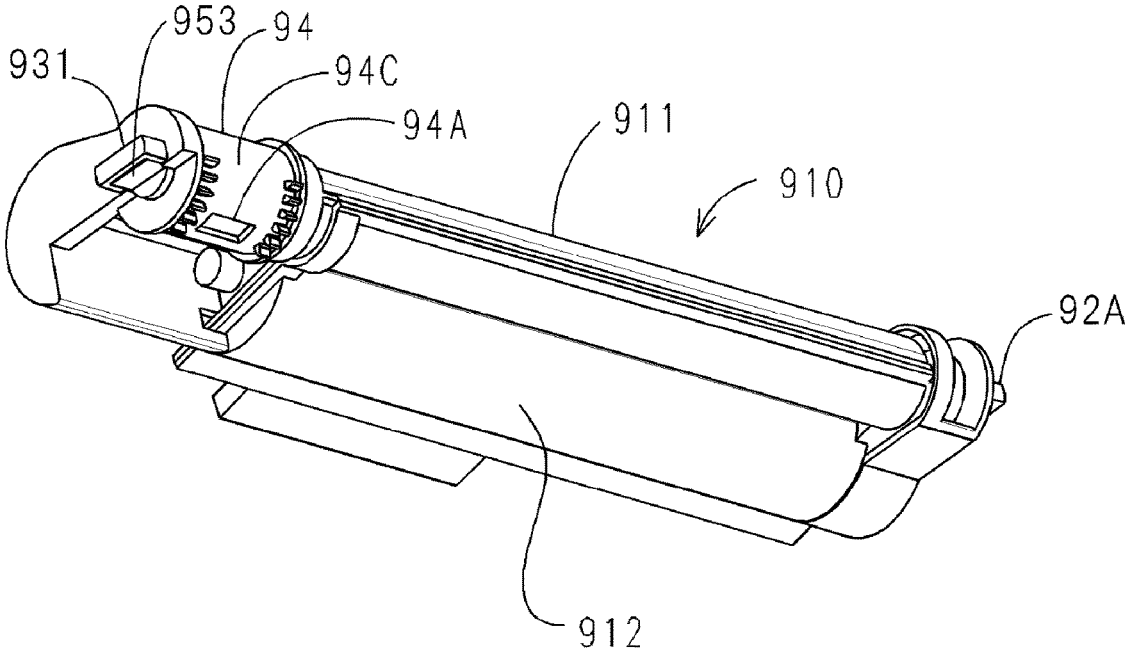

Next, a configuration of the toner cartridge 9 will be described using FIGS. 13, 14, and 15. FIG. 13 is an exploded perspective view of the toner cartridge 9, and FIG. 14 is a perspective view showing the toner cartridge 9 from below. Further, FIG. 15 is a sectional view of the toner cartridge 9.

As shown in FIG. 13, the toner cartridge 9 mainly includes a container member 911, a bottom member 912, a T-side holder 92, a T-side holder 93, a discharge port forming member 94, a discharge-side shutter 95, a conveyance screw 961, and a second agitator 962. Further, for the purpose of drive transmission, the toner cartridge 9 includes a conveyance screw gear 965, a T idler gear 966, and a second agitator gear 967.

Furthermore, in the toner cartridge 9, as shown in FIG. 14, a toner container 910 (a toner housing portion) is formed by the container member 911 and the bottom member 912, and toner is housed in the interior thereof. The toner container 910 includes a first end portion and a second end portion in a longitudinal direction of the toner cartridge 9. The first end portion is disposed at the right end portion of the toner container 910 in the longitudinal direction of the toner cartridge 9. The second end portion is disposed at the left end portion of the toner container 910 in the longitudinal direction of the toner cartridge 9. The discharge port forming member 94 (a cover) is fixed to the right end portion of the toner container 910 in the longitudinal direction. The discharge port forming member 94 has a discharge port forming surface 94C on the outer periphery thereof, and the discharge port 94A (a second opening) for discharging the toner to the outside is formed in the discharge port forming surface 94C.

Figure 15:
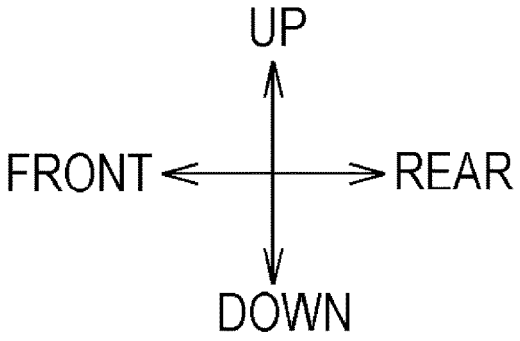
FIG. 15 is a sectional view of the toner cartridge according to the first embodiment.
Figure 15:
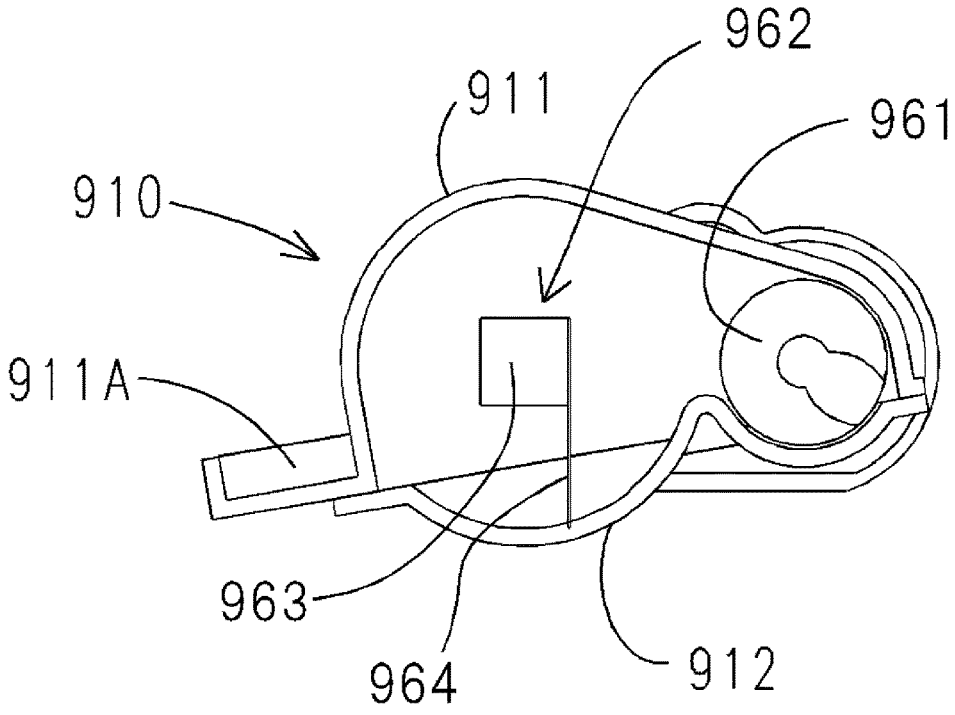

Moreover, as shown in FIG. 15, the conveyance screw 961 (a conveyance member) and the second agitator 962 (an agitating member) are provided rotatably in the interior of the toner container 910. The conveyance screw 961 and the second agitator 962 rotate when drive force is transmitted thereto respectively by the conveyance screw gear 965 and the second agitator gear 967 provided on the outside of the toner container 910 (see FIG. 13). The second agitator 962 is constituted by a second agitating rod 963 and a second agitating sheet 964. The conveyance screw 961 includes a rotary axis and a spiral-shaped blade portion provided on the outer periphery of the rotary axis. The toner housed in the toner container 910 is agitated and conveyed toward the conveyance screw 961 by the second agitator 962, then conveyed by the conveyance screw 961 toward the discharge port 94A provided in one axial direction end, as shown in FIG. 14, and then discharged through the discharge port 94A.

Furthermore, as shown in FIG. 13, the discharge-side shutter 95 (a shutter) is provided rotatably in the interior of the discharge port forming member 94. The discharge-side shutter 95 is provided with the toner passage hole 951 (a first opening) and a closing portion 952, and when the toner passage hole 951 is positioned relative to the discharge port forming member 94 so that at least a part thereof aligns with at least a part of the discharge port 94A, the toner can be discharged. In other words, the interior of the toner container 910 communicates with the outside through the toner passage hole 951 and the discharge port 94A. However, when the discharge port forming member 94 and the discharge-side shutter 95 are rotated relative to each other so that the relative positions thereof are displaced to relative positions in which the closing portion 952 faces the discharge port 94A, toner is prevented from being discharged to the outside from the interior of the toner container 910. As a result, leakage of the toner in the interior during conveyance and the like is prevented. Furthermore, an inner peripheral surface of the discharge port forming member 94 and an outer peripheral surface of the discharge-side shutter 95 are configured to be at least partially in close contact. Thus, toner leakage is suppressed.

Further, an engaged projection 953 (a projecting portion, a first portion-to-be-engaged) is provided on the discharge-side shutter 95. As shown in FIG. 14, the engaged projection 953 is partially exposed when incorporated into the toner cartridge 9, and by exerting external force on the engaged projection 953, the discharge-side shutter 95 is caused to perform a rotation operation.

As shown in FIG. 14, the T-side holder 92 and the T-side holder 93 (a holder) are respectively provided with a supported projection 92A and a supported projection 931 (a second portion-to-be-engaged). The supported projection 931 is arranged so as to cover at least a part of the engaged projection 953. The supported projection 931 is substantially U-shaped and includes a pair of leg portions and a connecting portion connecting the leg portions. The connecting portion is positioned on the outside of the engaged projection 953 in the axial direction, while the pair of leg portions are arranged to straddle the engaged projection 953 via the connecting portion and arranged substantially symmetrically relative to the engaged projection 953 when seen in the axial direction. The toner cartridge 9 is engaged to and supported on the developing unit 7 by the supported projection 92A and the supported projection 931. Note that a configuration for supporting the toner cartridge 9 will be described below.

Toner Cartridge Support

Figure 16A:
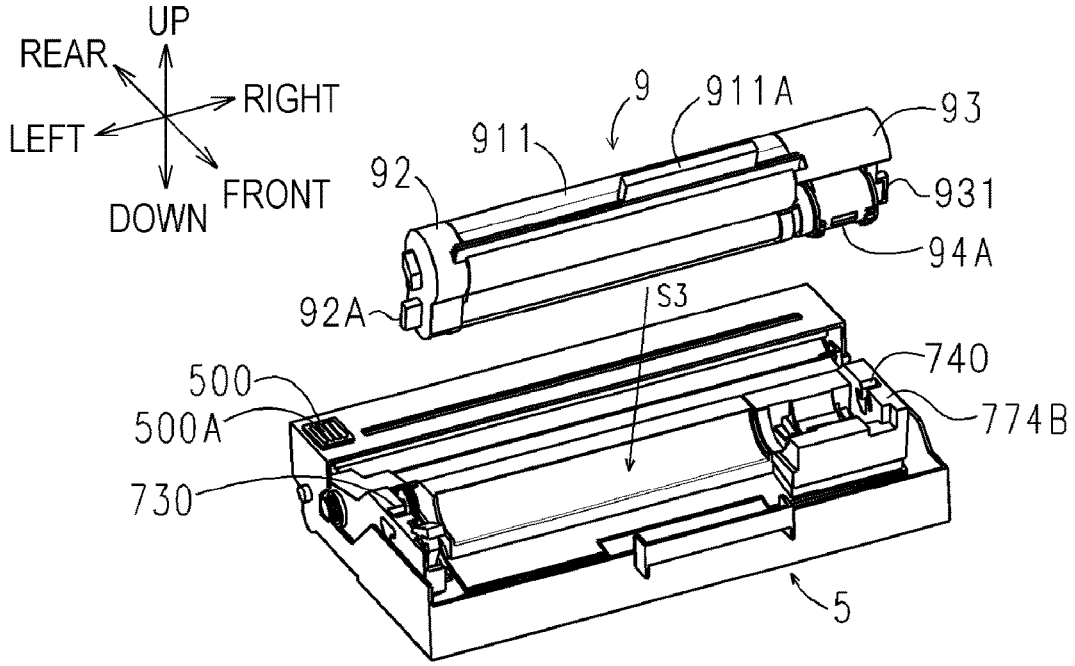
FIGS. 16A to 16C are perspective views of the toner cartridge and the process cartridge according to the first embodiment.
Figure 16B:
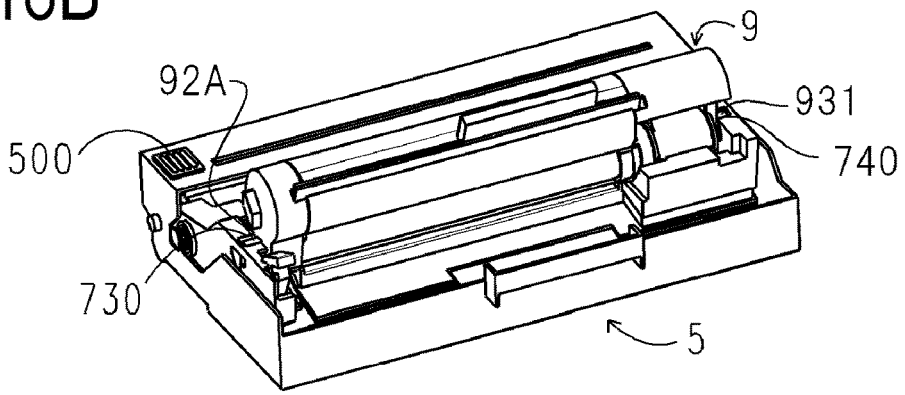
Figure 16C:
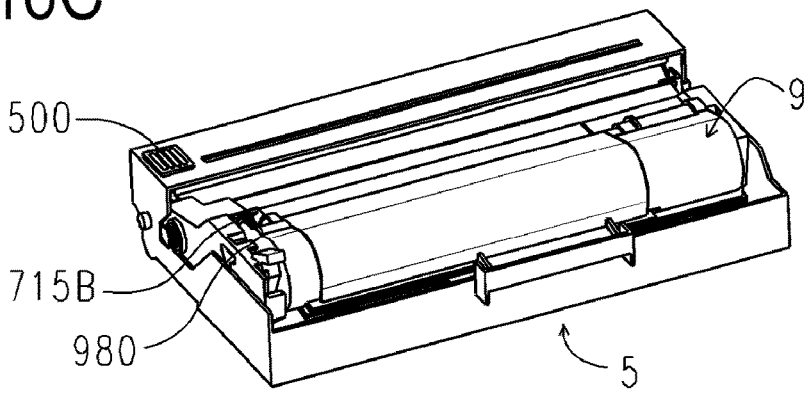

The configuration for supporting the toner cartridge 9 will now be described using FIGS. 16A to 16C. FIGS. 16A to 16C are perspective views of the toner cartridge 9 and the process cartridge 5, FIG. 16A showing a state prior to attachment of the toner cartridge 9, FIG. 16B showing the process for attaching the toner cartridge 9, and FIG. 16C showing a state in which attachment of the toner cartridge 9 is complete.

As shown in FIGS. 16A to 16C, the toner cartridge 9 is configured to be attachable to and detachable from the developing unit 7, which is attached to the process cartridge 5. A gripping portion 911A is provided on the container member 911 of the toner cartridge 9. Further, as described above, the T-side holder 92 and the T-side holder 93 are fixed to the respective longitudinal direction end portions of the toner cartridge 9. The T-side holder 92 and the T-side holder 93 respectively include a supported projection 92A and a supported projection 931 (supported projecting portions) by which the T-side holder 92 and the T-side holder 93 are supported on the developing unit 7. As also shown in FIGS. 5A and 5B, the developing unit 7 is provided with the support portion 730 and the support portion 740 for respectively supporting the supported projection 92A and the supported projection 931.

When the toner cartridge 9 is to be attached to the developing unit 7, as shown in FIG. 16A, the toner cartridge 9 is moved in the direction of an arrow S3 from above the developing unit 7 while the gripping portion 911A is gripped. As shown in FIG. 16B, the toner cartridge 9 moved in the direction of the arrow S3 enters a state in which the supported projection 92A and the supported projection 931 are supported by the support portion 730 and the support portion 740, respectively. From this state, the toner cartridge 9 is rotated relative to the developing unit 7 about the supported projection 92A and the supported projection 931, whereby attachment is complete, as shown in FIG. 16C, and thus the cartridge unit 10 is formed.

Further, when attachment is complete, the conveyance screw gear 965 of the toner cartridge 9 can be meshed to the idler gear 715B of the developing unit 7. As a result, the driving force of the developing unit 7 is transmitted to the toner cartridge 9.

Lift Mechanism of Toner Cartridge

Next, the lift mechanism 760 (the lock mechanism) of the toner cartridge 9 will be described using FIGS. 17A to 17C and 18A to 18C.

Figure 17A:
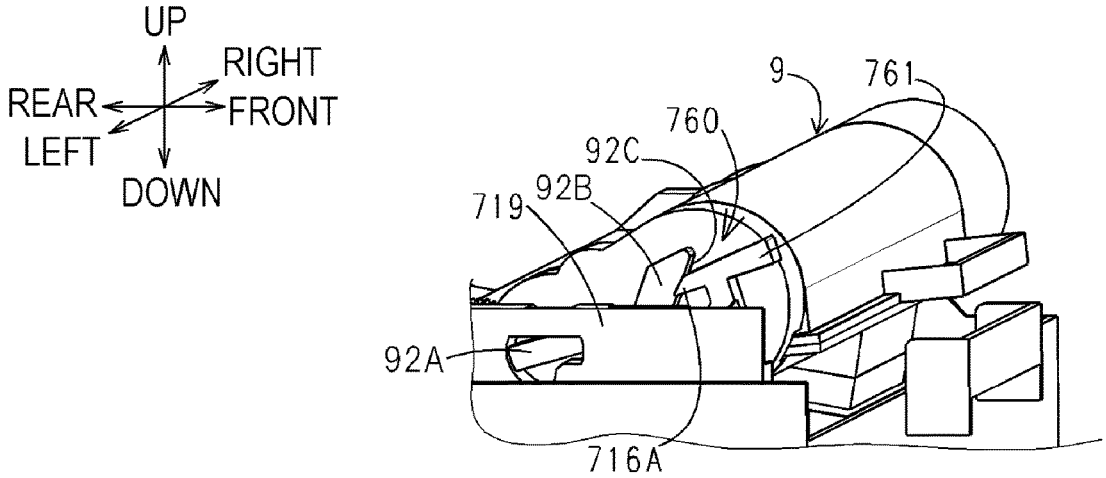
FIGS. 17A to 17C are views showing an operation of a lock mechanism according to the first embodiment.
Figure 17B:
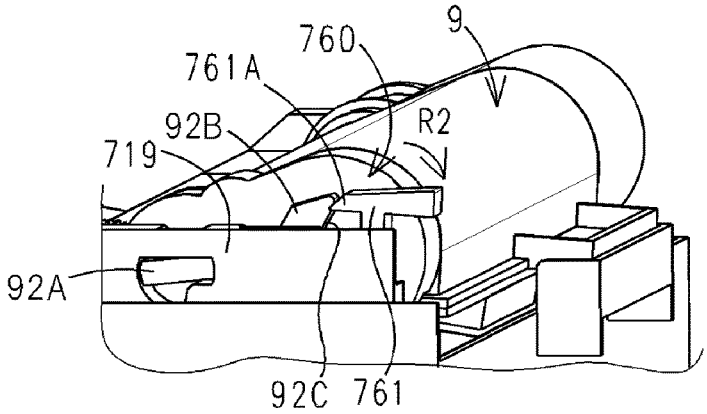
Figure 17C:
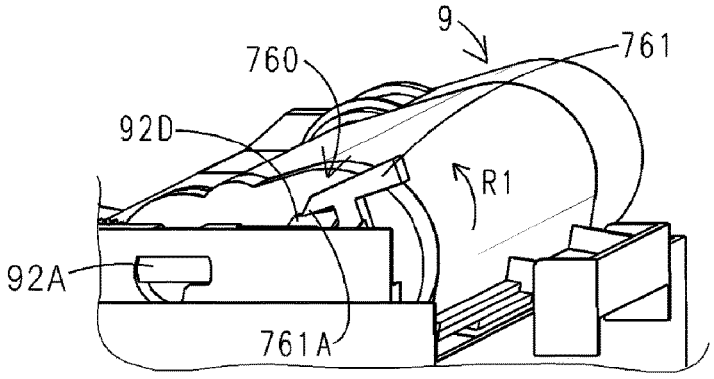

FIGS. 17A to 17C show movement of the lift mechanism 760 during the process for attaching the toner cartridge 9, FIG. 17A showing a state in which the toner cartridge 9 is carried on the lift mechanism 760 during the attachment process, FIG. 17B showing a state in which the lift mechanism 760 is opened during the process for attaching the toner cartridge 9, and FIG. 17C showing a state in which attachment of the toner cartridge 9 is complete.

Figure 18A:
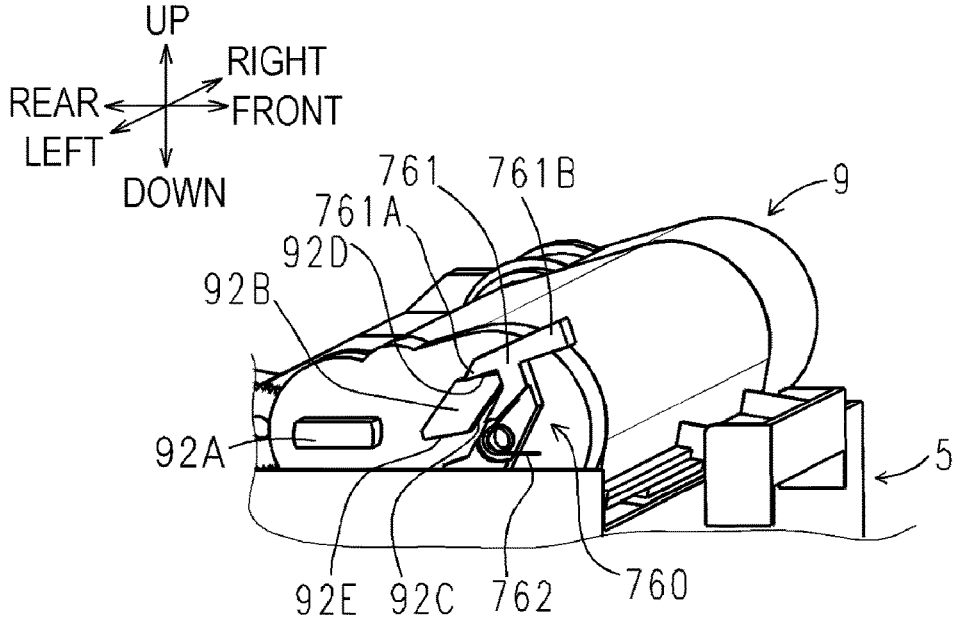
FIGS. 18A to 18C are views showing the operation of the lock mechanism according to the first embodiment.
Figure 18B:
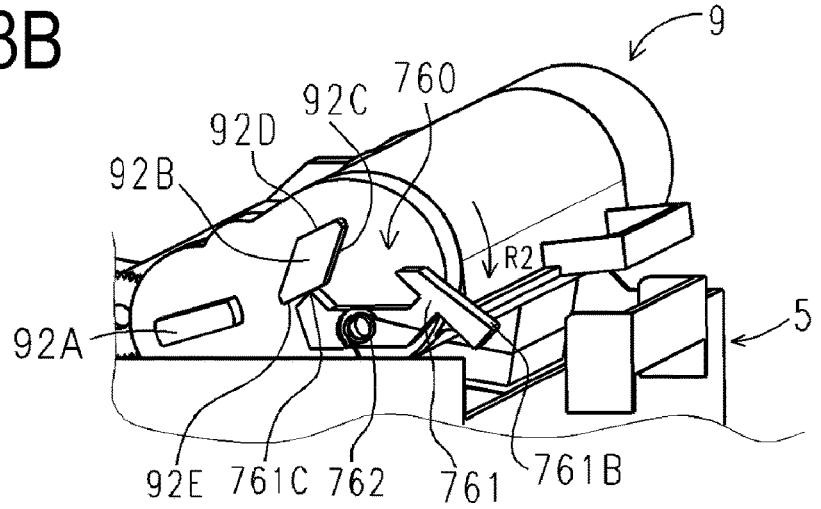
Figure 18C:
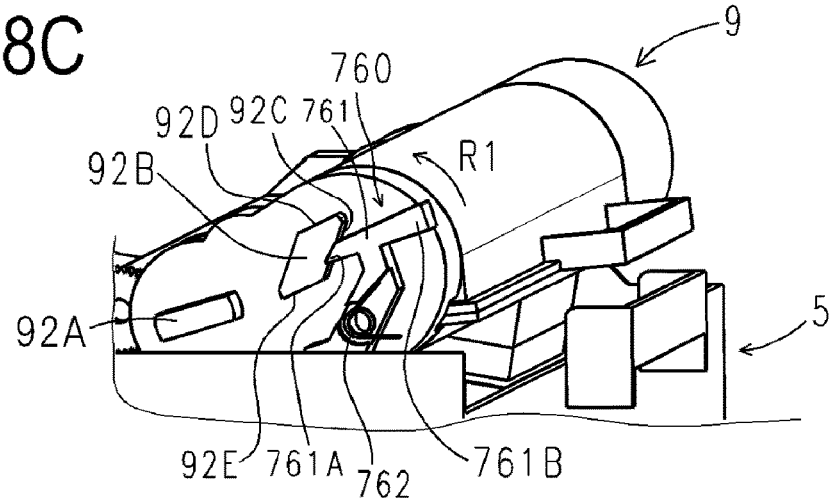

FIGS. 18A to 18C show movement by which the attached toner cartridge 9 is shifted to a state of being lifted up by the lift mechanism 760. FIG. 18A shows a state in which attachment of the toner cartridge 9 is complete. FIG. 18B shows the manner in which the toner cartridge 9 is lifted up by the lift mechanism 760. FIG. 18C shows the toner cartridge 9 in the lifted-up state. Note that for descriptive purposes, the side holder 719 of the developing unit 7 is not shown in FIGS. 18A to 18C.

As shown in FIGS. 18A to 18C, a projecting portion 92B is provided on the T-side holder 92 of the toner cartridge 9, and the projecting portion 92B includes a contact surface 92C, a holding surface 92D, and a receiving surface 92E. Further, as shown in FIGS. 5A and 5B, the developing unit 7 is provided with a boss 719A. The lift mechanism 760 is constituted by a lifting member 761 and a torsion coil spring 762 and is attached to the boss 719A so as to be capable of rotating about the boss 719A. In addition, the lifting member 761 includes a contact portion 761A, an operating portion 761B, and a lift-up portion 761C. Furthermore, the lifting member 761 is biased by the torsion coil spring 762 in the direction of an arrow R1.

Movement of the lift mechanism 760 during the process for attaching the toner cartridge 9 will now be described using FIGS. 17A to 17C. As the toner cartridge 9 rotates during the attachment process, as shown in FIG. 17A, the contact surface 92C comes into contact with the contact portion 761A such that the toner cartridge 9 is lifted onto the lift mechanism 760. Next, as the toner cartridge 9 continues to rotate, as shown in FIG. 17B, the lifting member 761 is pressed against the contact surface 92C so as to rotate in the direction of an arrow R2, thereby allowing the toner cartridge 9 to rotate. When the rotation operation is continued to the point where attachment of the toner cartridge 9 is complete, as shown in FIG. 17C, the contact portion 761A falls away from the contact surface 92C and comes into contact with the holding surface 92D. The toner cartridge 9 can thus be held by the lifting member 761 in an attached state.

Next, movement by which the toner cartridge 9 is shifted from the attached state to the lifted-up state will be described using FIGS. 18A to 18C. As shown in FIG. 18A, when the toner cartridge 9 is in the attached state, the contact portion 761A of the lifting member 761 is in contact with the holding surface 92D, and therefore the toner cartridge 9 cannot be detached. In order to detach the toner cartridge 9, as shown in FIG. 18B, the lifting member 761 is rotated in the direction of an arrow R2 by operating the operating portion 761B of the lifting member 761. As a result, the lift-up portion 761C of the lifting member 761 comes into contact with the receiving surface 92E such that the toner cartridge 9 can be rotated. When the operating portion 761B is then released, as shown in FIG. 18C, the lifting member 761 is rotated in the direction of an arrow R1 by the biasing force of the torsion coil spring 762. As a result, the contact surface 92C and the contact portion 761A come into contact with each other, and the toner cartridge 9 enters the lifted-up state carried on the lift mechanism 760. In this state, the toner cartridge 9 can be detached.

Opening/Closing Operations of Reception-Side Shutter

Figure 19A:
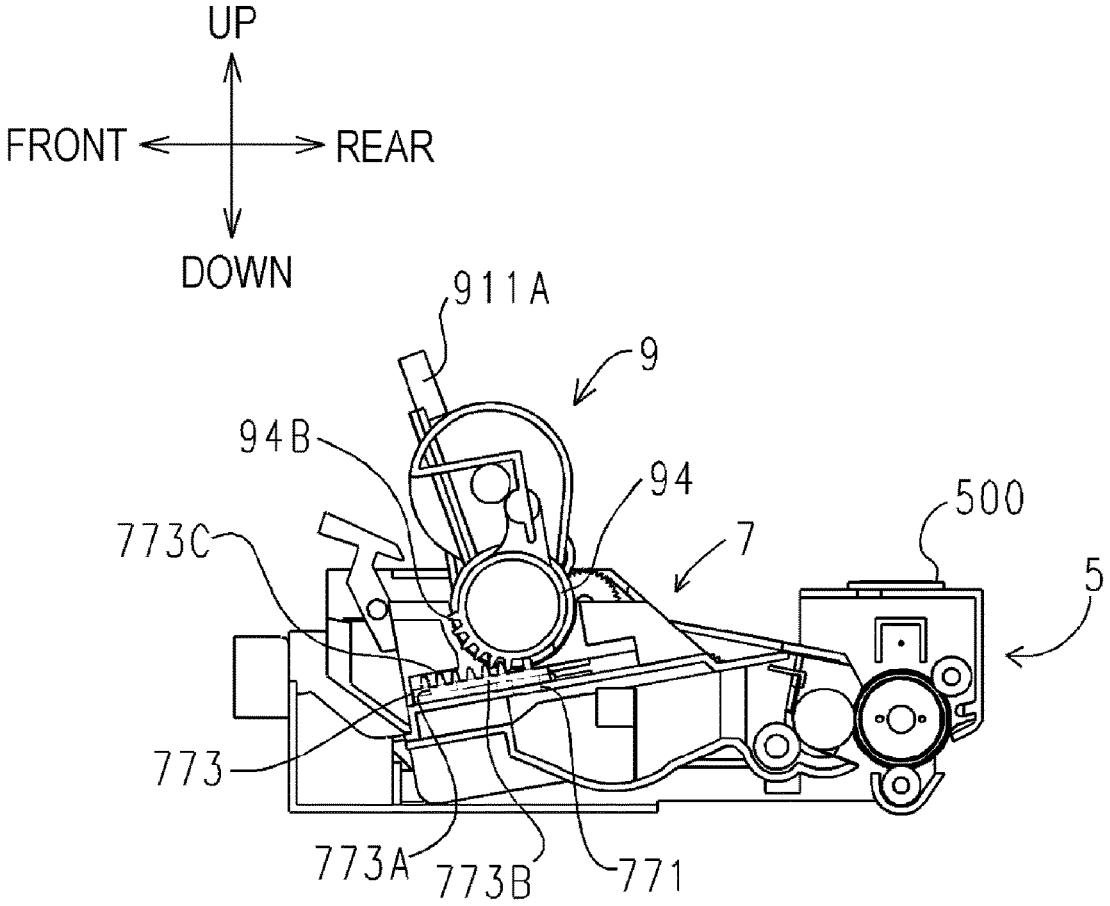
FIGS. 19A and 19B are views showing opening/closing operations of an opening/closing member according to the first embodiment.
Figure 19B:
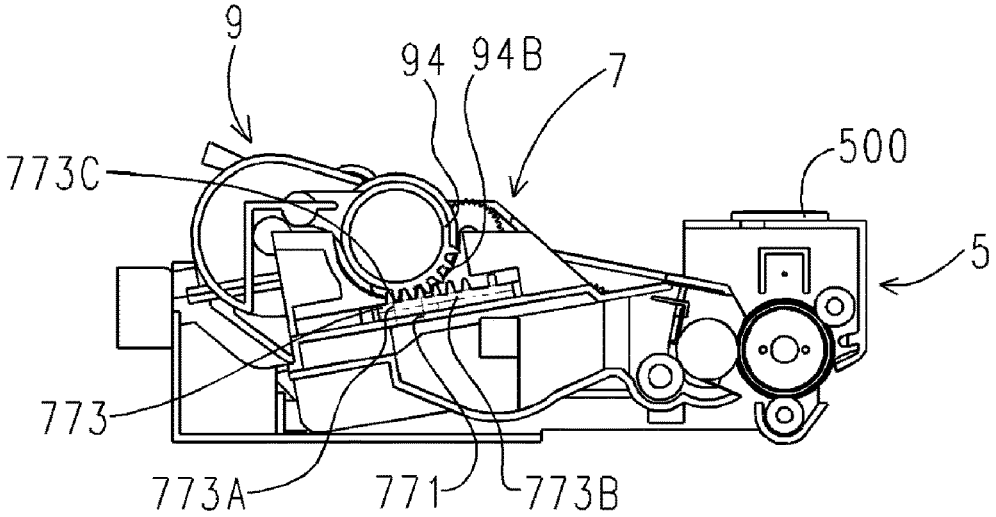

Next, opening/closing operations of a reception-side shutter, which are performed in conjunction with attachment/detachment of the toner cartridge 9, will be described using FIGS. 6, 19A and 19B. FIGS. 19A and 19B are views showing the opening/closing operations of the reception-side shutter of the developing unit 7, FIG. 19A showing a state in which the reception-side shutter is closed and FIG. 19B showing a state in which the reception-side shutter is open.

First, as shown in FIG. 6, the toner receiving portion 770 of the developing unit 7 is constituted by a toner receiving port 771 provided in an upper surface of the casing 700, a reception-side shutter seal 772, a reception-side shutter 773 (an opening/closing member), a reception port cover 774, and a connecting seal 775. Hole portions 772A, 773A, 774A, and 775A are provided respectively in these components. The hole portions 772A, 774A, and 775A in the reception-side shutter seal 772, the reception port cover 774, and the connecting seal 775 are assembled so as to align with the toner receiving port 771. Further, the reception-side shutter 773 includes a blocking portion 773B in addition to the hole portion 773A and is incorporated into the casing 700 to be capable of sliding relative thereto. The toner receiving port 771 is opened and closed by this sliding movement.

As shown in FIGS. 19A and 19B, the opening/closing operations of the reception-side shutter 773 are performed in conjunction with operations for attaching and extracting the toner cartridge 9. Here, a group of driven projections 773C are disposed on the reception-side shutter 773. Meanwhile, a group of driving projections 94B (a gear portion) are disposed on the outer peripheral surface of the discharge port forming member 94 of the toner cartridge 9.

As described above, in the process for attaching the toner cartridge 9 to the developing unit 7, the toner cartridge 9 is shifted to the attached state by being rotated. FIG. 19A shows a state prior to the rotation operation performed during the attachment process. In this state, the blocking portion 773B of the reception-side shutter 773 opposes the toner receiving port 771 so that the toner receiving port 771 is closed. At this time, the group of driving projections 94B and the group of driven projections 773C are engaged.

Next, FIG. 19B shows a state in which the toner cartridge 9 has been rotated to the point where attachment is complete. At this time, the toner cartridge 9 is rotated while maintaining the engagement between the group of driving projections 94B and the group of driven projections 773C, and therefore the reception-side shutter 773 slides in conjunction with the rotation operation of the toner cartridge 9. Accordingly, the position of the hole portion 773A in the reception-side shutter 773 aligns with the position of the toner receiving port 771, and as a result, the toner receiving port 771 is opened.

Similarly when the toner cartridge 9 is extracted from the developing unit 7, the reception-side shutter 773 slides in conjunction with the rotation operation of the toner cartridge 9 such that the toner receiving port 771 is closed.

Thus, in a state where the toner cartridge 9 is attached to the developing unit 7, the toner receiving port 771 is open such that toner can be received into the interior of the developing unit 7 from the toner cartridge 9. In a state where the toner cartridge 9 is not attached to the developing unit 7, on the other hand, the toner receiving port 771 is closed, thereby preventing foreign matter from infiltrating the developing unit 7 and preventing toner from leaking to the outside from the interior of the developing unit 7.

Opening/Closing Operations of Discharge-Side Shutter

Figure 20A:
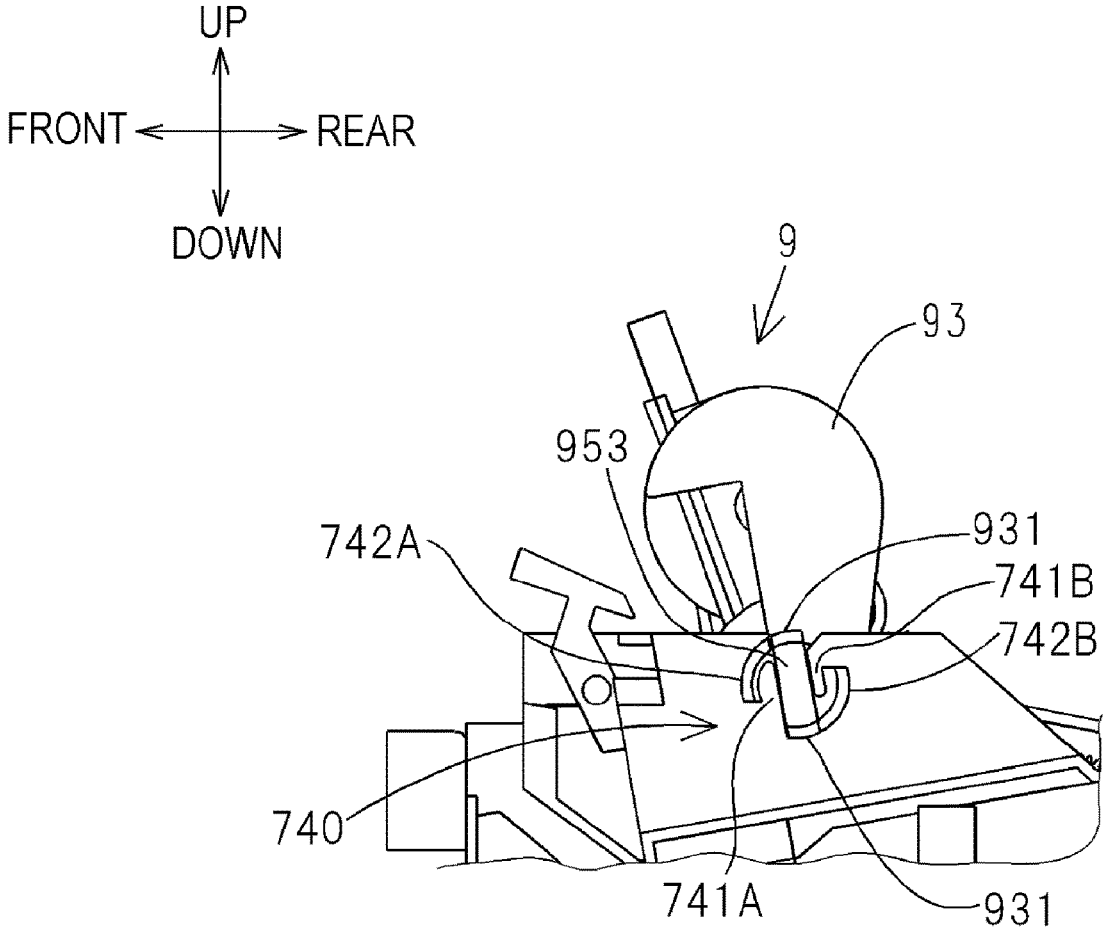
FIGS. 20A and 20B are views showing opening/closing operations of a shutter according to the first embodiment.
Figure 20B:
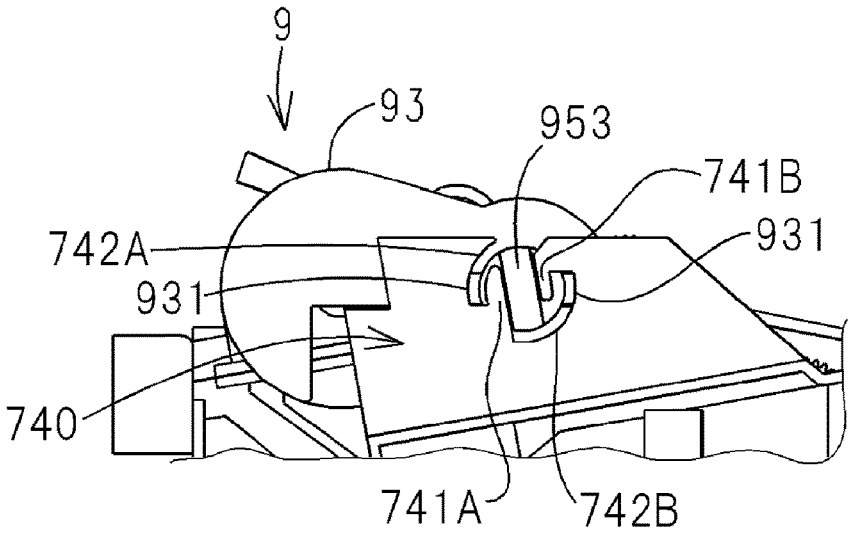

Next, opening/closing operations of the discharge-side shutter 95 will be described using FIGS. 20A and 20B. FIGS. 20A and 20B are views showing the opening/closing operations of the discharge-side shutter 95 of the toner cartridge 9, FIG. 20A showing a state in which the discharge-side shutter 95 is closed and FIG. 20B showing a state in which the discharge-side shutter 95 is open.

As described above, when the positions of the discharge port 94A in the discharge port forming member 94 and the toner passage hole 951 in the discharge-side shutter 95, shown in FIG. 13, are aligned, the discharge port 94A is opened. When, on the other hand, the closing portion 95B of the discharge-side shutter 95 opposes the discharge port 94A, the discharge port 94A is closed. Hence, the opening/closing operations of the discharge-side shutter 95, similarly to the opening/closing operations of the reception-side shutter 773, described above, are performed in conjunction with the rotation operations of the toner cartridge 9 during attachment and extraction.

As shown in FIGS. 5A, 5B, 20A, and 20B, the engaged projection 953 is provided on the discharge-side shutter 95 and arranged on the inside of the supported projection 931 in a radial direction. Further, an engaging portion 741A and an engaging portion 741B (first engaging portions) are provided on the support portion 740 of the developing unit 7. The engaging portion 741A and the engaging portion 741B are arranged so that the respective surfaces thereof are parallel. Furthermore, a surface in a frontward direction relative to the position in which the supported projection 931 is inserted serves as the engaging portion 741A, while a surface in a rearward direction serves as the engaging portion 741B. In addition, a notch portion 742A and a notch portion 742B (second engaging portions) are provided in the support portion 740. Similarly, a notch in a frontward direction relative to the position in which the supported projection 931 is inserted serves as the notch portion 742A, while a notch in a rearward direction serves as the notch portion 742B.

FIG. 20A shows a state prior to the rotation operation of the toner cartridge 9 during the attachment process. In this state, as shown in FIG. 13, the closing portion 952 of the discharge-side shutter 95 opposes the discharge port 94A, and therefore the discharge port 94A is closed. At this time, the pair of leg portions of the supported projection 931 and the engaged projection 953 are in a first arrangement arranged adjacent to each other in the attachment direction. At this time, the engaged projection 953 is sandwiched between the engaging portion 741A and the engaging portion 741B, thereby obstructing a rotation operation of the discharge-side shutter 95 relative to the developing unit 7.

Next, FIG. 20B shows a state in which the toner cartridge 9 has been rotated to the point where attachment thereof to the developing unit 7 is complete. The supported projection 931 can enter the notch portion 742A and the notch portion 742B, and therefore rotation of the toner cartridge 9, not including the discharge-side shutter 95, is not obstructed. Accordingly, the toner cartridge 9 is rotated relative to the developing unit 7 in a state where the rotation operation of the discharge-side shutter 95 is obstructed. Hence, by means of the rotation operation performed by the toner cartridge 9 during the attachment process, the discharge-side shutter 95 is rotated relative to the toner cartridge 9 within the interior thereof. Thus, the toner cartridge 9 and the discharge-side shutter 95 are rotated relative to each other from the relative position (first relative position) shown in FIGS. 1 and 13 to relative position (second relative position) in which the positions of the toner passage hole 951 in the discharge-side shutter 95 and the discharge port 94A are aligned, and as a result, the discharge port 94A is opened. At this time, the pair of leg portions of the supported projection 931 are guided by the notch portion 742A and the notch portion 742B. the pair of leg portions of the supported projection 931 and the engaged projection 953 enter a second arrangement arranged side by side in a substantially orthogonal direction to the attachment direction.

Similarly when the toner cartridge 9 is detached from the developing unit 7, the discharge-side shutter 95 is rotated in conjunction with the rotation operation of the toner cartridge 9 until the discharge port 94A is closed.

Problem Encountered when Reattaching Toner Cartridge

Next, a problem encountered in a conventional configuration when the toner cartridge 9 is reattached will be described using FIGS. 21A, 21B, and 22 to 25. FIGS. 21A, 21B, and 22 to 25 are schematic sectional views showing operations for inserting and extracting the toner cartridge 9 in a conventional configuration, and specifically showing enlargements of a support portion 1740, a supported projection 1931, and a engaged projection 1953. Note that in the conventional configuration described below, unless specified otherwise, configurations and positional relationships are identical to those of the first embodiment described above and hereafter. In this case, the attachment direction S3 of the toner cartridge 9 is shown as a downward direction in the figures. Further, the supported projection 1931, similarly to the supported projection 931 shown in FIG. 14, is substantially U-shaped, but for descriptive purposes, the rightmost surface of the supported projection 1931, or in other words the outermost surface thereof in the axial direction, has been omitted and illustrated with a dotted line.

Figure 21A:
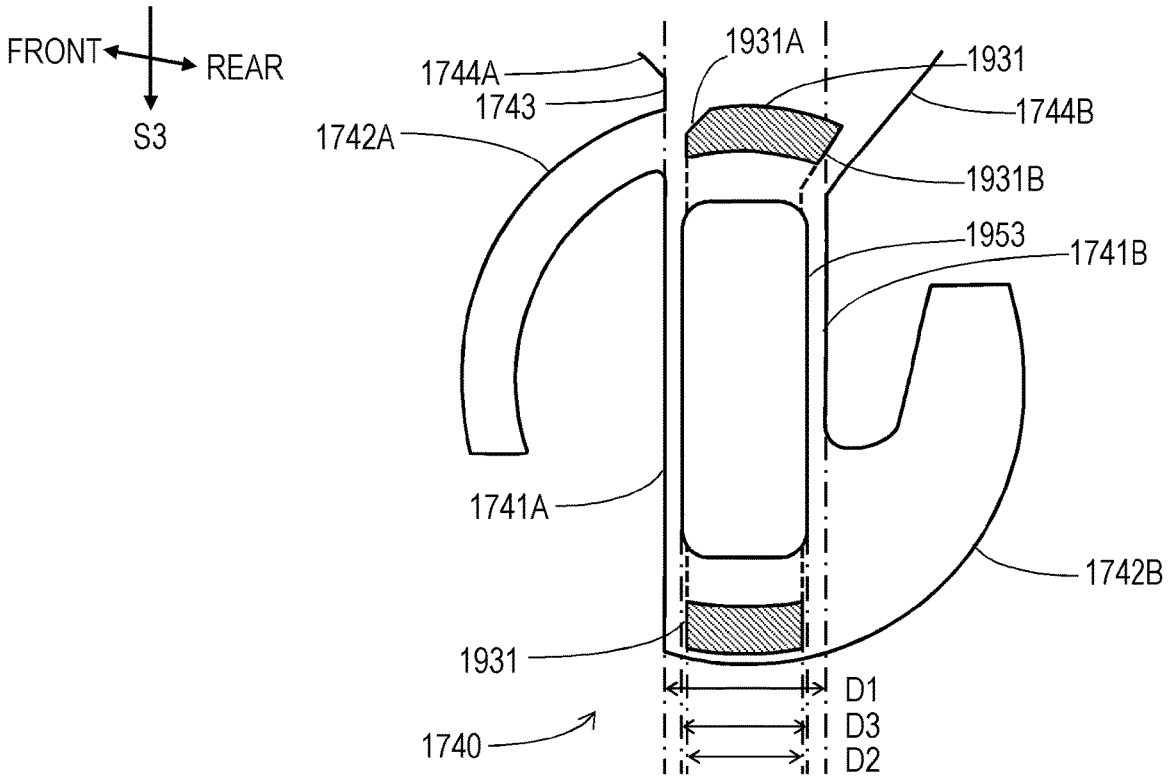
FIGS. 21A and 21B are schematic sectional views of a support portion and a projecting portion according to a conventional configuration.
Figure 21B:
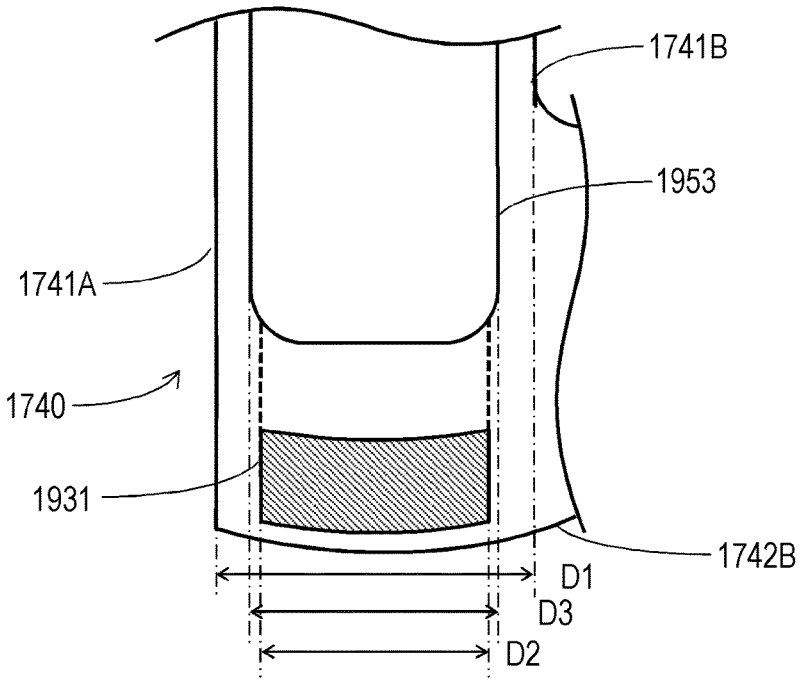

First, using FIGS. 21A and 21B, a state at the point where the supported projection 1931 is attached to the support portion 1740 will be described. FIG. 21A is a schematic sectional view showing the entirety of the support portion 1740, the supported projection 1931, and the engaged projection 1953, and FIG. 21B is an enlarged view showing a part of FIG. 21A, specifically a tip end portion of the supported projection 1931 on a downstream side in the attachment direction S3.

In the support portion 1740, an inner wall surface 1743 is provided on an upstream side of a notch portion 1742A in the attachment direction S3 of the toner cartridge 9. Here, in FIGS. 21A and 21B showing the conventional configuration, the inner wall surface 1743 is positioned on an extension line of an engaging portion 1741A.

Further, in the attachment direction S3 of the toner cartridge 9, a tapered portion 1744A and a tapered portion 1744B are provided on the upstream side of the inner wall surface 1743 and the upstream side of an engaging portion 1741B, respectively. This is so that when the supported projection 1931 is inserted into the support portion 1740, an attachment port is widened so as to guide the insertion direction of the supported projection 1931, making it easier for the user to perform the operation to insert the toner cartridge 9.

Further, the supported projection 1931 includes a tapered surface 1931A. This is to ensure a smooth operation when the supported projection 1931 is rotated, or more specifically when the toner cartridge 9 is rotated to the point at which the toner cartridge 9 enters the attached state. If the supported projection 1931 is not pushed in sufficiently in the attachment direction S3, the wall surface of the supported projection 1931 may interfere with the inner wall surface 1743 when the supported projection 1931 is rotated such that the rotation operation of the supported projection 1931 is obstructed. By providing the tapered surface 1931A, obstruction of the rotation operation of the supported projection 1931 is prevented from occurring. More specifically, in a case where the supported projection 1931 is not pushed in sufficiently, the tapered surface 1931A contacts the inner wall surface 1743 and a ridgeline of the notch portion 1742A as a result of the rotation operation of the supported projection 1931, thereby realizing an action for guiding the supported projection 1931 in the attachment direction S3. As a result, the supported projection 1931 can rotate smoothly.

The supported projection 1931 also includes an inclined surface 1931B, which will be described in detail below.

Note that in the support portion 1740, as shown in FIG. 21B, a predetermined clearance D1 is formed between the surfaces of the engaging portions 1741A and 1741B opposing each other in the front-rear direction. Meanwhile, the supported projection 1931 and the engaged projection 1953 respectively have predetermined widths D2 and D3 in the front-rear direction. In this case, the clearance D1 has a larger value than the widths D2 and D3. This is to ensure that the supported projection 1931 and the engaged projection 1953 can always be inserted into and extracted from the support portion 1740, irrespective of variations in manufacturing tolerance and so on. Note that in the first embodiment and the conventional configuration, the front-rear direction width D3 of the engaged projection 1953 is set at a slightly larger value than the width D2 of the supported projection 1931. This is to ensure that the engaged projection 1953 can easily impinge on the engaging portion 1741A and the engaging portion 1741B during the rotation operation of the toner cartridge 9, irrespective of the manufacturing tolerance and so on.

Figure 22:
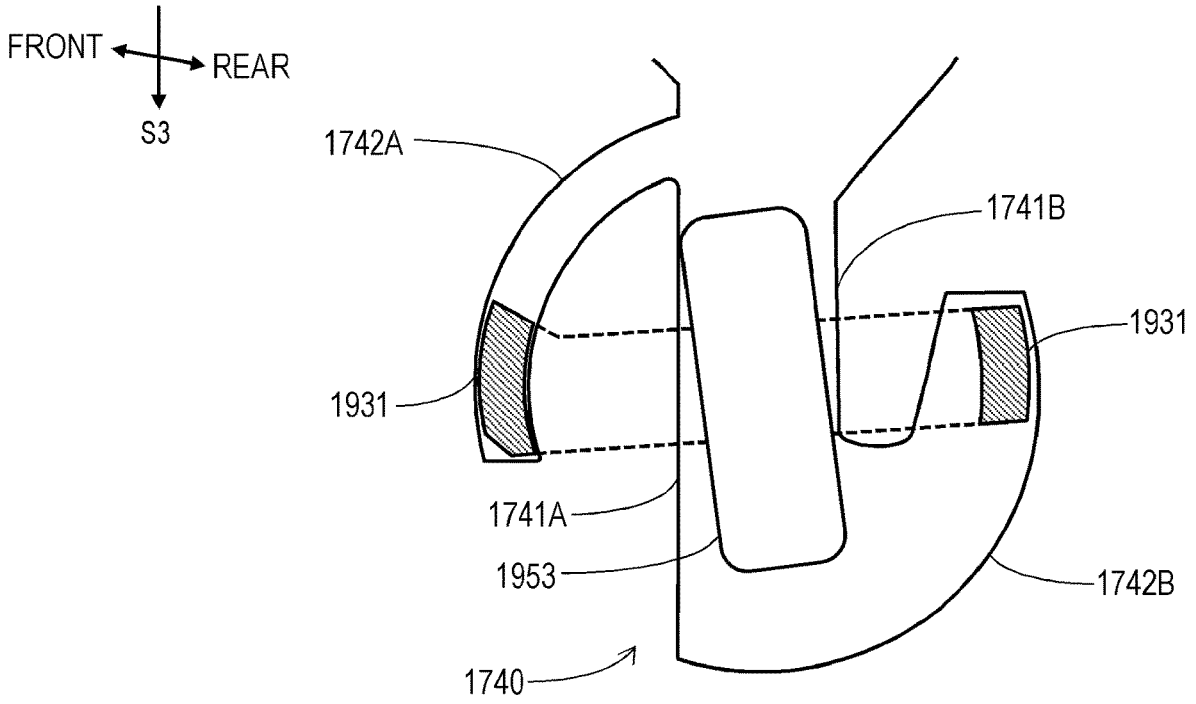
FIG. 22 is a schematic sectional view of the support portion and the projecting portion according to the conventional configuration.

Next, using FIG. 22, the arrangement of the toner cartridge 9 in the attached state will be described. As noted above, the rotation operation of the discharge-side shutter 95 is obstructed by at least a part of the engaged projection 1953 impinging on the engaging portion 1741A or the engaging portion 1741B. In this case, as noted above, the width D3 of the engaged projection 1953 is smaller than the clearance D1 between the engaging portions 1741A and 1741B, and therefore the engaged projection 1953 is able to rotate by a predetermined angle from a state prior to the rotation operation of the toner cartridge 9, shown in FIGS. 21A and 21B. As a result, as shown in FIG. 22, a part of the engaged projection 1953 comes into contact with the engaging portion 1741A or the engaging portion 1741B.

Next, using FIGS. 23 and 24, positional relationships between the respective members when the toner cartridge 9 in the attached state is re-extracted from the developing unit 7 will be described.

Figure 23:
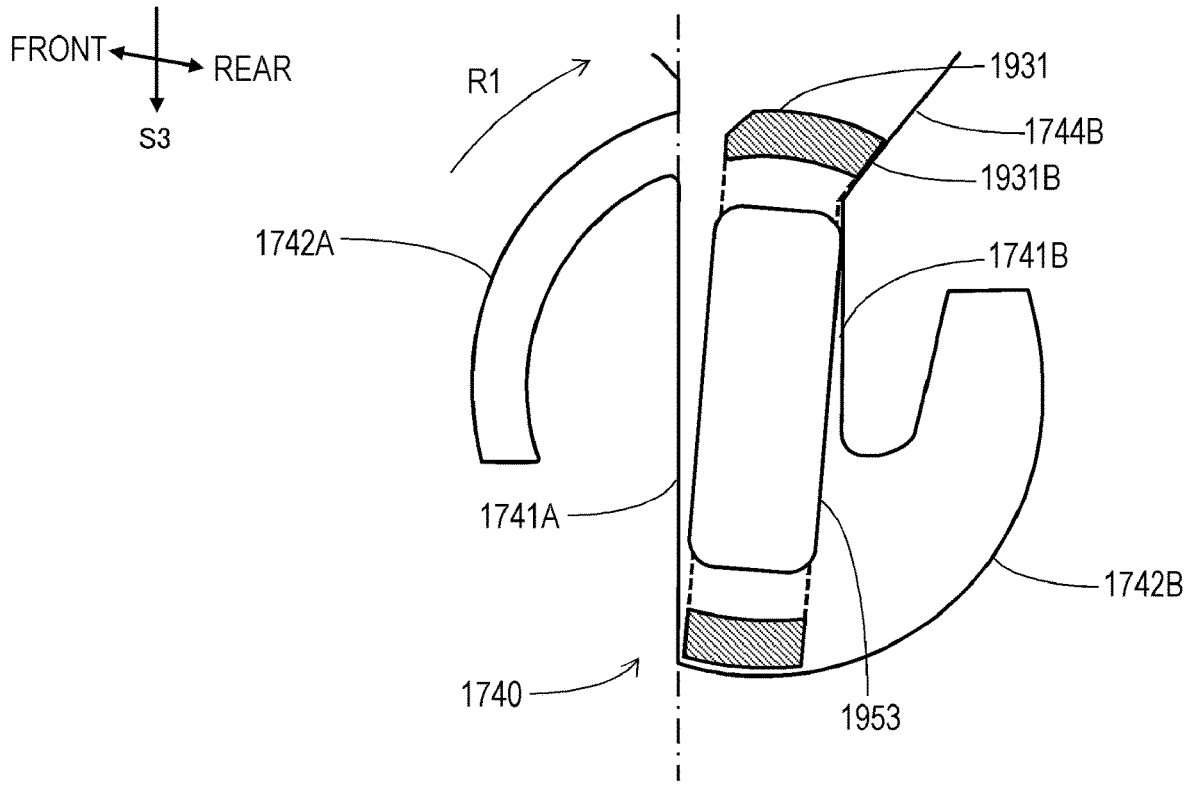
FIG. 23 is a schematic sectional view of the support portion and the projecting portion according to the conventional configuration.

FIG. 23 shows a state in which the toner cartridge 9 has been rotated by a maximum amount in a direction R1 in order to extract the toner cartridge 9 from the developing unit 7. At this time, at least a part of the supported projection 1931 and at least a part of the support portion 1740 contact each other, thereby restricting rotation of the toner cartridge 9. Here, the angles and arrangement of the inclined surface 1931B and the tapered portion 1744B are set so that the inclined surface 1931B and the tapered portion 1744B contact each other by surface contact.

Hence, in the state where the toner cartridge 9 has been rotated by the maximum amount in direction R1 in order to extract the toner cartridge 9 from the developing unit 7, the supported projection 1931 and the engaged projection 1953 are arranged substantially parallel. This state is identical to the positional relationship between the supported projection 1931 and the engaged projection 1953 prior to insertion of the toner cartridge 9, as shown in FIGS. 21A and 21B.

Figure 24:
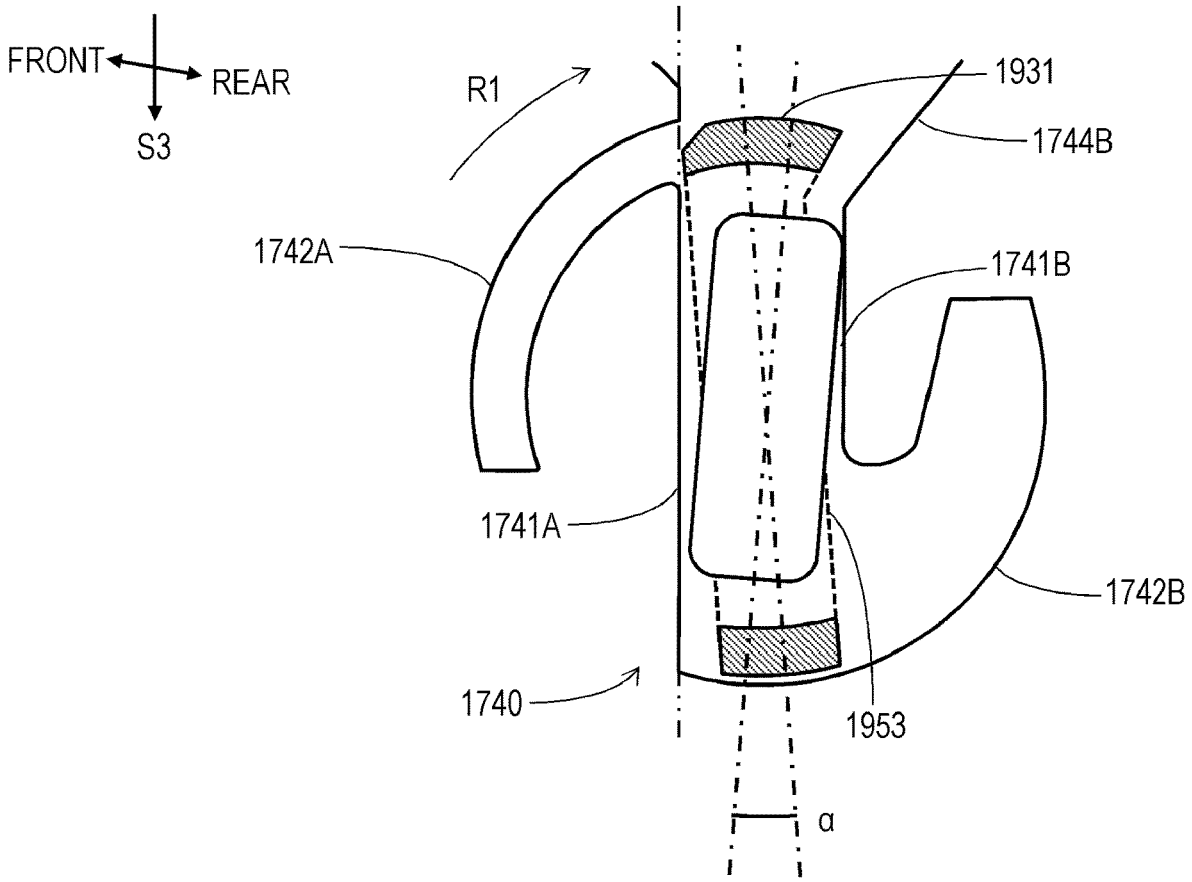
FIG. 24 is a schematic sectional view of the support portion and the projecting portion according to the conventional configuration.

Meanwhile, FIG. 24 shows a state in which the toner cartridge 9 has been rotated by a minimum amount in direction R1 in order to extract the toner cartridge 9 from the developing unit 7. The direction for extracting the toner cartridge 9 from the developing unit is the opposite direction to the attachment direction S3. In other words, the toner cartridge 9 is extracted substantially parallel to the surfaces of the engaging portion 1741A and the engaging portion 1741B. Hence, as shown in FIG. 24, the toner cartridge 9 can be extracted by rotating the supported projection 1931 to a position rearward of the extension line of the engaging portion 1741A (illustrated by a dot-dot-dash line in FIG. 24). Note that in the state shown in FIG. 24, the part of the supported projection 1931 positioned furthest frontward is positioned on the extension line of the engaging portion 1741A. In this case, similarly to the case shown in FIG. 23, a part of the engaged projection 1953 contacts the engaging portion 1741B. In other words, in the state shown in FIG. 24, the supported projection 1931 and the engaged projection 1953 intersect by an angle $\alpha$ in a cross-sectional direction. At this time, as noted above, mainly to suppress toner leakage, the discharge-side shutter 95 and the discharge port forming member 94 are at least partially in close contact, and therefore a predetermined frictional force acts thereon. As a result, even after the toner cartridge 9 is extracted from the developing unit 7, the positional relationship between the discharge-side shutter 95 and the discharge port forming member 94, or in other words the intersection angle $\alpha$ between the supported projection 1931 and the engaged projection 1953, is maintained as is.

Figure 25:
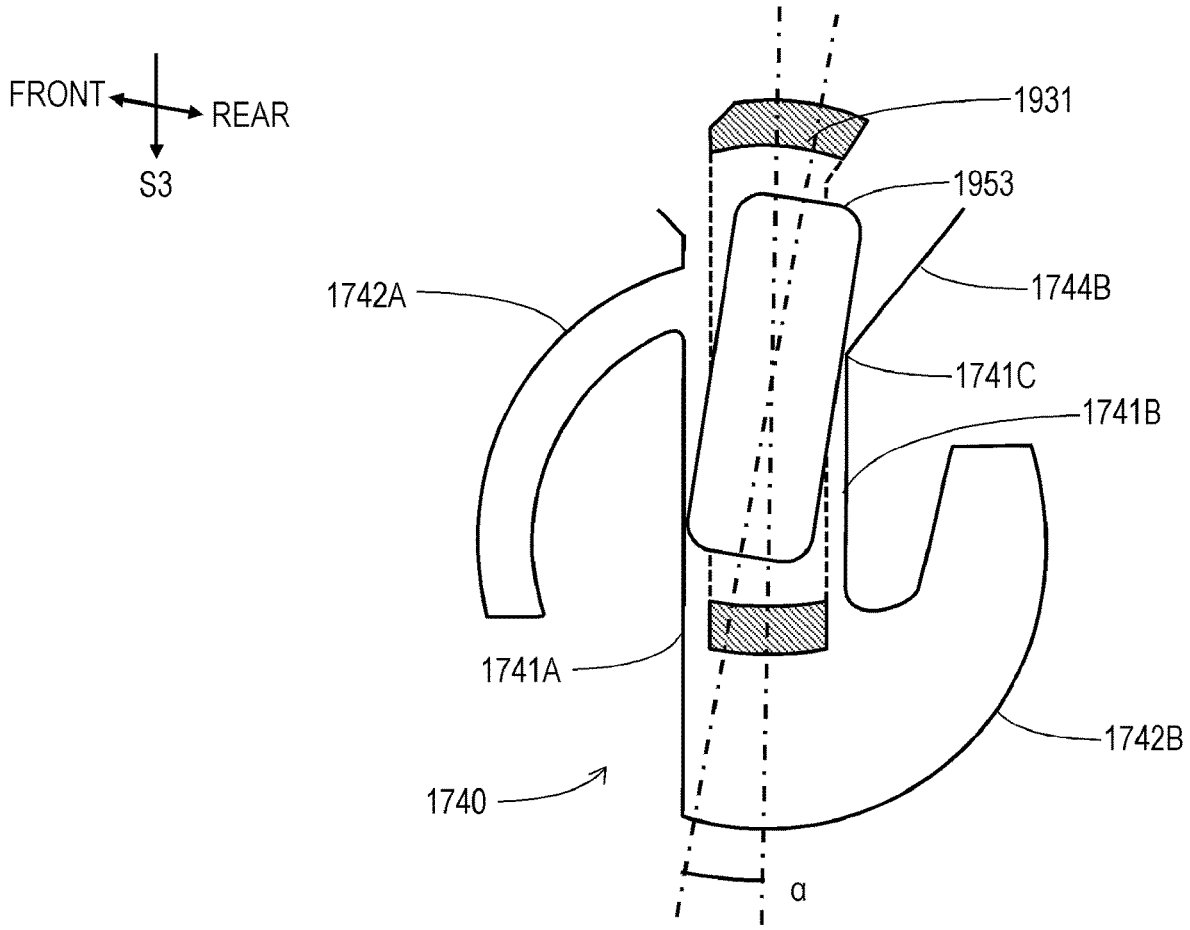
FIG. 25 is a schematic sectional view of the support portion and the projecting portion according to the conventional configuration.

Next, using FIG. 25, a problem encountered when reattaching the toner cartridge 9 in the conventional configuration will be described. FIG. 25 is a view showing a case in which, after the toner cartridge 9 is extracted in a state where the supported projection 1931 and the engaged projection 1953 intersect by the angle $\alpha$, as shown in FIG. 24, an attempt is made to reattach the same toner cartridge 9 to the developing unit as is. At this time, the front-rear direction position of the toner cartridge 9 is positioned at the contact portion between the engaged projection 1953 and the engaging portion 1741A. In this case, as shown in FIG. 25, by pushing the toner cartridge 9 in by a predetermined amount in the attachment direction S3, a part of the engaged projection 1953 comes into contact with a vertex portion 1741C. The vertex portion 1741C is the most protruding part of the indentation forming the support portion 1740 and the part where the engaging portion 1741B and the tapered portion 1744B intersect. As a result, the operation for attaching the toner cartridge 9 in the attachment direction S3 is obstructed. At this time, by strongly pushing the toner cartridge 9 further in in the S3 direction, the toner cartridge 9 can be moved to a rotatable position while being guided along an incline formed by the engaged projection 1953 and the engaging portion 1741B. As noted above, however, a predetermined frictional force acts on the discharge-side shutter 95 and the discharge port forming member 94, and therefore a predetermined load is required to push the toner cartridge 9 in up to a rotatable position. Alternatively, the toner cartridge 9 can be attached by limiting the insertion direction of the toner cartridge 9 and twisting the toner cartridge in. However, forcing the user to implement such a specialized operation method may be troublesome for the user.

Hence, in the conventional configuration, when the toner cartridge is extracted by means of the minimum required rotation operation and then the same toner cartridge is reattached to the developing unit, the operation may prove troublesome for the user.

Solution to Problem Encountered when Reattaching Toner Cartridge

Figure 26A:
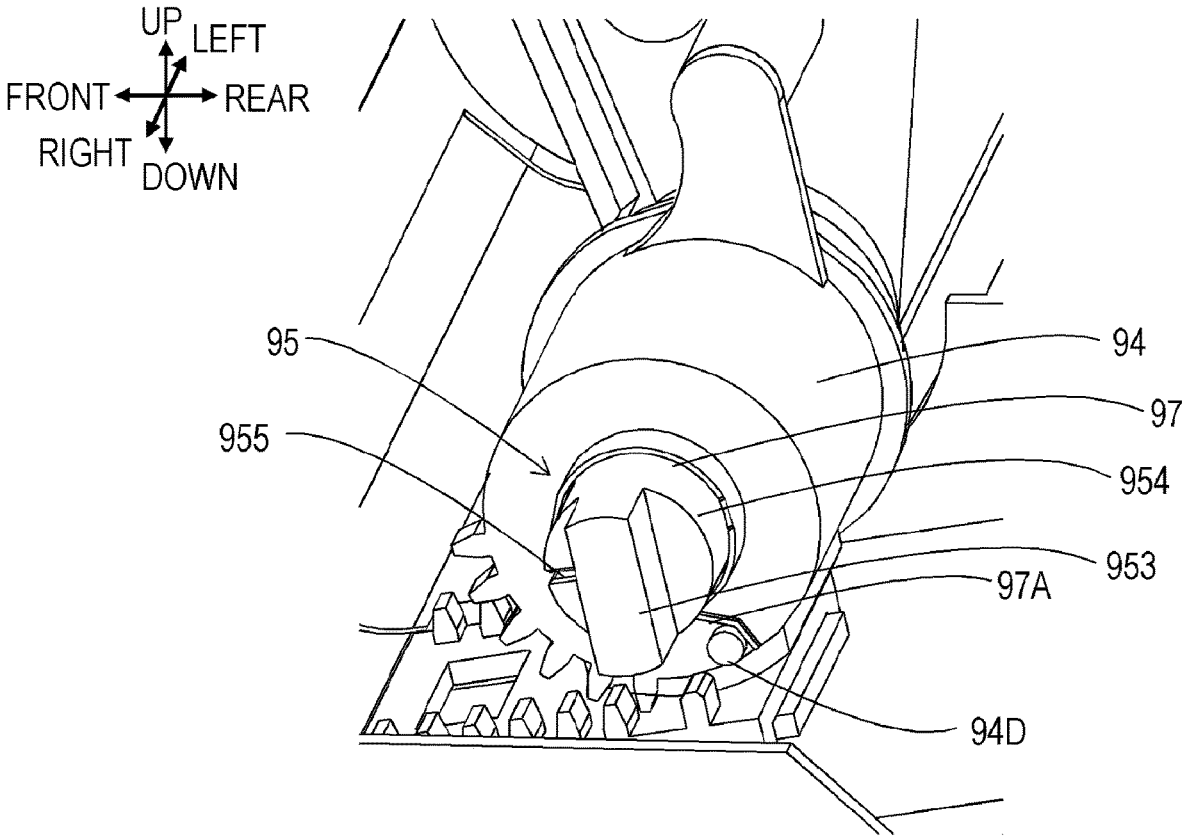
FIGS. 26A and 26B are illustrative views showing configurations of the toner cartridge and the process cartridge according to the first embodiment.
Figure 26B:
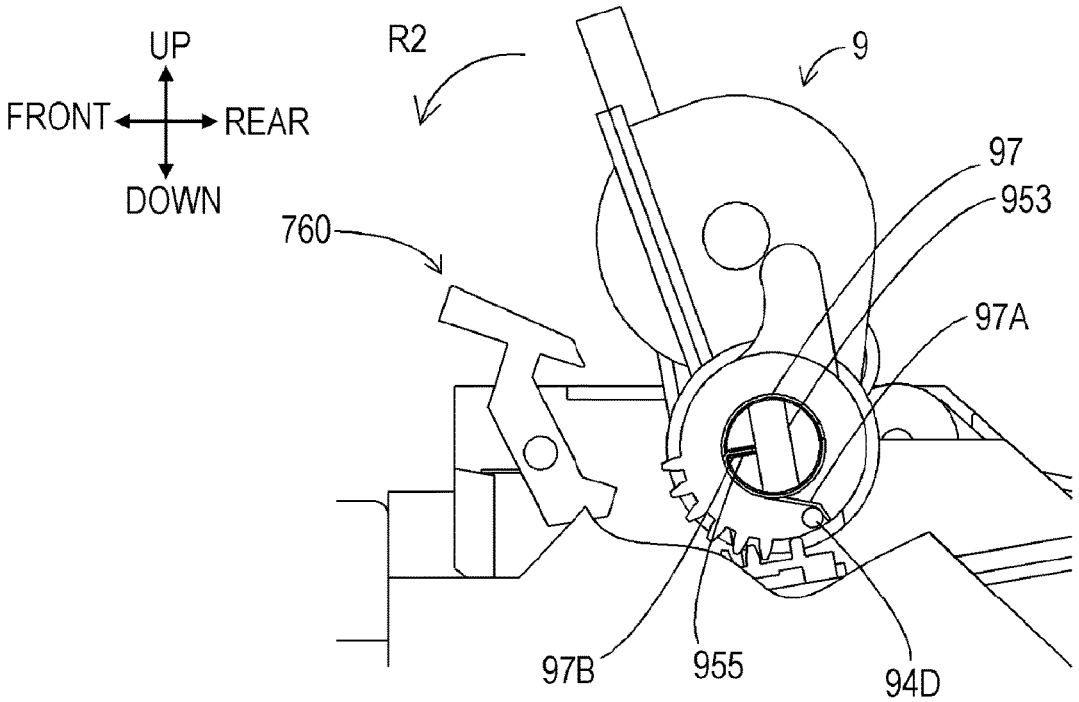
Figure 27A:
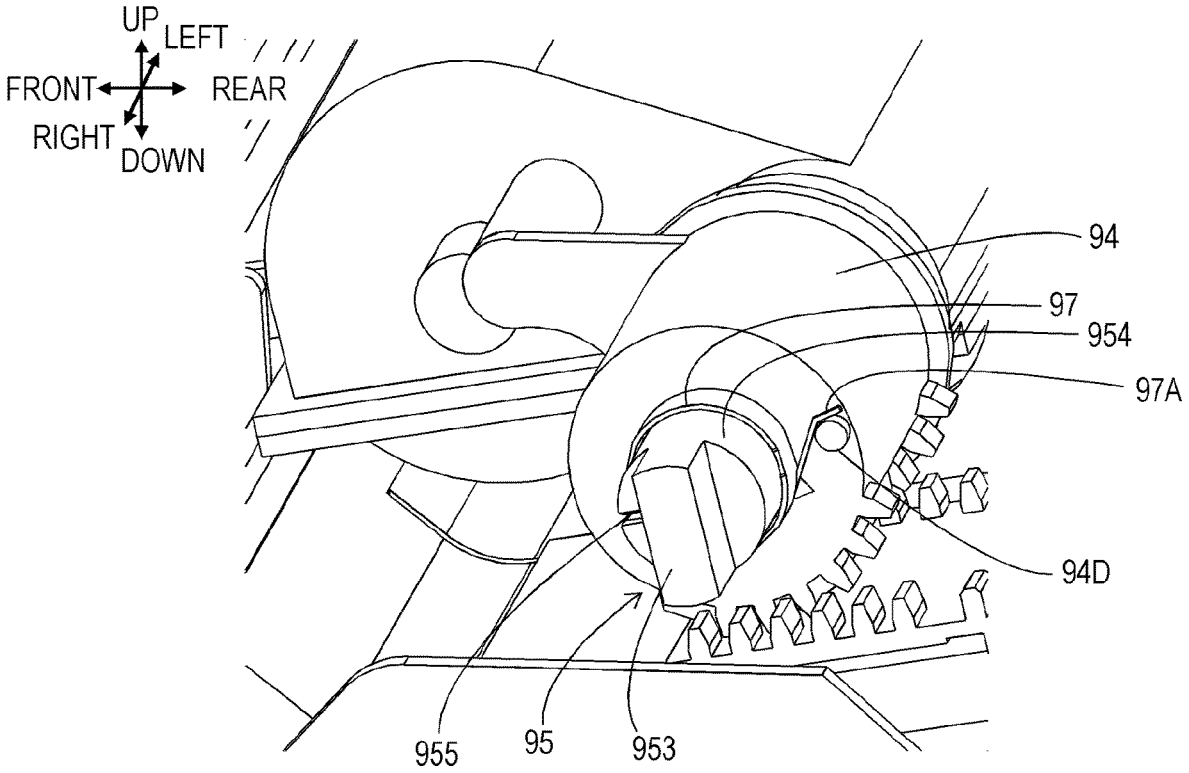
FIGS. 27A and 27B are illustrative views showing the configurations of the toner cartridge and the process cartridge according to the first embodiment.
Figure 27B:
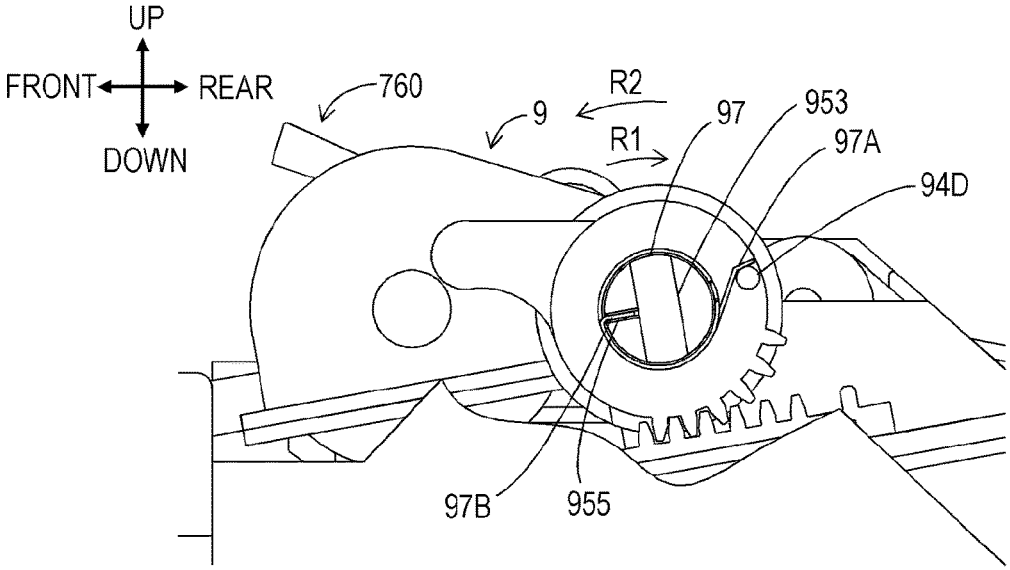
Figure 28:
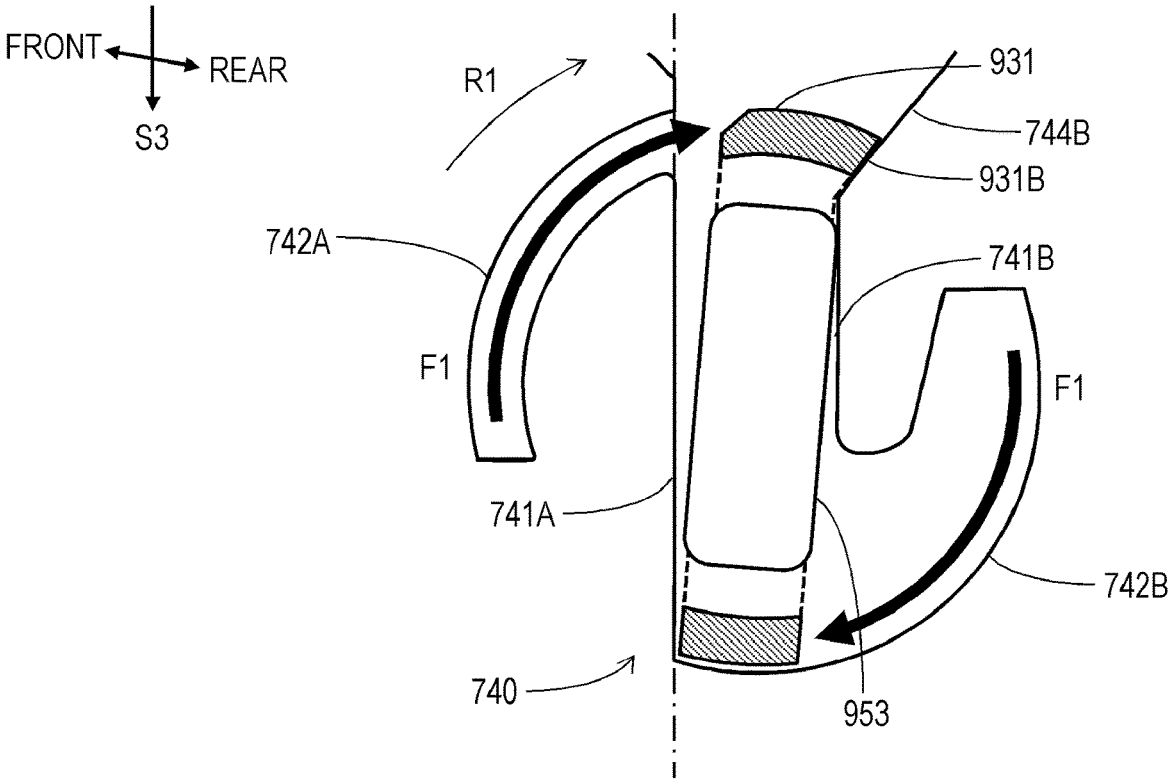
FIG. 28 is a schematic sectional view of a support portion and a projecting portion according to the first embodiment.

The configuration of the toner cartridge 9 according to the first embodiment, which is the feature of this embodiment, in relation to the aforesaid problem encountered when reattaching the toner cartridge 9 will now be described using FIGS. 1, 26, 27, and 28. FIG. 1 is an exploded perspective view showing a part of the toner cartridge 9 according to the first embodiment. Further, FIGS. 26A and 26B show a state in which the toner cartridge 9 is inserted into the developing unit 7 and the discharge-side shutter 95 remains closed, FIG. 26A being a perspective view thereof and FIG. 26B being a sectional view thereof. FIGS. 27A and 27B, meanwhile, show a state in which the toner cartridge 9 has been attached to the developing unit 7 by being rotated and the discharge-side shutter 95 is open, FIG. 27A being a perspective view thereof and FIG. 27B being a sectional view thereof. Further, FIG. 28 is a schematic sectional view showing the entirety of the support portion 740, the supported projection 931, and the engaged projection 953.

In the first embodiment, as shown in FIG. 1, the toner cartridge 9 includes a biasing spring 97 (a biasing member). The biasing spring 97 is a torsion coil spring with a supported portion 97A formed on one end and an engagement portion 97B formed on the other end. Further, the discharge port forming member 94 is provided with a support projection 94D. In addition, in the discharge-side shutter 95, a notch portion 955 serving as an engaged portion is provided in a holding shaft 954.

As shown in FIGS. 26A and 26B, when the biasing spring 97 is incorporated into the toner cartridge, the biasing spring 97 is held by the holding shaft 954 and supported in a state where the engagement portion 97B is engaged with the notch portion 955. Further, the supported portion 97A is supported by the support projection 94D. At this time, the supported portion 97A is supported on the downstream side of the support projection 94D in the rotation direction 2 of the toner cartridge 9 during attachment to the developing unit 7.

When the toner cartridge 9 is rotated from the state shown in FIGS. 26A and 26B, the biasing spring 97 enters the state shown in FIGS. 27A and 27B. At this time, the support projection 94D, which constitutes a part of the discharge port forming member 94, rotates in conjunction with the rotation of the toner cartridge 9. As a result, the position of the supported portion 97A supported by the support projection 94D also moves in the rotation direction R2. As noted above, however, the engaged projection 953 is held by the engaging portions 741A and 741B, and therefore rotation of the discharge-side shutter 95 is suppressed. Accordingly, the position of the engagement portion 97B, which is engaged with the notch portion 955 constituting a part of the discharge-side shutter 95, is fixed. As a result, a moment of torsion acts on the biasing spring 97. In this state, the lift mechanism 760 described above holds the toner cartridge 9 in a state of being attached to the developing unit 7.

By releasing the lift mechanism 760 when the toner cartridge 9 is to be extracted from the developing unit 7, the moment of torsion acting on the biasing spring 97 is released, and as a result, as shown in FIG. 28, a biasing force F1 acts on the toner cartridge 9 in the biasing direction R1. Accordingly, the biasing force F1 acting in direction 1 also acts on the supported projection 931, which is integrated with the toner cartridge 9, causing the supported projection 931 to enter a state of being rotated by the maximum amount in direction R1, as shown in FIG. 28. In other words, the supported projection 931 and the engaged projection 953 are arranged substantially parallel, and as a result, when the toner cartridge 9 is extracted and then reinserted, the problem encountered during reattachment, described above, can be solved.

Here, FIGS. 26A, 26B, 27A, and 27B show a case in which one end of the biasing spring 97 is engaged with the notch portion 955 in the discharge-side shutter 95 and the other end is supported by the support projection 94D of the discharge port forming member 94. Instead, however, a part of the biasing spring 97 may be fixed to the discharge port forming member 94 and a different part may be caused to act on the discharge-side shutter 95. Alternatively, a part of the biasing spring 97 may be caused to act on the T-side holder 93, which is a site that is fixed to the toner cartridge 9 and moves in conjunction with the rotation of the toner cartridge 9, instead of the discharge-side shutter 95.

Different means for causing force to act in the biasing direction R1 when the toner cartridge 9 is attached to the developing unit 7 will now be described using FIGS. 29A, 29B, 30, 31, 32A, 32B, 33A, and 33B.

Figure 29A:
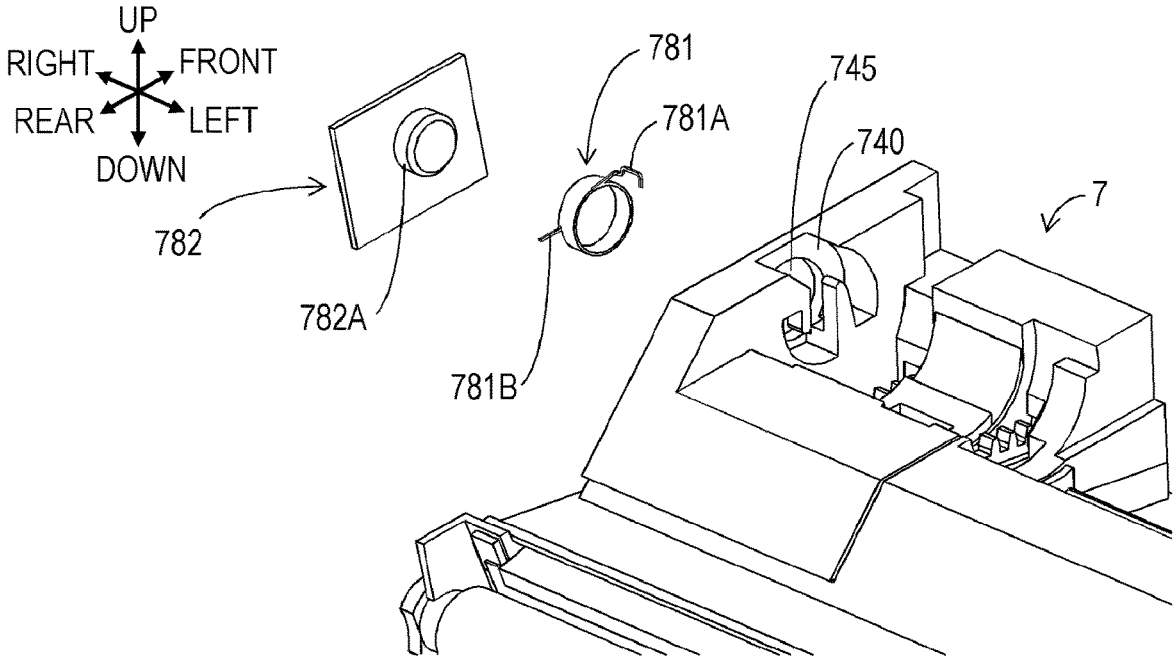
FIGS. 29A and 29B are exploded perspective views of the developing unit and a biasing member according to the first embodiment.
Figure 29B:
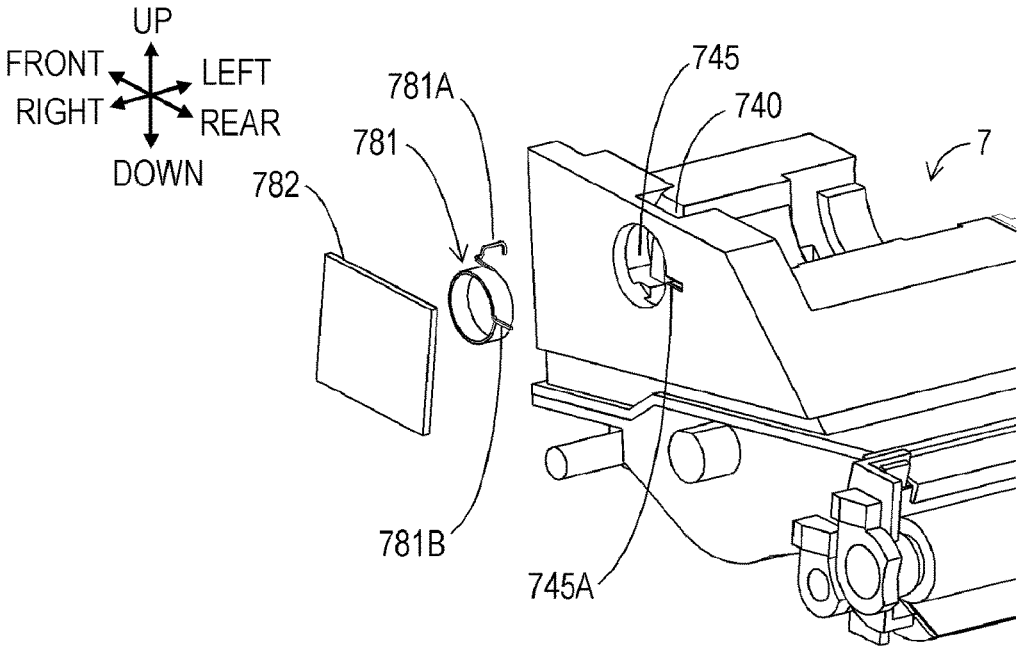

FIGS. 29A and 29B are exploded perspective views showing an enlargement of the vicinity of the support portion 740 of the developing unit 7, FIG. 29A being a view showing the support portion 740 from the inside of the developing unit 7 and FIG. 29B being a view showing the support portion 740 from the outside of the developing unit 7. The support portion 740 includes a hole portion 745. Further, a notch portion 745A is provided in the hole portion 745. Furthermore, a biasing spring 781 and a holding member 782 can be attached to the developing unit 7. A holding projection 782A is provided on the holding member 782.

Figure 30:
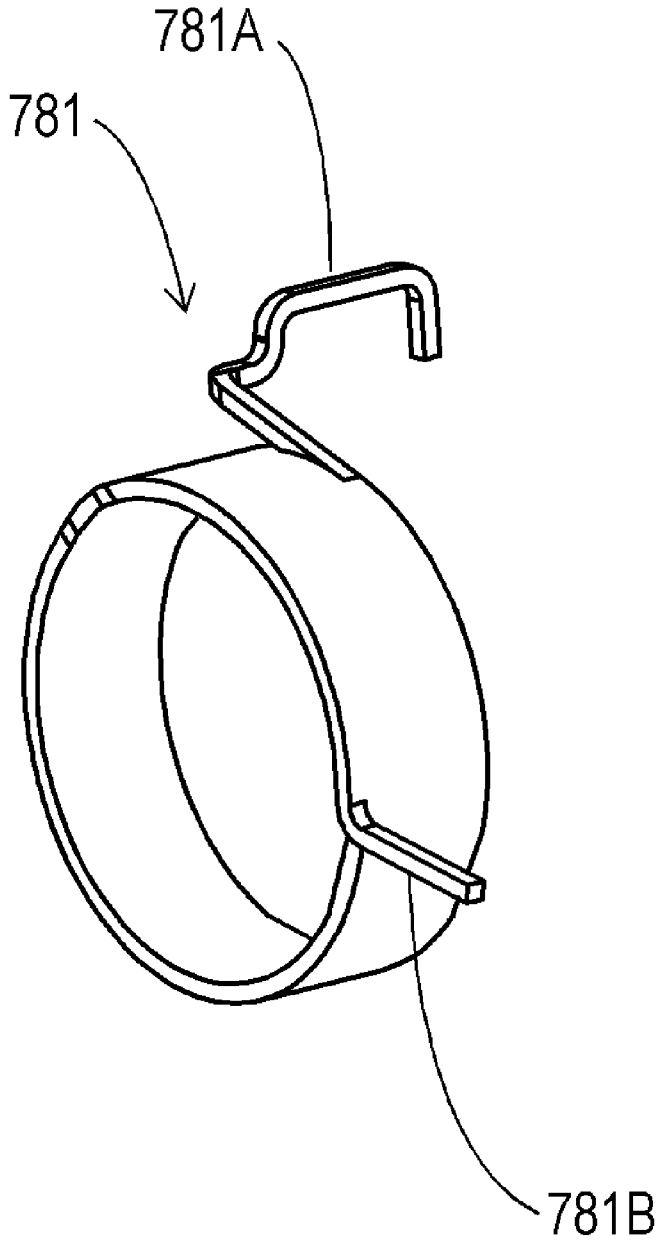
FIG. 30 is a perspective view of the biasing member according to the first embodiment.

Further, FIG. 30 is an enlarged perspective view of the biasing spring 781. The biasing spring 781 is a torsion coil spring with a supported portion 781A formed on one end and an engagement portion 781B formed on the other end. The supported portion 781A is shaped so as to be bent in multiple stages.

Figure 31:
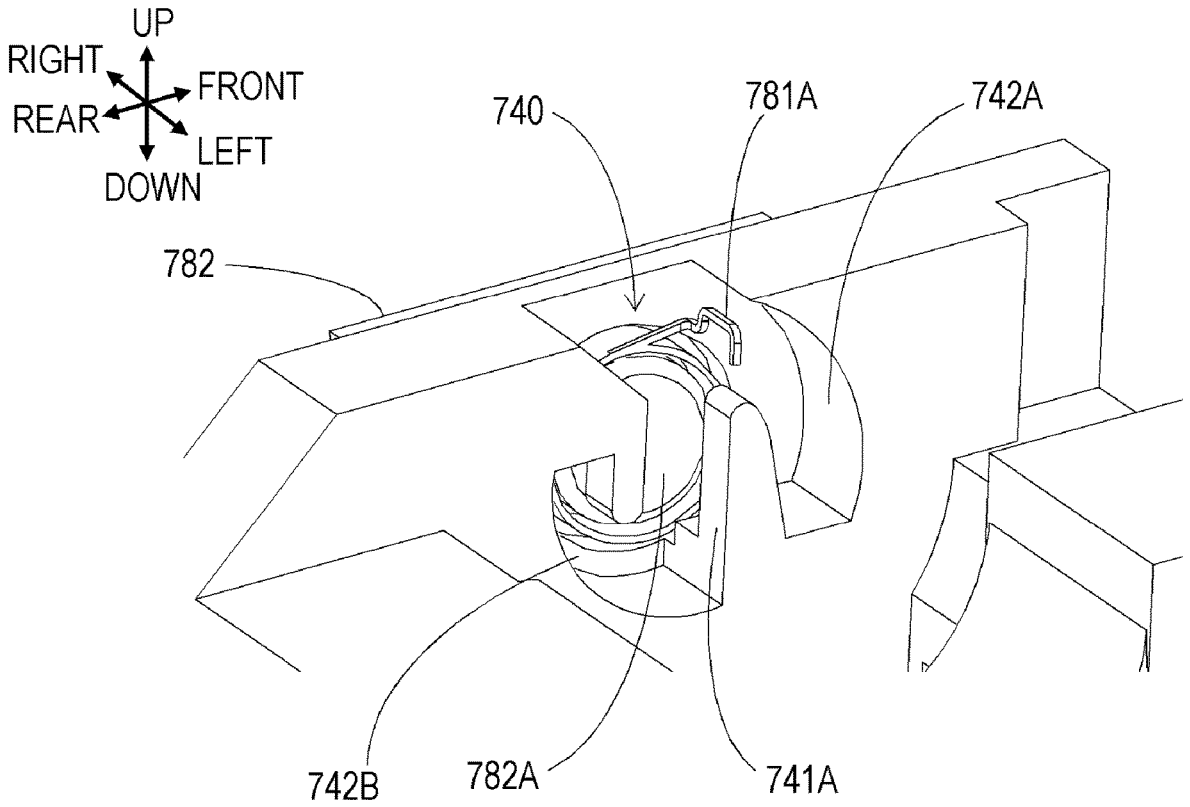
FIG. 31 is a perspective view of the developing unit and the biasing member according to the first embodiment.

Next, FIG. 31 is a perspective view showing a state in which the biasing spring 781 and the holding member 782 are incorporated into the developing unit 7. The biasing spring 781 is held by a holding projection 782A. The biasing spring 781 is also fitted into the hole portion 745, and the engagement portion 781B thereof is fitted into the notch portion 745A shown in FIG. 29B. The supported portion 781A is positioned in a location corresponding to the notch portion 742A.

Figure 32A:
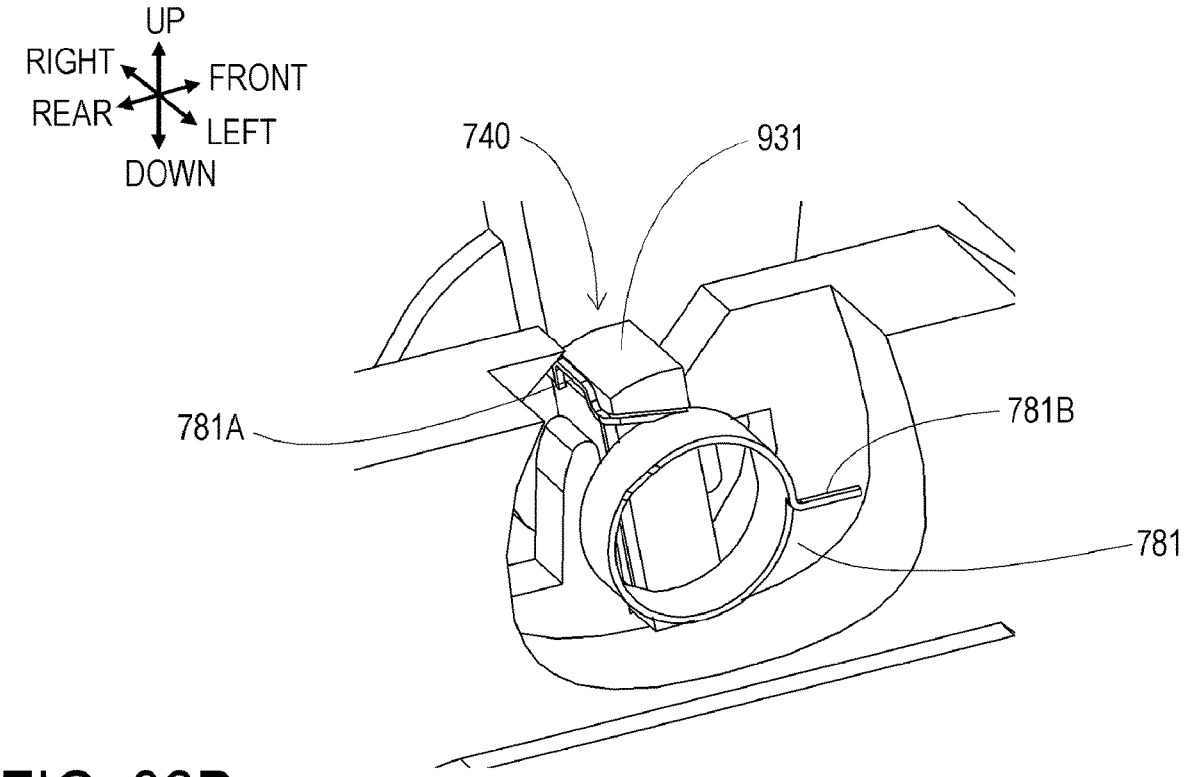
FIGS. 32A and 32B are illustrative views showing configurations of the toner cartridge and the process cartridge according to the first embodiment.
Figure 32B:
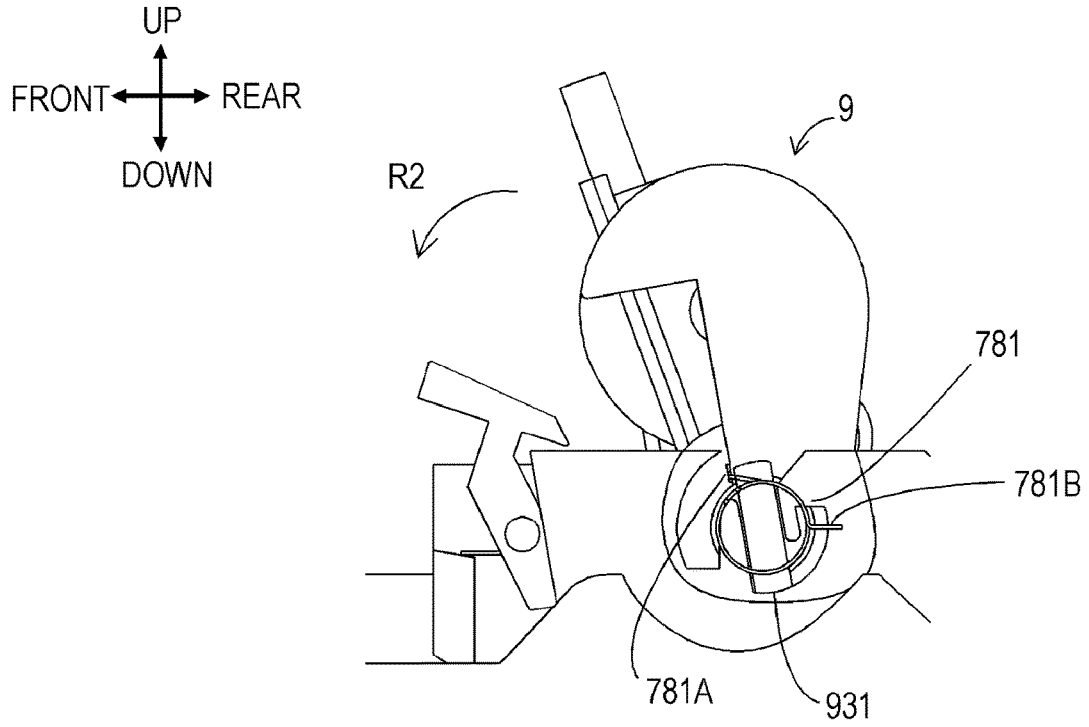

FIGS. 32A and 32B show a state in which the toner cartridge 9 is inserted into the developing unit 7 and the discharge-side shutter 95 remains closed, FIG. 32A being a perspective view thereof and FIG. 32B being a sectional view thereof. Note that for descriptive purposes, the holding member 782 is not shown. In this state, the supported portion 781A contacts a part of the supported projection 931. In this case, the supported portion 781A is formed from a combination of bent portions in multiple stages in order to maximize the contact area between the supported portion 781A and the supported projection 931. Further, the supported portion 781A is arranged so that the part thereof on the upstream side in the rotation direction R2 of the toner cartridge 9 contacts the supported projection 931.

Figure 33A:
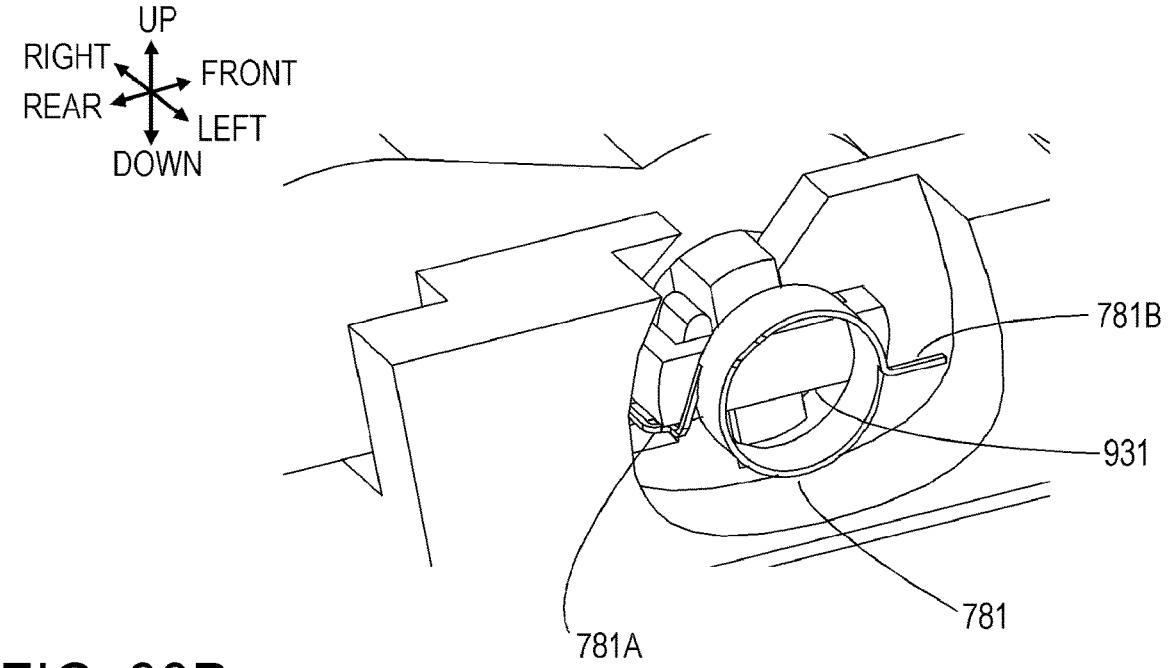
FIGS. 33A and 33B are illustrative views showing the configurations of the toner cartridge and the process cartridge according to the first embodiment.
Figure 33B:
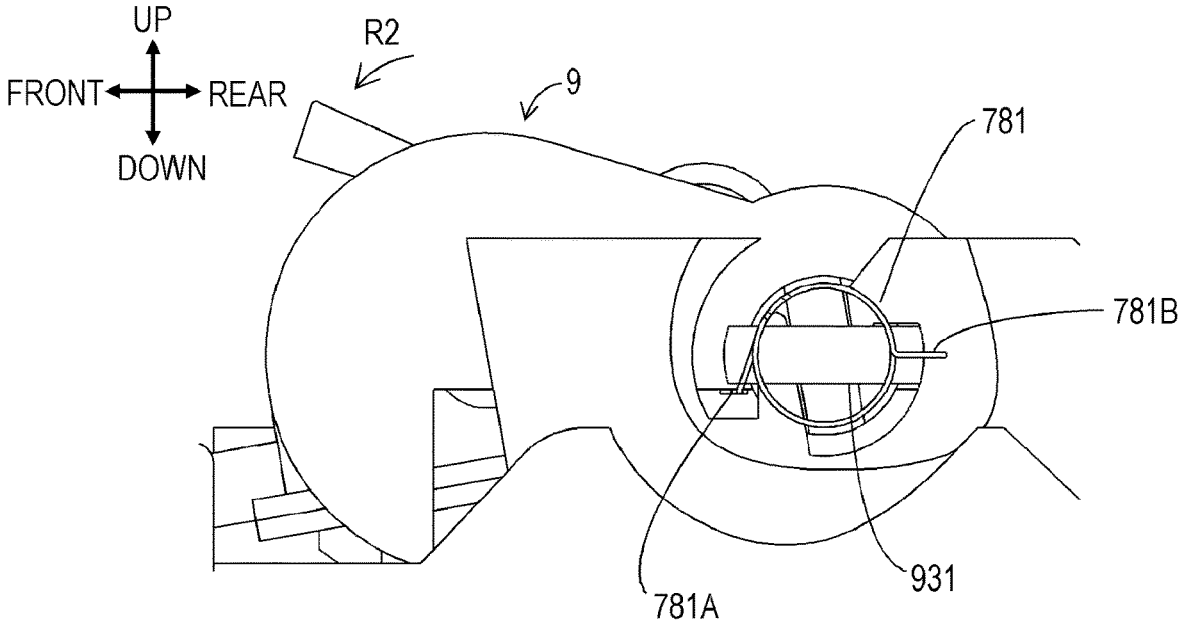

FIGS. 33A and 33B, meanwhile, show a state in which the toner cartridge 9 has been attached to the developing unit 7 by being rotated and the discharge-side shutter 95 is open, FIG. 33A being a perspective view thereof and FIG. 33B being a sectional view thereof. Note that for descriptive purposes, similarly to the state shown in FIGS. 32A and 32B, the holding member 782 is not shown. Similarly to the state shown in FIGS. 27A and 27B, when the cartridge 9 is rotated, the position of the supported portion 781A moves in conjunction with the rotation while the engagement portion 781B remains fixed. As a result, a moment of torsion acts on the biasing spring 781 in direction R1. Hence, similarly to the configuration described above, when the toner cartridge 9 is extracted, the supported projection 931 is rotated by the maximum amount, as shown in FIG. 28, by the biasing force acting in direction R1. As a result, the problem encountered during reattachment, described above, can be solved.

Further, in a state where the toner cartridge 9 is not attached, the supported portion 781A may be arranged in a location corresponding to the notch portion 742B, and the shape of the biasing spring 781 may be set accordingly.

Figure 34A:
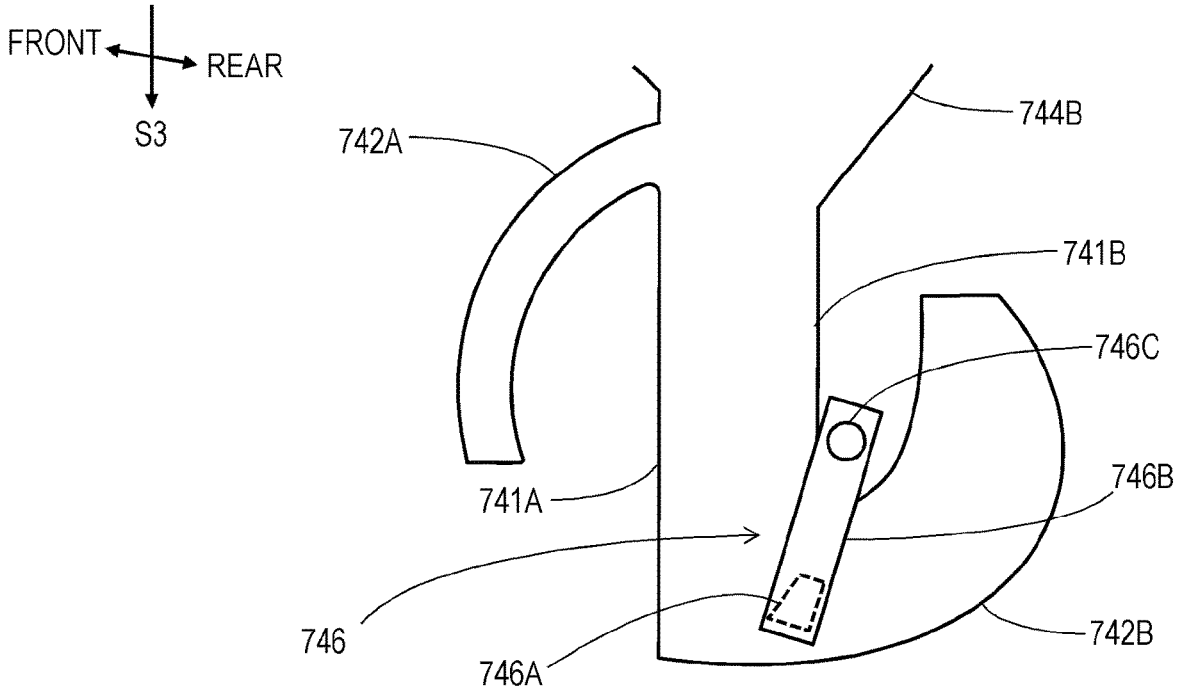
FIGS. 34A and 34B are schematic sectional views of the support portion and a biasing lever according to the first embodiment.
Figure 34B:
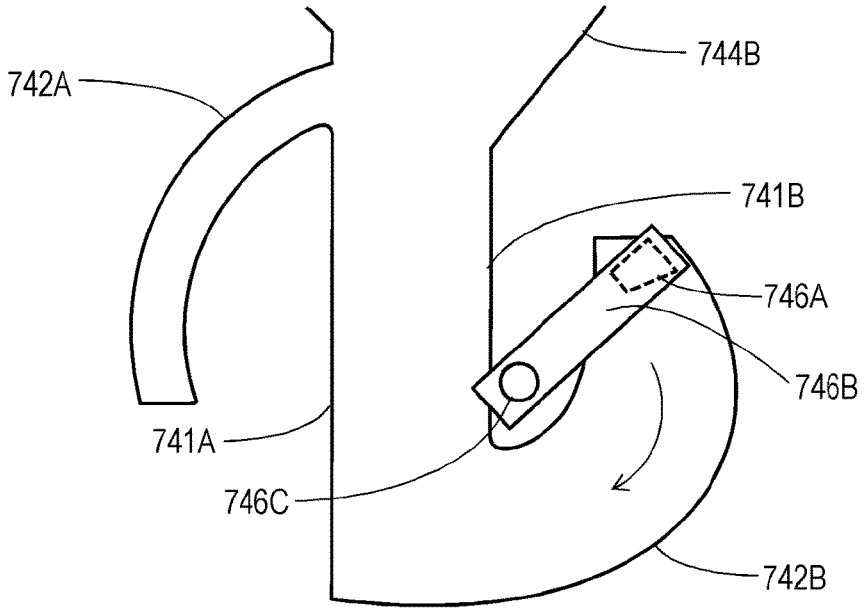

Alternative means for causing force to act in the biasing direction R1 when the toner cartridge 9 is attached to the developing unit 7 will now be described using FIGS. 34A and 34B. FIGS. 34A and 34B show the support portion 740, FIG. 32A showing a state in which the toner cartridge 9 is not inserted into the developing unit 7 and FIG. 32B showing a state in which attachment of the toner cartridge 9 to the developing unit 7 is complete.

As shown in FIGS. 34A and 34B, the support portion 740 includes a biasing lever 746 serving as a lever member. The biasing lever 746 includes a supported projection 746A, an arm 746B, and a holding shaft 746C. The supported projection 746A is provided on the right side (the far side on the sectional view shown in FIGS. 34A and 34B, not denoted by an arrow) of the arm 746B. The supported projection 746A is arranged so as to contact a part of the supported projection 931 as a contact portion when the toner cartridge 9 is attached to the developing unit 7. As the toner cartridge 9 rotates, the biasing lever 746 performs a rotary motion about the holding shaft 746C.

Further, a biasing spring (not shown) is provided on the biasing lever 746, and a part thereof is fixed to the support portion 740. Hence, by shifting from the state shown in FIG.

34A, in which the toner cartridge 9 is unattached, to the state shown in FIG. 34B, in which the toner cartridge 9 is attached, biasing force is exerted on the supported projection 931 by the biasing spring via the supported projection 746A. Likewise in this case, similarly to the case described above, when the toner cartridge 9 is extracted, the supported projection 931 is rotated by the maximum amount, as shown in FIG. 28. As a result, the problem encountered during reattachment, described above, can be solved.

Second Embodiment

Figure 35:
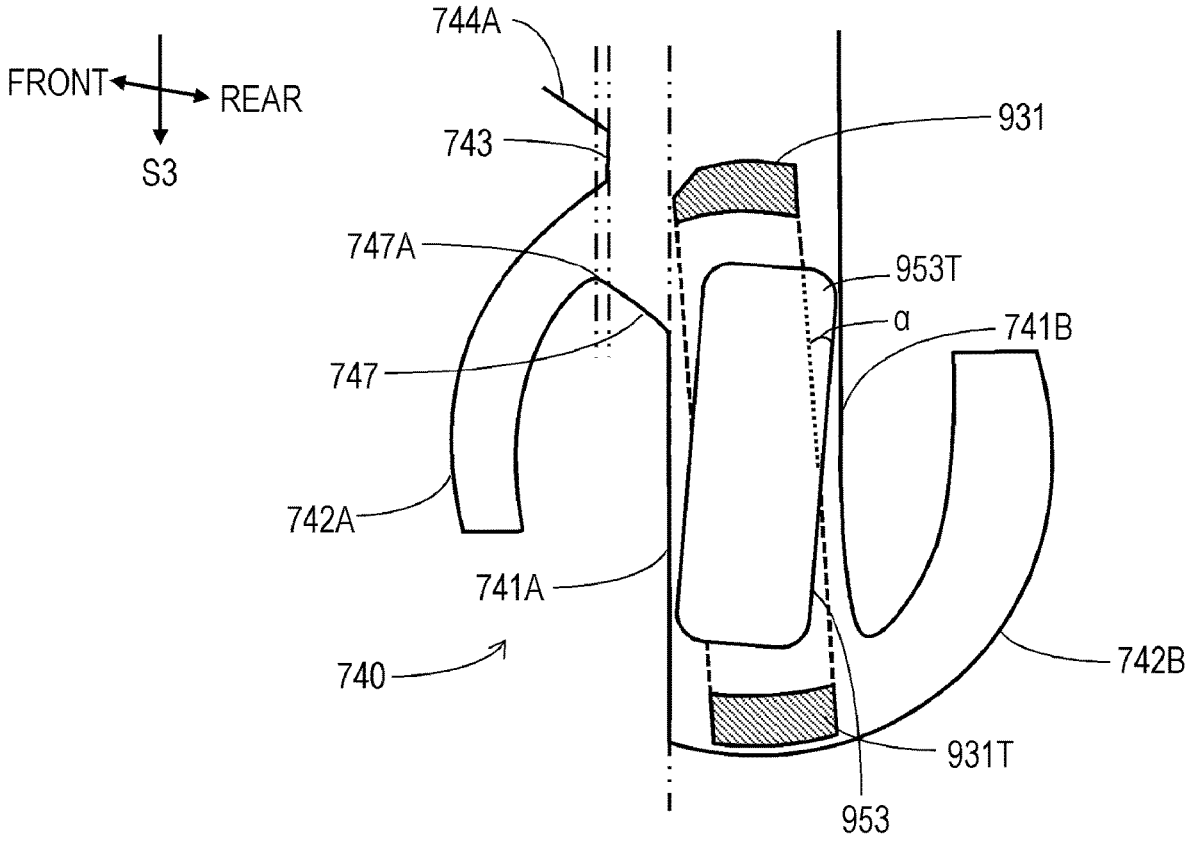
FIG. 35 is a schematic sectional view of a support portion and a projecting portion according to a second embodiment.
Figure 36:
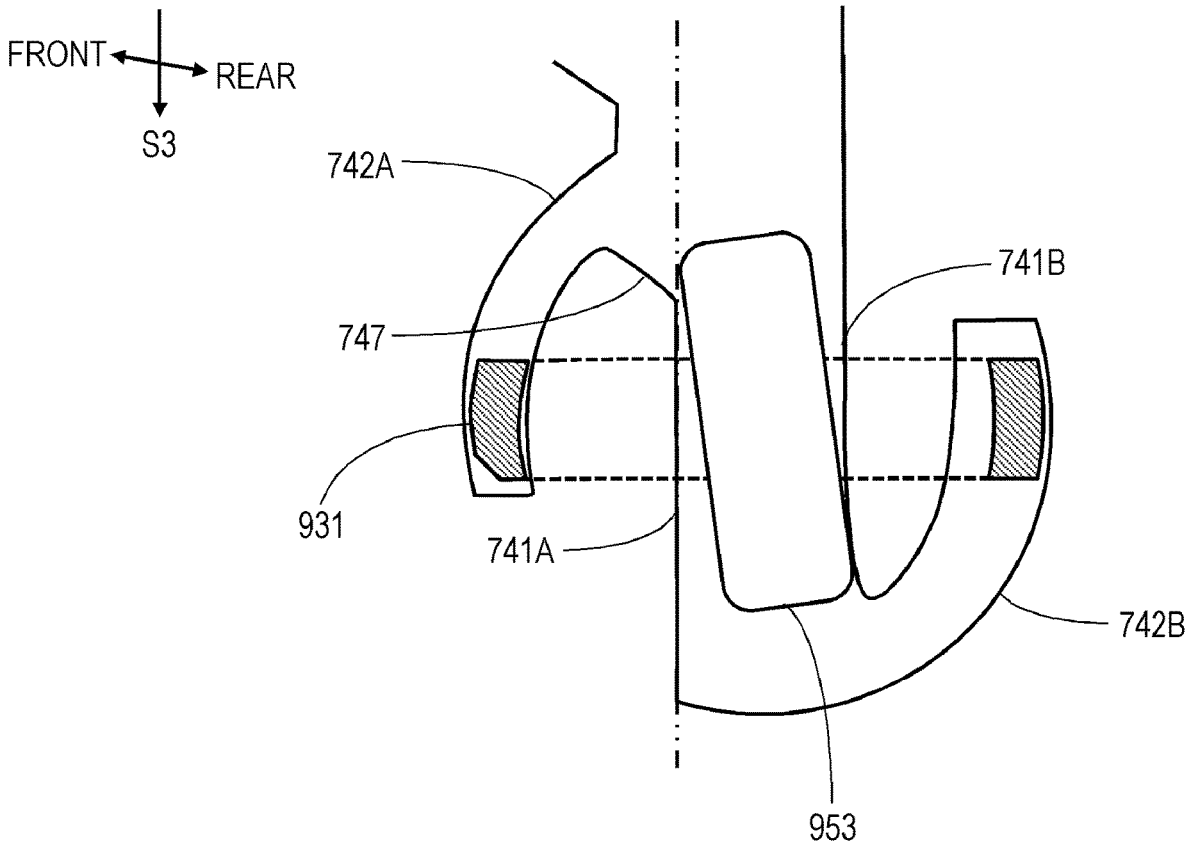
FIG. 36 is a schematic sectional view of the support portion and the projecting portion according to the second embodiment.

A configuration of the toner cartridge 9 according to a second embodiment will now be described using FIGS. 35 and 36. The second embodiment differs from the first embodiment in that a biasing member such as the biasing spring 97 is not provided. All other configurations are similar to the first embodiment and will not be described again. FIG. 35 is a schematic sectional view showing an enlargement of the support portion 740, the supported projection 931, and the engaged projection 953 in a state where the toner cartridge 9 has been inserted into the developing unit 7 in the direction S3 and the discharge-side shutter 95 is closed. Further, FIG. 36 is a schematic sectional view showing an enlargement of the support portion 740, the supported projection 931, and the engaged projection 953 in a state where the toner cartridge 9 has been attached to the developing unit 7 by being rotated and the discharge-side shutter 95 is open. The support portion 740, which serves as an attachment portion between the supported projection 931 and the engaged projection 953, includes a pair of guide walls opposing each other in a substantially orthogonal direction to the attachment direction, and opposing wall surfaces of the pair of guide walls on the downstream side in the attachment direction form the engaging portions 741A and 741B. One upstream side wall surface of the pair of guide walls forms a guide surface that is continuously connected to one engaging portion 741B along the attachment direction. A guide surface that widens so as to increase the width of the attachment portion on the upstream side in the attachment direction is formed on the other wall surface. The latter guide surface includes a tapered portion 747 (a tapered wall surface) and an inner wall surface 743, to be described below.

In the second embodiment, as shown in FIG. 35, the inner wall surface 743 is positioned on the front side of the extension line of the engaging portion 741A. The tapered portion 747 is also provided on the tip end portion of the engaging portion 741A on the upstream side in the direction S3. A tip end portion 747A positioned on the boundary between the tapered portion 747 and the notch portion 742A is positioned further frontward than the aforesaid position of the inner wall surface 743. The engaging portion 741B, meanwhile, extends to the upstream side of the inner wall surface 743 in the insertion direction S3. Hence, in the attachment direction S3 for attaching the toner cartridge 9 to the support portion 740, the tapered portion 744A exists in a front side inlet and the engaging portion 741B exists to the rear of the support portion 740. Thus, during the operation for inserting the toner cartridge 9 into the support portion 740 from the front, insertion into the support portion 740 is guided so that the supported projection 931 and the engaged projection 953 actively contact the surface of the engaging portion 741B. In a state where the supported projection 931 and the engaged projection 953 intersect, respective intersecting portions 931T and 953T of the intersecting supported projection 931 and engaged projection 953 actively contact the engaging portion 741B. Hence, the intersection angle $\alpha$ between the supported projection 931 and the engaged projection 953 receives force in a reducing direction. Furthermore, during the insertion operation, the supported projection 931 and the engaged projection 953 actively contact the engaging portion 741B, and therefore the supported projection 931 and the engaged projection 953 do not forcefully contact the engaging portion 741A on the front side of the supported projection 931 and the engaged projection 953. Due to these effects, the toner cartridge 9 can be inserted without generating an excessive load, and as a result, the toner cartridge 9 can be attached smoothly.

Furthermore, as shown in FIG. 36, when the toner cartridge 9 is rotated, the upstream side of the engaging portion 741A in the insertion direction S3 and the downstream side of the engaging portion 741B in the insertion direction S3 contact the engaged projection 953 so as to act as a rotation stopper. Note that the engaging portion 741B is configured to extend to the downstream side in the insertion direction S3, the reason for this being that since the tapered portion 747 is provided on the tip end portion of the engaging portion 741A on the upstream side in the S3 direction, the part for stopping the rotation of the engaged projection 953 becomes smaller, and therefore, when rotation is stopped by the tapered portion 747, the engaged projection 953 may tilt by a large amount. The engaging portion 741B extends to the downstream side in the insertion direction S3, and the S3 direction tip end portion of the engaged projection 953 is brought into contact with the extended part thereof. Hence, the rotation of the engaged projection 953 can be stopped by the extended part of the engaging portion 741B even when the tapered portion 747 is provided. As a result, the engaged projection 953 can be prevented from tilting by a large amount.

Moreover, when the toner cartridge 9 is rotated, the supported projection 931 enters the notch portion 742A and the notch portion 742B. As a result, the discharge-side shutter is opened such that toner can be supplied.

By using the configuration described above, the problem encountered during reattachment, as described above, can be solved.

Third Embodiment

In a third embodiment, the problem is solved by providing a tapered portion on the projecting portion. This will now be described in detail using FIGS. 37A, 37B to 39, 40A, and 40B. The third embodiment differs from the first embodiment in that a biasing member such as the biasing spring 97 is not provided. All other configurations are similar to the first embodiment and will not be described again.

Figure 37A:
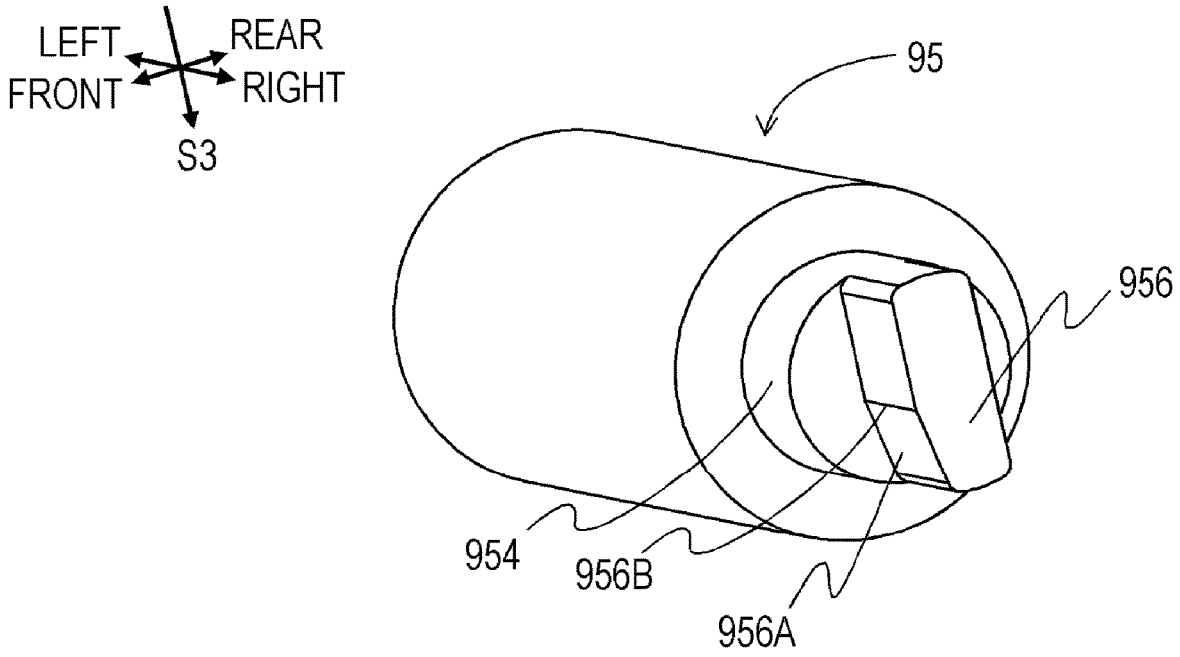
FIGS. 37A and 37B are perspective views and a schematic sectional view of a shutter according to a third embodiment.
Figure 37B:
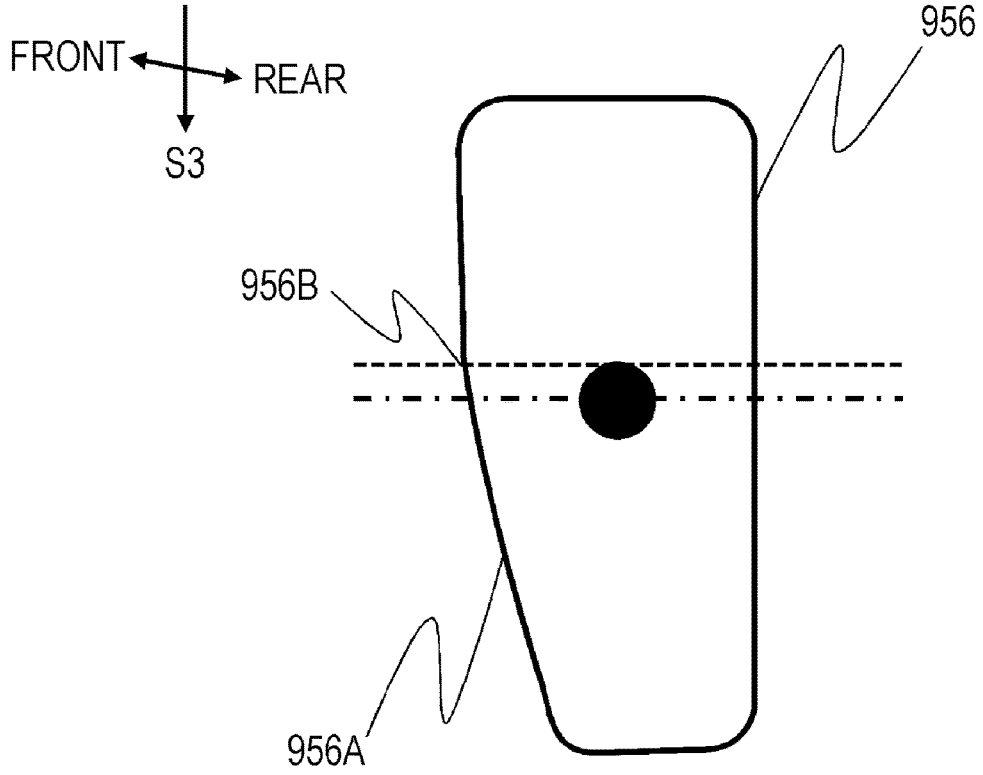

FIGS. 37A and 37B show a configuration according to the third embodiment. FIG. 37A is a perspective view of the discharge-side shutter 95. On an engaged projection 956 provided on the tip end of the discharge-side shutter 95, a tapered portion 956A is provided on the S3 direction side, i.e. the toner cartridge insertion direction side. FIG. 37B is a view seen from a rotary axis direction of the discharge-side shutter 95. A rotational center is indicated by a black dot in the figure.

Here, a taper start position 956B is set on the upstream side of the rotational center in the insertion direction S3. The reason for this is to provide the engaged projection 956 with a tapered shape with which, when the toner cartridge 9 is extracted, as will be described below, a ridgeline of the tapered portion 956A of the engaged projection 956 does not overlap a ridgeline (a dotted line in FIG. 38) of the supported projection 931 and extends inward thereof.

Figure 38:
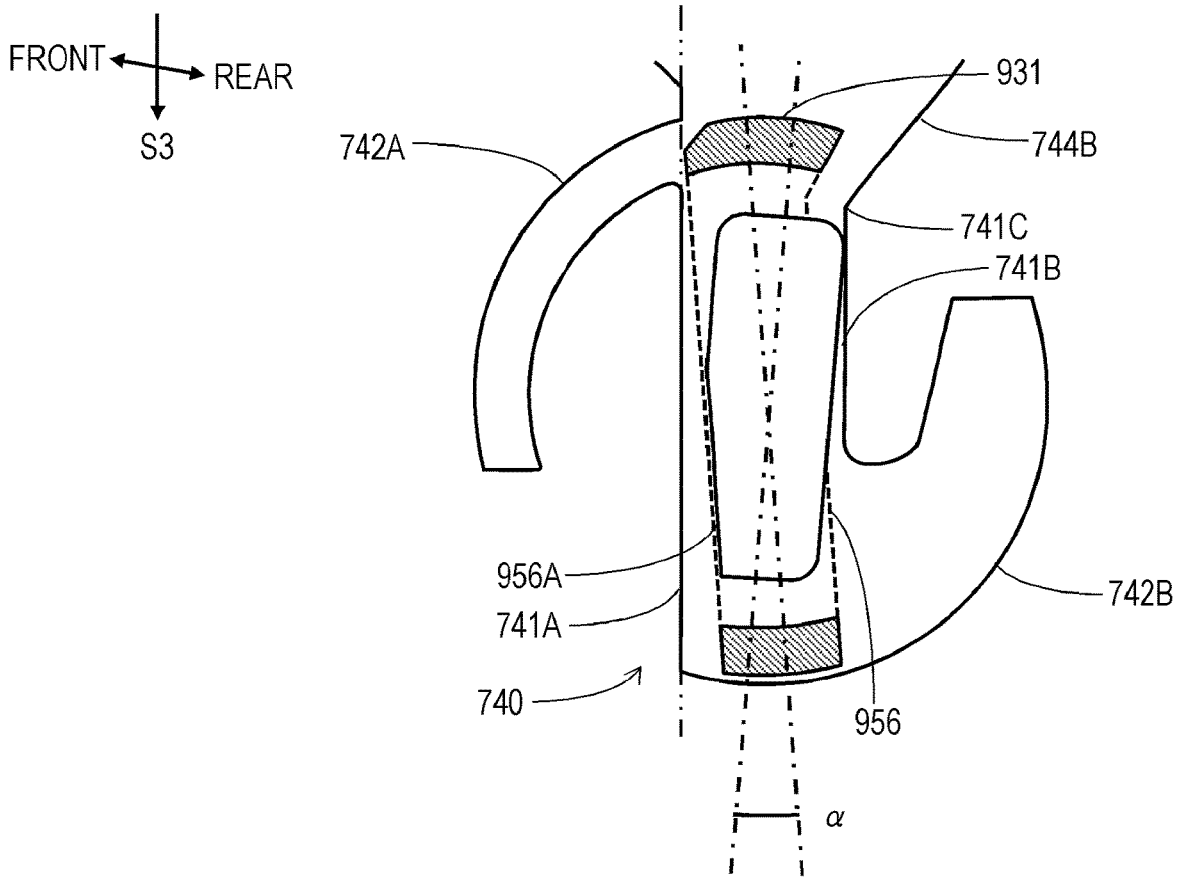
FIG. 38 is a schematic sectional view of a support portion and a projecting portion according to the third embodiment.

Next, FIG. 38 shows a state in which, similarly to the first embodiment, the toner cartridge 9 has been rotated by the minimum extent while being extracted from the developing unit 7. As a featured configuration of the third embodiment, the following tapered shape is provided on the engaged projection 956. The tapered shape is set so that even when the angle between the engaged projection 956 and the supported projection 931 is displaced within a predetermined range from an angle for forming a completely closed state, the width of the engaged projection 956 and the supported projection 931 in an orthogonal direction to the attachment direction, in a case where the engaged projection 956 and the supported projection 931 are projected in the attachment direction, does not exceed a predetermined magnitude. In other words, the tapered shape is set so that even when the angle of the supported projection 931 relative to the engaged projection 956 is insufficient with respect to the angle for forming a completely closed state, the width of the engaged projection 956 and the supported projection 931 in an orthogonal direction to the attachment direction does not exceed a predetermined width. More specifically, when seen in the axial direction, the tapered shape is constituted by an inclined surface (tapered portion 956A) formed by cutting away, in an inclined direction relative to the attachment direction, a corner portion on the attachment direction downstream side, among a pair of corner portions of a substantially rectangular side face of the engaged projection 956 that is long in the attachment direction. The aforesaid predetermined range is a range of the relative angles of the engaged projection 956 and the supported projection 931 in which the toner cartridge 9 can be extracted from the developing unit 7 even when the angle of the supported projection 931 relative to the engaged projection 956 is insufficient.

The direction in which the toner cartridge 9 is extracted from the developing unit 7 is the opposite direction to the attachment direction S3. In other words, the toner cartridge 9 is extracted substantially parallel to the surfaces of the engaging portion 741A and the engaging portion 741B. Hence, as shown in FIG. 38, the toner cartridge 9 can be extracted by rotating the supported projection 931 to a position rearward of the extension line of the engaging portion 741A (illustrated by a dot-dot-dash line in FIG. 38). Note that in the state shown in FIG. 38, the part of the supported projection 931 positioned furthest frontward is positioned on the extension line of the engaging portion 741A. In this case, similarly to the case of the engaged projection 1953 not having a tapered portion, shown in FIG. 23, a part of the engaged projection 956 contacts the engaging portion 741B. In other words, in the state shown in FIG. 38, the supported projection 931 and the engaged projection 956 intersect by the angle $\alpha$ in the cross-sectional direction. In this case, the engaged projection 956 is provided with a tapered shape with which the ridgeline of the tapered portion 956A does not overlap the ridgeline (the dotted line in the figure) of the supported projection 931 and extends inward thereof.

Figure 39:
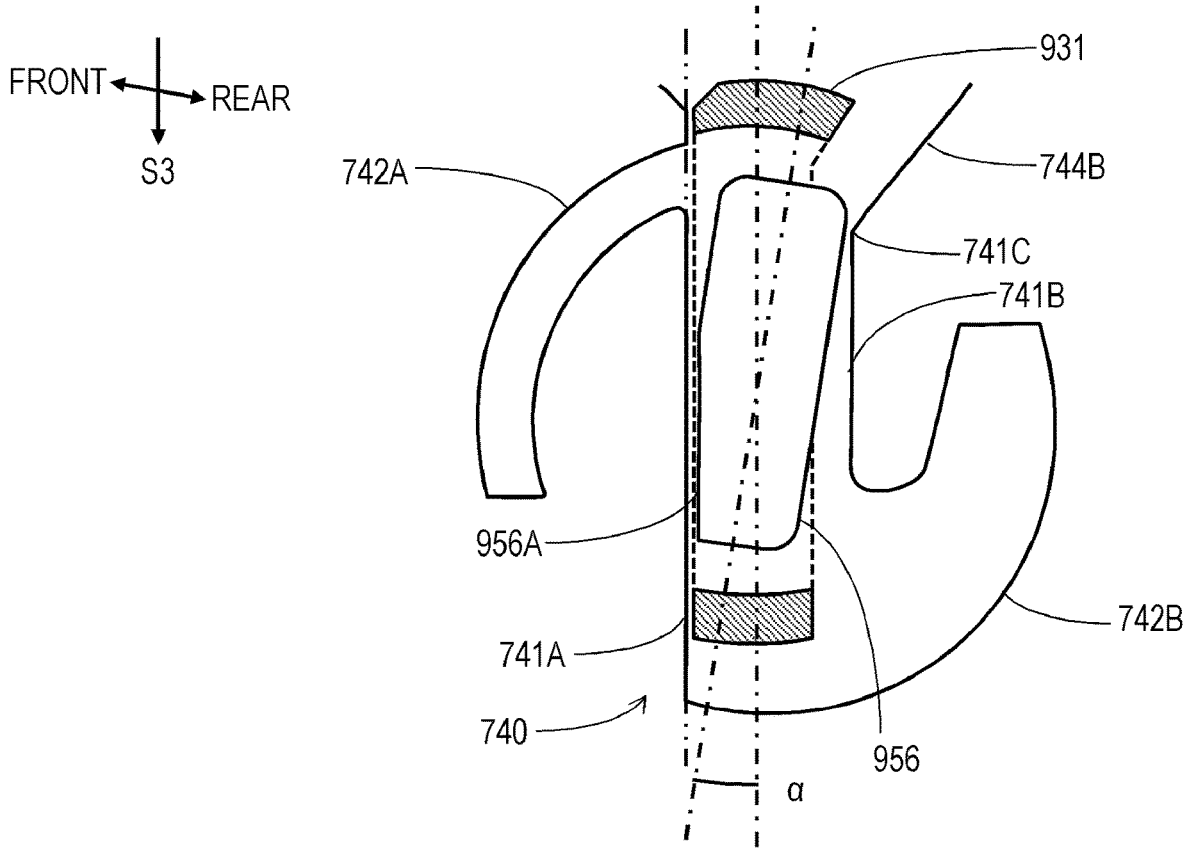
FIG. 39 is a schematic sectional view of the support portion and the projecting portion according to the third embodiment.

Next, FIG. 39 shows the behavior of the toner cartridge during attachment. FIG. 39 is a view showing a case in which, after the toner cartridge 9 is extracted in a state where the supported projection 931 and the engaged projection 956 intersect in the manner shown in FIG. 38, an attempt is made to reattach the same toner cartridge 9 to the developing unit 7 as is. At this time, the engaged projection 956 does not contact the extension line (illustrated by a dot-dot-dash line in FIG. 38) of the engaging portion 741A, and therefore the supported projection 931 can be inserted along the engaging portion 741A. In this case, by pushing the toner cartridge 9 in by a predetermined amount in the attachment direction S3, a part of the engaged projection 956 comes into contact with a vertex portion 741C, as shown in FIG. 39. The vertex portion 741C is the most protruding part of the indentation forming the support portion 740 and the part where the engaging portion 741B and the tapered portion 744B intersect.

Figure 40A:
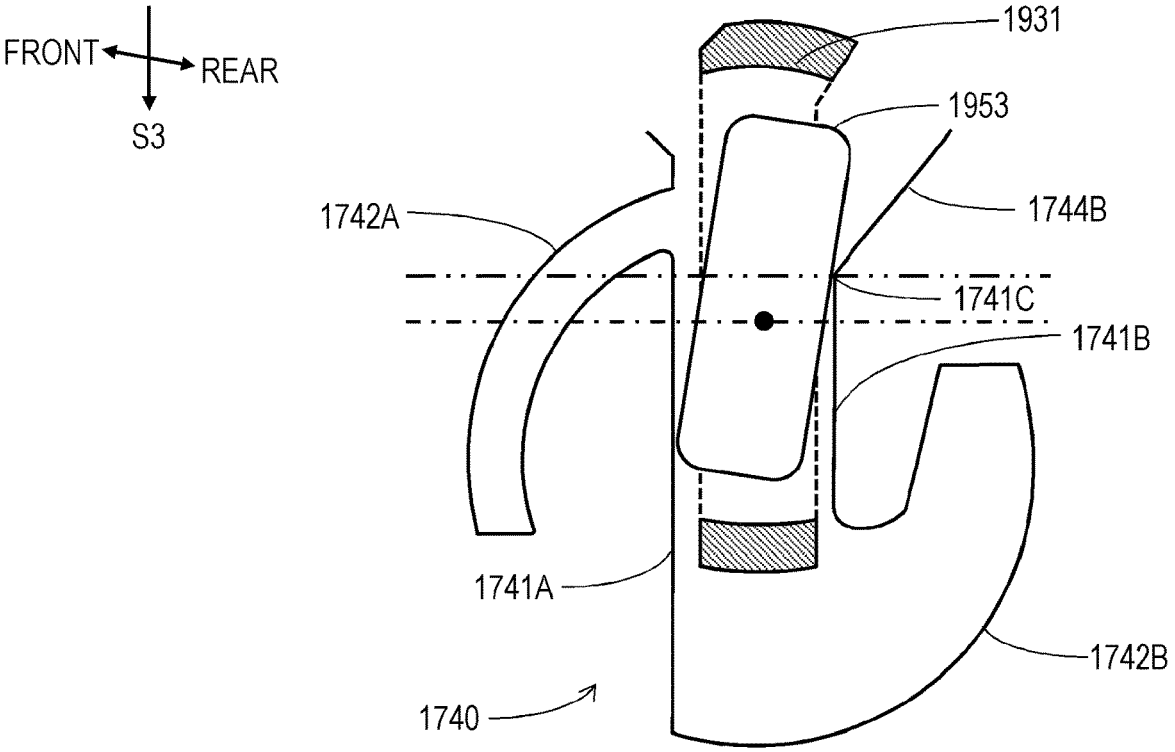
FIGS. 40A and 40B are schematic sectional views of the support portions and projecting portions according to the conventional configuration and the third embodiment.
Figure 40B:
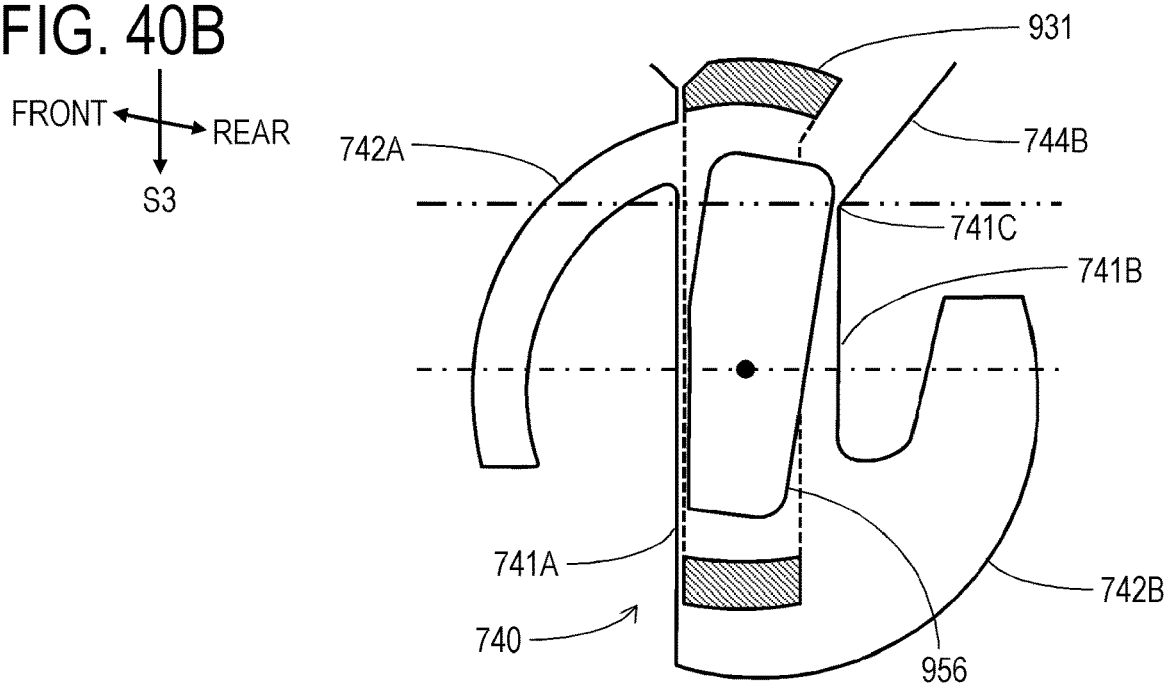

Next, FIGS. 40A and 40B show contact states according to the conventional configuration and the configuration of the third embodiment. FIG. 40A is a view showing the contact state according to the conventional configuration. In the conventional configuration, the position of the rotational center of the engaged projection 1953 is near the vertex portion 1741C where the engaged projection 1953 and the support portion 1740 contact each other, and therefore, when the toner cartridge 9 is pushed in to the insertion direction S3 side, a rotational moment is less likely to act thereon. FIG. 40B, meanwhile, is a view showing the contact state according to the configuration of the third embodiment, in which the position of the rotational center of the engaged projection 953 is further away from the vertex portion 741C where the engaged projection 953 and the support portion 740 contact each other than the rotational center shown in FIG. 40A such that a rotational moment is more likely to act. Moreover, the contact location is a single location, and therefore the amount of resistance caused by friction is small, meaning that the toner cartridge 9 can rotate more easily than when a tapered shape is not provided.

Hence, by providing the projecting portion with a tapered shape, the toner cartridge can be reattached without impeding the attachment operation when the toner cartridge is inserted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-119123, filed on Jul. 10, 2020, which is hereby incorporated by reference herein in its entirety.

What is claimed is:

1. A toner cartridge attachable to and detachable from a developing unit of an image forming apparatus for forming an image on a recording material, the toner cartridge comprising:

a toner housing portion that houses toner and that has a first end portion and a second end portion on an opposite side to the first end portion in a longitudinal direction of the toner cartridge;

a conveyance member that is disposed in the interior of the toner housing portion, includes a rotary axis, and that conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the toner cartridge is configured such that by rotating the toner housing portion relative to the shutter in a state in which the first portion-to-be-engaged is engaged to a first engaging portion of the developing unit, relative positions of the cover and the shutter are displaced from first relative position, in which the closing portion opposes the second opening, to second relative position, in which the interior of the toner housing portion communicates with a reception port of the developing unit through the first opening and the second opening, and the second portion-to-be-engaged is engaged to a second engaging portion of the developing unit, thereby completing attachment of the toner cartridge to the developing unit, and wherein the toner cartridge includes a biasing member that exerts a biasing force for generating relative rotation between the cover and the shutter in a direction for displacing the relative positions thereof from the second relative position to the first relative position.

2. The toner cartridge according to claim 1, wherein the second portion-to-be-engaged is adjacent to the first portion-to-be-engaged in an orthogonal direction to the axis parallel to the axial direction and is caused to rotate relative to the first portion-to-be-engaged about the axis parallel to the axial direction by the relative rotation between the toner housing portion and the shutter.

3. The toner cartridge according to claim 2, wherein, before the toner housing portion is rotated relative to the shutter during attachment of the toner cartridge to the developing unit, the first portion-to-be-engaged and the second portion-to-be-engaged, in a case of being seen in the axial direction, are set in a first arrangement arranged side by side in an attachment direction in which the toner cartridge is attached to the developing unit, and after the toner housing portion is rotated relative to the shutter, the first portion-to-be-engaged and the second portion-to-be-engaged are set in a second arrangement arranged side by side in a direction that intersects the attachment direction.

4. The toner cartridge according to claim 3, wherein, in a case where the toner cartridge is attached to and detached from the developing unit, the first portion-to-be-engaged and the second portion-to-be-engaged are inserted into and extracted from a predetermined attachment portion, which is provided on the developing unit, in the attachment direction and in the first arrangement.

5. The toner cartridge according to claim 1, wherein the biasing member is a torsion coil spring fixed, at one end thereof, to the cover and fixed, at the other end thereof, to the shutter.

6. A toner cartridge attachable to and detachable from a developing unit of an image forming apparatus for forming an image on a recording material, the toner cartridge comprising:

a toner housing portion that houses toner and that has a first end portion and a second end portion on an opposite side to the first end portion in a longitudinal direction of the toner cartridge;

a conveyance member that is disposed in the interior of the toner housing portion, includes a rotary axis, and conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the toner cartridge is configured such that by rotating the toner housing portion relative to the shutter in a state in which the first portion-to-be-engaged is engaged to a first engaging portion of the developing unit, relative positions of the cover and the shutter are displaced from first relative position, in which the closing portion opposes the second opening, to second relative position, in which the interior of the toner housing portion communicates with a reception port of the developing unit through the first opening and the second opening, and the second portion-to-be-engaged is engaged to a second engaging portion of the developing unit, thereby completing attachment of the toner cartridge to the developing unit, wherein the first portion-to-be-engaged and the second portion-to-be-engaged are configured such that before the toner housing portion is rotated relative to the shutter during attachment of the toner cartridge to the developing unit, the first portion-to-be-engaged and the second portion-to-be-engaged, in a case of being seen in the axial direction, are set in a first arrangement arranged side by side in an attachment direction in which the toner cartridge is attached to the developing unit, and after the toner housing portion is rotated relative to the shutter, the first portion-to-be-engaged and the second portion-to-be-engaged are set in a second arrangement arranged side by side in a direction that intersects the attachment direction, and wherein the first portion-to-be-engaged has a tapered shape in a case of being seen in the axial direction, the tapered shape being formed so that even though an angle of the first portion-to-be-engaged relative to the second portion-to-be-engaged in the first arrangement is displaced within a predetermined range, a width of the first portion-to-be-engaged and the second portion-to-be-engaged in an orthogonal direction to the attachment direction, in a case where the first portion-to-be-engaged and the second portion-to-be-engaged are projected in the attachment direction, does not vary.

7. The toner cartridge according to claim 6, wherein the first portion-to-be-engaged, in a case of being seen in the axial direction, has a substantially rectangular side face that is long in the attachment direction, and as the tapered shape includes an inclined surface formed by cutting away, in an inclined direction relative to the attachment direction, a corner portion on a downstream side in the attachment direction, among a pair of corner portions of the side face.

8. The toner cartridge according to claim 7, wherein an end portion of the inclined surface on an upstream side in the attachment direction, in a case of being seen in the axial direction, is positioned on the attachment direction upstream side of the rotational center of the first portion-to-be-engaged.

9. The toner cartridge according to claim 7, wherein a ridgeline of the inclined surface, in a case of being seen in the axial direction, is positioned inward of the second portion-to-be-engaged in an orthogonal direction to the attachment direction.

10. The toner cartridge according to claim 6, wherein in a case where the toner cartridge is attached to and detached from the developing unit, the first portion-to-be-engaged and the second portion-to-be-engaged are inserted into and extracted from a predetermined attachment portion, which is provided on the developing unit, in the attachment direction and in the first arrangement, and wherein the predetermined range is a range of relative angles of the first portion-to-be-engaged and the second portion-to-be-engaged in which the first engaged portion and the second portion-to-be-engaged can be extracted from the predetermined attachment portion in a case where the toner cartridge is detached from the developing unit.

11. The toner cartridge according to claim 1, wherein the second portion-to-be-engaged includes a pair of leg portions and a connecting portion connecting the pair of leg portions, wherein the connecting portion is positioned on the outside of the first portion-to-be-engaged in the axial direction, and wherein the pair of leg portions are arranged to straddle the first portion-to-be-engaged via the connecting portion and arranged symmetrically relative to the first portion-to-be-engaged in a case of being seen in the axial direction.

12. The toner cartridge according to claim 1, wherein the conveyance member is a screw having a spiral-shaped blade portion on the outer periphery of the rotary axis.

13. The toner cartridge according to claim 1, wherein the cover includes a gear portion that engages with an opening/closing member for opening and closing the reception port of the developing unit in a state where the first portion-to-be-engaged is engaged to the first engaging portion of the developing unit, and in a case where the toner housing portion and the shutter rotate relative to each other, the gear portion causes the opening/closing member to open and close the reception port.

14. A developing unit of an image forming apparatus for forming an image on a recording material, the developing unit comprising:

a carrier that carries toner;

a casing in which the carrier is incorporated, the casing having a first toner housing chamber for housing the toner; and a toner cartridge that can be attached to and detached from the casing, wherein the casing comprises:

a reception port that receives toner supplied from the toner cartridge; and an attachment portion including a first engaging portion and a second engaging portion for engaging the toner cartridge to the casing, wherein the toner cartridge comprises:

a toner housing portion that houses the toner and that has a first end portion and a second end portion on an opposite side to the first end portion in a longitudinal direction of the toner cartridge;

a conveyance member that is disposed in the interior of the toner housing portion, includes a rotary axis, and conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the developing unit is configured such that by rotating the toner housing portion relative to the shutter in a state in which the first portion-to-be-engaged is engaged to the first engaging portion of the developing unit, relative positions of the cover and the shutter are displaced from first relative position, in which the closing portion opposes the second opening, to second relative position, in which the interior of the toner housing portion communicates with the reception port of the developing unit through the first opening and the second opening, and the second portion-to-be-engaged is engaged to the second engaging portion of the developing unit, thereby completing attachment of the toner cartridge to the developing unit, and wherein the developing unit includes a biasing member that exerts a biasing force for generating relative rotation between the cover and the shutter in a direction for displacing the relative positions thereof from the second relative position to the first relative position.

15. The developing unit according to claim 14, wherein the second portion-to-be-engaged is adjacent to the first portion-to-be-engaged in an orthogonal direction to the axis parallel to the axial direction and is caused to rotate relative to the first portion-to-be-engaged about the axis parallel to the axial direction by the relative rotation between the toner housing portion and the shutter.

16. The developing unit according to claim 15, wherein, before the toner housing portion is rotated relative to the shutter during attachment of the toner cartridge to the developing unit, the first portion-to-be-engaged and the second portion-to-be-engaged, in a case of being seen in the axial direction, are set in a first arrangement arranged side by side in an attachment direction in which the toner cartridge is attached to the developing unit, and after the toner housing portion is rotated relative to the shutter, the first portion-to-be-engaged and the second portion-to-be-engaged are set in a second arrangement arranged side by side in a direction that intersects the attachment direction.

17. The developing unit according to claim 16, wherein, in a case where the toner cartridge is attached to and detached from the developing unit, the first portion-to-be-engaged and the second portion-to-be-engaged are inserted into and extracted from a predetermined attachment portion, which is provided on the developing unit, in the attachment direction and in the first arrangement.

18. The developing unit according to claim 14, wherein the biasing member is a torsion coil spring, one end of which is fixed to the casing and the other end of which contacts the second portion-to-be-engaged so as to exert the biasing force thereon.

19. The developing unit according to claim 14, wherein the biasing member comprises:

a lever that is attached rotatably to the casing at one end and has a contact portion that contacts the second portion-to-be-engaged on the other end; and a spring provided between the casing and the lever in order to cause the contact portion to exert the biasing force on the second portion-to-be-engaged.

20. A developing unit provided in an image forming apparatus for forming an image on a recording material, the developing unit comprising:

a carrier that carries toner;

a casing in which the carrier is incorporated, the casing having a first toner housing chamber for housing the toner; and a toner cartridge that can be attached to and detached from the casing, wherein the casing comprises:

a reception port that receives toner supplied from the toner cartridge; and an attachment portion including a first engaging portion and a second engaging portion for engaging the toner cartridge to the casing, wherein the toner cartridge comprises:

a toner housing portion that houses the toner and that has a first end portion and a second end portion on an opposite side to the first end portion in a longitudinal direction of the toner cartridge;

a conveyance member that is disposed in the interior of the toner housing portion, includes a rotary axis, and conveys the toner housed in the toner housing portion toward one end of the conveyance member in an axial direction of the rotary axis;

a shutter that is incorporated to the first end portion of the toner housing portion in the axial direction so as to be capable of rotating relative to the toner housing portion about an axis parallel to the axial direction, and that includes a first opening that allows the toner housed in the toner housing portion to be discharged to the exterior from the interior of the toner housing portion, a closing portion for preventing the toner from moving to the exterior, and a first portion-to-be-engaged that projects in the axial direction;

a cover that is fixed to the first end portion of the toner housing portion in the axial direction so as to cover the shutter and that includes a second opening which, together with the first opening, allows the toner housed in the toner housing portion to be discharged to the exterior from the interior of the toner housing portion; and a second portion-to-be-engaged that is provided to the first end portion of the toner housing portion in the axial direction, wherein the first portion-to-be-engaged and the second portion-to-be-engaged, in a case of being seen in the axial direction, are configured to be capable of taking a first arrangement arranged side by side in an attachment direction in which the toner cartridge is attached to the developing unit, and a second arrangement arranged side by side in a direction that intersects the attachment direction, wherein the toner cartridge is configured such that in a case where the toner cartridge is to be attached to the developing unit, by rotating the toner housing portion relative to the shutter in a state in which the first portion-to-be-engaged and the second portion-to-be-engaged are inserted into the attachment portion in the first arrangement and the first portion-to-be-engaged is engaged to the first engaging portion, relative positions of the cover and the shutter are displaced from first relative position, in which the closing portion opposes the second opening, to second relative position, in which the interior of the toner housing portion communicates with the reception port through the first opening and the second opening, and the second portion-to-be-engaged is engaged to the second engaging portion after entering the second arrangement, thereby completing attachment of the toner cartridge to the developing unit, wherein the attachment portion, in a case of being seen in the axial direction, includes a pair of guide walls opposing each other in an orthogonal direction to the attachment direction, and wherein the pair of guide walls are configured such that opposing wall surfaces on the downstream side in the attachment direction form the first engaging portion, one wall surface on the upstream side in the attachment direction extends along the attachment direction and is connected to the first engaging portion, and the other wall surface on the upstream side in the attachment direction includes a tapered wall surface that inclines so as to increase the width of the attachment portion on the upstream side in the attachment direction.

21. The developing unit according to claim 20, wherein the second portion-to-be-engaged includes a pair of leg portions and a connecting portion connecting the pair of leg portions, wherein the connecting portion is positioned on the outside of the first portion-to-be-engaged in the axial direction, and wherein the pair of leg portions are arranged to straddle the first portion-to-be-engaged via the connecting portion and arranged symmetrically relative to the first portion-to-be-engaged in a case of being seen in the axial direction.

22. The developing unit according to claim 20, wherein the conveyance member is a screw having a spiral-shaped blade portion on the outer periphery of the rotary axis.

23. The developing unit according to claim 20, wherein the casing includes an opening/closing member for opening and closing the reception port, wherein the cover includes a gear portion that engages with the opening/closing member in a state where the first portion-to-be-engaged is engaged to the first engaging portion, and wherein, in a case where the toner housing portion and the shutter rotate relative to each other in the state where the first portion-to-be-engaged is engaged to the first engaging portion, the gear portion causes the opening/closing member to open and close the reception port.

24. The developing unit according to claim 20, wherein the casing includes a lock mechanism for maintaining attitude of the toner cartridge, in which the cover and the shutter are in the second relative position, relative to the casing.

25. A process cartridge attachable to and detachable from an apparatus main body of an image forming apparatus for forming an image on a recording material, the process cartridge comprising:

a photosensitive member unit including a photosensitive member on which a latent image is formed;

a developing unit for forming a toner image on the photosensitive member by developing the latent image; and the toner cartridge according to claim 1.

26. A process cartridge attachable to and detachable from an apparatus main body of an image forming apparatus for forming an image on a recording material, the process cartridge comprising:

a photosensitive member unit including a photosensitive member on which a latent image is formed; and the developing unit according to claim 14, for forming a toner image on the photosensitive member by developing the latent image.

27. An image forming apparatus forming an image on a recording material, the image forming apparatus comprising:

an apparatus main body including a photosensitive member unit that includes a photosensitive member on which a latent image is formed, a developing unit for forming a toner image on the photosensitive member by developing the latent image, and a transfer unit for transferring the toner image onto the recording material; and the toner cartridge according to claim 1, which can be attached to and detached from the developing unit.

28. An image forming apparatus for forming an image on a recording material, the image forming apparatus comprising:

a photosensitive member unit including a photosensitive member on which a latent image is formed;

the developing unit according to claim 14, for forming a toner image on the photosensitive member by developing the latent image; and a transfer unit for transferring the toner image onto the recording material.

* * * * *